US005918873A

United States Patent [19]

Saito et al.

[11] Patent Number: 5,918,873

[45] **Date of Patent: *Jul. 6, 1999**

[54] SHEET SUPPLYING APPARATUS WHICH REGULATES TIP END OF SHEET BY FIRST AND SECOND ABUTMENT MEANS

[75] Inventors: Hiroyuki Saito, Yokohama; Haruyuki Yanagi, Machida; Satoshi Saikawa, Inagi; Tan At Ming, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/621,882

[22] Filed: Mar. 26, 1996

[30] Foreign Application Priority Data

Mar. 30, 1995 [JP] Japan ..... 7-073899
Jun. 30, 1995 [JP] Japan ..... 7-165349

[51] Int. Cl.[6] ..... B65H 5/00

[52] U.S. Cl. ..... 271/10.11; 271/118; 271/121; 271/127; 271/167; 271/170; 271/119

[58] Field of Search ..... 271/117, 118, 271/121, 124, 125, 127, 167, 10.11, 170, 119

[56] References Cited

U.S. PATENT DOCUMENTS 4,900,003 2/1990 Hashimoto .
5,277,417 1/1994 Moritake et al. ..... 271/121
5,298,959 3/1994 Saito et al. .
5,348,283 9/1994 Yanagi et al. .
5,370,380 12/1994 Suzuki et al. .
5,437,444 8/1995 Kawakami et al. ..... 271/121 X
5,480,247 1/1996 Saikawa et al. ..... 271/119 X
5,527,029 6/1996 Bortolotti et al. ..... 271/124
5,528,352 6/1996 Ichinokawa et al. ..... 271/121 X
5,582,399 12/1996 Sugiura ..... 271/119 X

FOREIGN PATENT DOCUMENTS 0 627 321 12/1994 European Pat. Off. .
0 672 601 9/1995 European Pat. Off. .

OTHER PUBLICATIONS

Patent Abstracts of Japan, vol. 013, No. 380 (M–863), Aug. 23, 1989 & JP 01–133 835 A (Canon Inc.), May 25, 1989.

*Primary Examiner*—Boris Milef
*Attorney, Agent, or Firm*—Fitzpatrick, Cella, Harper & Scinto

[57] ABSTRACT

The present invention provides a sheet supplying apparatus which has a sheet supporting unit for supporting a sheet, a first abutment member for regulating a tip end of the sheet supported by the sheet supporting unit, a displaceable second abutment member for regulating the tip end of the sheet supported by the sheet supporting unit, and a sheet supply for feeding out the sheet supported by the sheet supporting unit An angle between a surface of the sheet supported by the sheet supporting unit and a sheet abutment surface of the second abutment member is smaller than an angle between the surface of the sheet and a sheet abutment surface of the first abutment member.

17 Claims, 37 Drawing Sheets

| |
|---|
| FIG. 21A |
| FIG. 21B |
| FIG. 21C |

SHEET SUPPLYING APPARATUS WHICH REGULATES TIP END OF SHEET BY FIRST AND SECOND ABUTMENT MEANS

BACKGROUND OF THE INVENTION

1. Field of the Invention

The present invention relates to a sheet supplying apparatus used with a recording apparatus such as a printer, a copying machine, a facsimile and the like.

2. Related Background Art

In conventional recording apparatuses such as printers, copying machines, facsimiles and the like, a thick sheet such as a post card, an envelope or a special sheet such as a plastic film are used as a sheet, as well as a plain sheet. The sheet is manually supplied or inserted one by one, or the sheets are automatically and successively supplied by means of a sheet supplying apparatus.

FIGS. 44 and 45 show an example of a conventional recording apparatus integrally incorporating a sheet supplying apparatus therein. In FIGS. 44 and 45, the recording apparatus comprises a sheet supplying apparatus 100 for separating and supplying sheets P one by one, and a recording portion 101 for recording an image on the supplied sheet P. The sheet supplying apparatus 100 has a pressure plate 103 shiftable with respect to a base (sheet stacking means) 102, and a sheet stack P rested on the pressure plate 103 is urged against a sheet supply roller 105 and rollers 105 coaxial with the sheet supply roller by means of a pressure spring 104. Further, a separation pawl 107 is located at a position corresponding to one of front corners of the sheet stack P. The separation pawl 107 is disposed at only one corner of the sheet stack.

Tip end of the sheets P stacked on the pressure plate abut against a sheet tip end abutment portion 102*a* provided at a lower end of the base 101. As shown in FIG. 45, an abutment surface of the sheet tip end abutment portion 102*a* is inclined with respect to a surface of the sheet stack P within an angular range of β° to γ°. When a sheet having relatively small resiliency such as a thin sheet is used, as shown in FIG. 45, the sheets are supported in an inclined condition in such a manner that one front corner of the sheet stack P is regulated by the separation pawl 107 and the other front edge of the sheet stack (not regulated by the separation pawl) abuts against the sheet tip end abutment portion 102*a*. When the sheet supply roller 105 is contacted with the sheet stack P and is rotated, a conveying force acts on the sheet stack P.

On the other hand, since one front corner of the sheet stack P is regulated by the separation pawl 107, only an uppermost sheet P overcome the resistance of the separation pawl 107 to ride over the latter, thereby separating the uppermost sheet from the other sheets. The separated sheet is supplied to the recording portion 101.

When a sheet having relatively great resiliency such as an envelope and a post card is used, since the sheet is not flexed in the vicinity of the separation pawl 107 sufficient to be separated by the separating action of the separation pawl 107, it is difficult to separate the uppermost sheet from the other sheets by the separation pawl 107. Thus, regarding the sheet P having relatively great resiliency, the separation pawl 107 (located at one front corner of the sheet stack) is spaced apart from the sheet stack, and the sheet is separated in the following manner. The sheets having relatively great resiliency are prevented from advancing toward a downstream side due to friction between the tip end of the sheet stack and the sheet tip end abutment portion 102*a* when the tip end of the sheet stack abut against the sheet tip end abutment portion 102*a* (regulated condition). In order to release such a regulated condition, it is necessary to overcome the resiliency of the sheet to flex the sheet and to provide a conveying force sufficient to feed the sheet P toward the downstream side in opposition to the friction between the tip end of the sheet stack P and the sheet tip end abutment portion 102*a*.

When the uppermost sheet directly contacted with the sheet supply roller 105 is subjected to the conveying force from the sheet supply roller 105, the conveying force of the sheet supply roller 105 indirectly acts on the other sheets (other than the uppermost sheet) due to friction between the sheets. In consideration of this fact, the inclination angle β° to γ° (with respect to the surface of the sheet stack P) of the abutment surface of the sheet tip end abutment portion 102*a* is selected so that only the uppermost sheet P directly subjected to the conveying force of the sheet supply roller 105 is supplied and the other sheets P are regulated (i.e., not supplied). With this arrangement, the sheets having relatively great resiliency can be separated and supplied one by one.

Further, in such a recording apparatus, it is requested that the sheet can be supplied or inserted one by one manually. To satisfy this requirement, the inclination angle of the pressure plate 103 and the inclination angle β° to γ° (with respect to the surface of the sheet stack P) of the abutment surface of the sheet tip end abutment portion 102*a* are selected so that the sheet P can be inserted up to the sheet tip end abutment portion 102*a* without interference and can reach a convey roller (not shown) through the sheet tip end abutment portion 102*a*.

As mentioned above, the inclination angle β°°to γ° (with respect to the surface of the sheet stack P) of the abutment surface of the sheet tip end abutment portion 102*a* is selected in a relatively narrow angular range so that both the sheets P having relatively small resiliency and the sheets P having relatively great resiliency can be held, separated and supplied and at the same time the manual sheet insertion is permitted. However, in the above-mentioned conventional sheet supplying apparatus has the following drawbacks:

(1) Since only one front corner of the sheet stack P is regulated by the separation pawl 107 and the other front edge of the sheet stack is supported by the sheet tip end abutment portion 102*a*, when the sheets P having relatively small resiliency are used, the other front corner of the sheet stack (not regulated by the separation pawl 107) is often protruded toward the downstream side, thereby causing the skew-feed of sheet in the recording portion 101.

(2) When the sheets P are stacked on the pressure plate 103 for a long time, the other front corner of the sheet stack (not regulated by the separation pawl 107) is gradually protruded toward the downstream side and the regulated condition of the front corner of the sheet stack P regulated by the separation pawl 107 becomes unstable. In such a condition, if the sheet supplying operation is performed, poor sheet separation is generated, thereby causing the double-feed of sheets.

(3) During the stacking operation of the sheets P on the pressure plate 103, after the tip end of the sheet stack P abut against the sheet tip end abutment portion 102*a*, when the sheet stack P is slid laterally until a side edge of the sheet stack is contacted with a side reference surface 102*b* for positioning the side edge of the sheet stack P, since the tip end of the sheet stack is shifted along the sheet tip end abutment portion 102*a*, the tip end of the sheet stack is gradually slid down from the sheet tip end abutment portion 102*a* toward the downstream side. As a result, when the side edge of the sheet stack is contacted with the side reference surface 102*b*, the front corner of the sheet stack P regulated by the separation pawl 107 is shifted toward the downstream side of the separation pawl 107, with the result that the front corner of the sheet stack is not regulated by the separation pawl 107. In this condition, when the sheet supplying operation is performed, a plurality of sheet P not regulated by the separation pawl 107 are supplied at once.

(4) In order to amend the poor sheet tip end holding ability described in the above items (1) and (2), if the inclination angle β° to γ° (with respect to the surface of the sheet stack P) of the sheet tip end abutment portion 102*a* is made smaller, when the sheet is manually supplied one by one without rotating the sheet supply roller, particularly regarding the sheet having the small resiliency, after the tip end of the sheet abuts against the sheet tip end abutment portion 102*a*, the sheet P cannot be further advanced, thereby making the manual sheet supply difficult.

(5) When the sheet supplying apparatus is used with an ink jet recording apparatus, it is requested that a special sheet having a surface on which special coating agent capable of improving coloring ability and preventing ink-stain to achieve high quality image recording is coated can be used. In this case, while the sheet P is being separated and supplied by the sheet supplying apparatus 100, the coating agent on the surface of the sheet is scraped by the rubbing of the sheet by means of the sheet supply roller 105 and/or the catching of the front corner of the sheet by means of the separation pawl 107. Consequently, the fine particles of the scraped coating agent are deposited on the sheet tip end abutment portion 102*a* to gradually increase the frictional resistance between the sheet tip end abutment portion 102*a* and tip end of the sheet, with the result that, as a large number of special sheets P are used, it is difficult to supply the sheet by the sheet supply roller 105.

SUMMARY OF THE INVENTION

The present invention aims to eliminate the above-mentioned conventional drawbacks, and an object of the present invention is to provide a sheet supplying apparatus and a recording apparatus in which sheet can be effectively separated and supplied regardless of resiliency of the sheet even when manual sheet supply is adopted and special sheets having a surface coated on special coating agent are used, and regulation of a front corner of a sheet stack by means of a sheet separation means is not lost even when the sheet stack is rested on a sheet stacking means for a long time and which can reduce occurrence of double-feed of sheets.

To achieve the above object, the present invention provides a sheet supplying apparatus comprising a sheet supporting means for supporting a sheet, a first abutment member for regulating a tip end of the sheet supported by the sheet supporting means, a second abutment member which can be displaced and which is adapted to regulate the tip end of the sheet supported by the sheet supporting means, and a sheet supply means for feeding out the sheet supported by the sheet supporting means, and wherein an angle between a surface of the sheet supported by the sheet supporting means and an abutment surface of the second abutment member is smaller than an angle between the surface of the sheet and an abutment surface of the first abutment member.

DETAILED DESCRIPTION OF THE PREFERRED EMBODIMENTS

Figure 1:
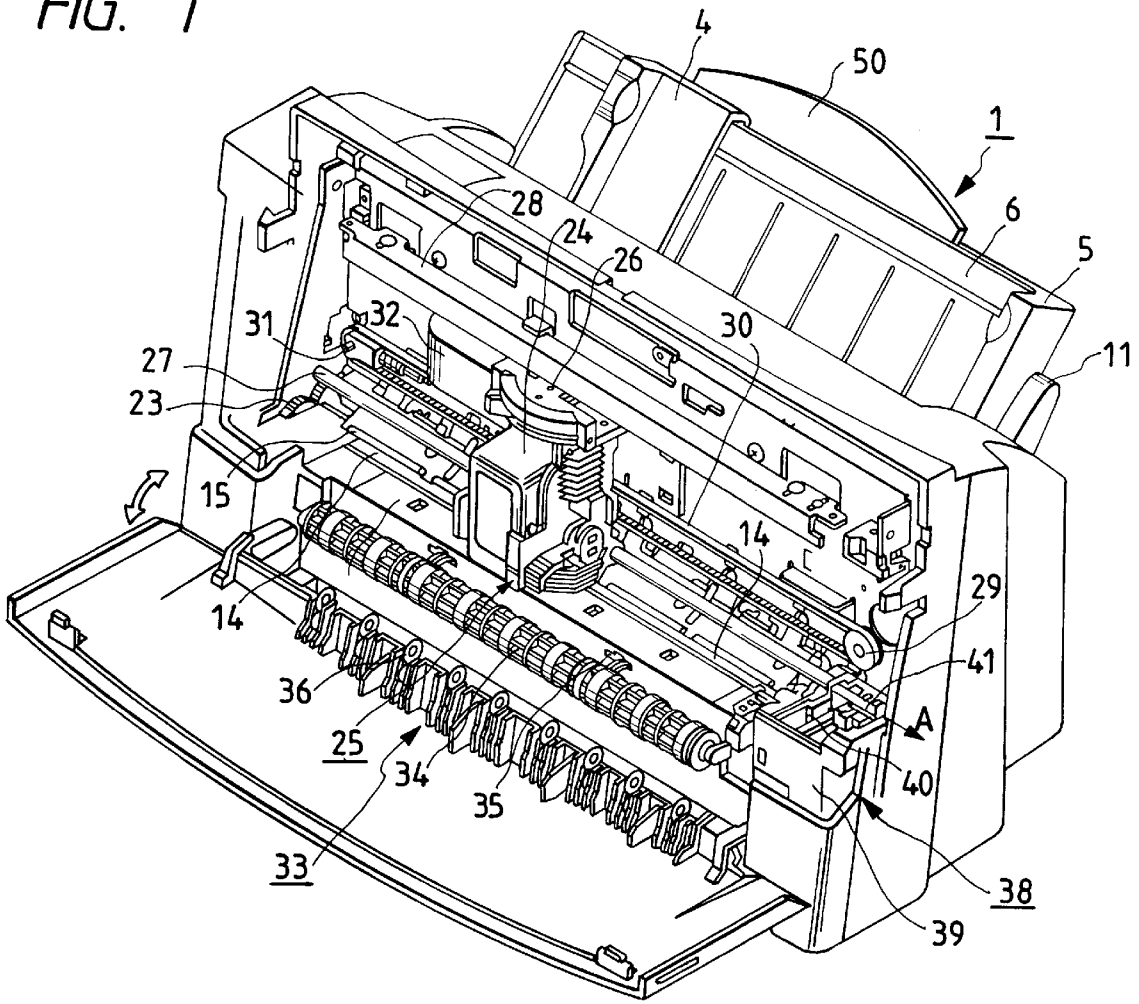
FIG. 1 is a perspective view of an ink jet recording apparatus having a sheet supplying apparatus according to the present invention.

Embodiments of a sheet supplying apparatus and a recording apparatus (ink jet recording apparatus) having such a sheet supplying apparatus according to the present invention will now be explained with reference to the accompanying drawings.

First Embodiment

An ink jet recording apparatus having a sheet supplying apparatus according to a first embodiment of the present invention will be described. In this embodiment, the recording apparatus integrally incorporates a sheet supplying apparatus 1 therein and includes a sheet supply portion for supplying sheets P stacked on a base (sheet stacking means) 5, a carriage portion for scanning an ink jet recording head (recording means) 24 in a direction perpendicular to a sheet supplying direction, a cleaning portion for cleaning the ink jet recording head 24, and a sheet discharge portion for discharging the sheet on which an image was recorded out of the apparatus.

The sheets P formed from paper sheets or synthetic resin film sheets stacked on a pressure plate 6 of the sheet supplying apparatus 1 are supplied one by one by a sheet supply rotary member or sheet supply roller (sheet supply means) 2. The supplied sheet is conveyed by a sheet convey roller 14 to a recording position where the ink jet recording head 24 is opposed to the sheet. In the recording position, an image is recorded on the sheet by the recording head 24 in response to image information. Thereafter, the sheet is pinched between a sheet discharge roller 34 and spurs 36 and is discharged out of the recording apparatus in a substantially horizontal direction. The sheet supplying apparatus 1 comprised the sheet supply roller 2 (described later), a separation pawl 3, a movable side guide 5, the base 5, the pressure plate 6, pressure plate springs 7, a release cam gear 9, a pawl spring 10, a separation pawl release lever 11, a release cam 12 and the like, and further includes an input gear 8*a* (FIG. 8), idler gears 8*b*, 8*c*, 8*d*, a supply roller gear 8*d* and drive gear such as a clutch gear 8*e*.

Figure 2:
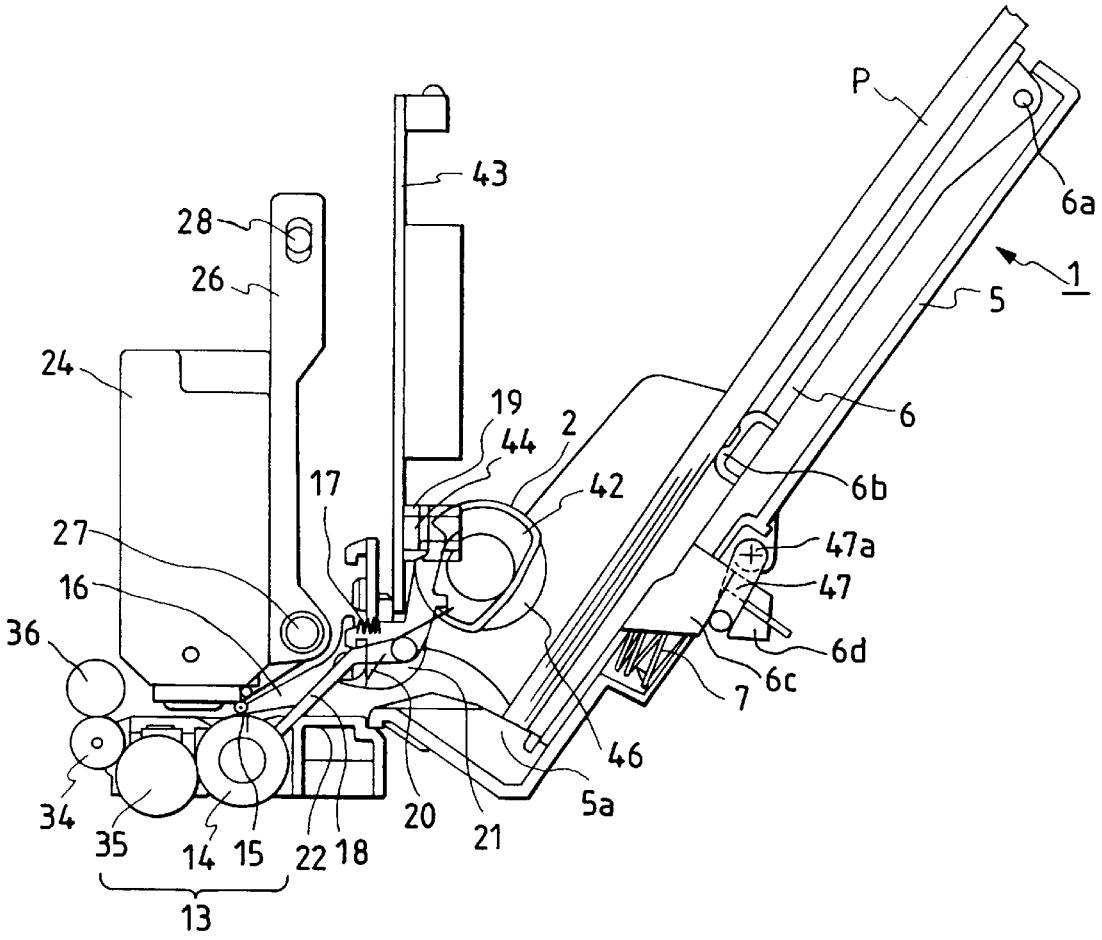
FIG. 2 is a sectional view of a main portion of the ink jet recording apparatus.
Figure 3:
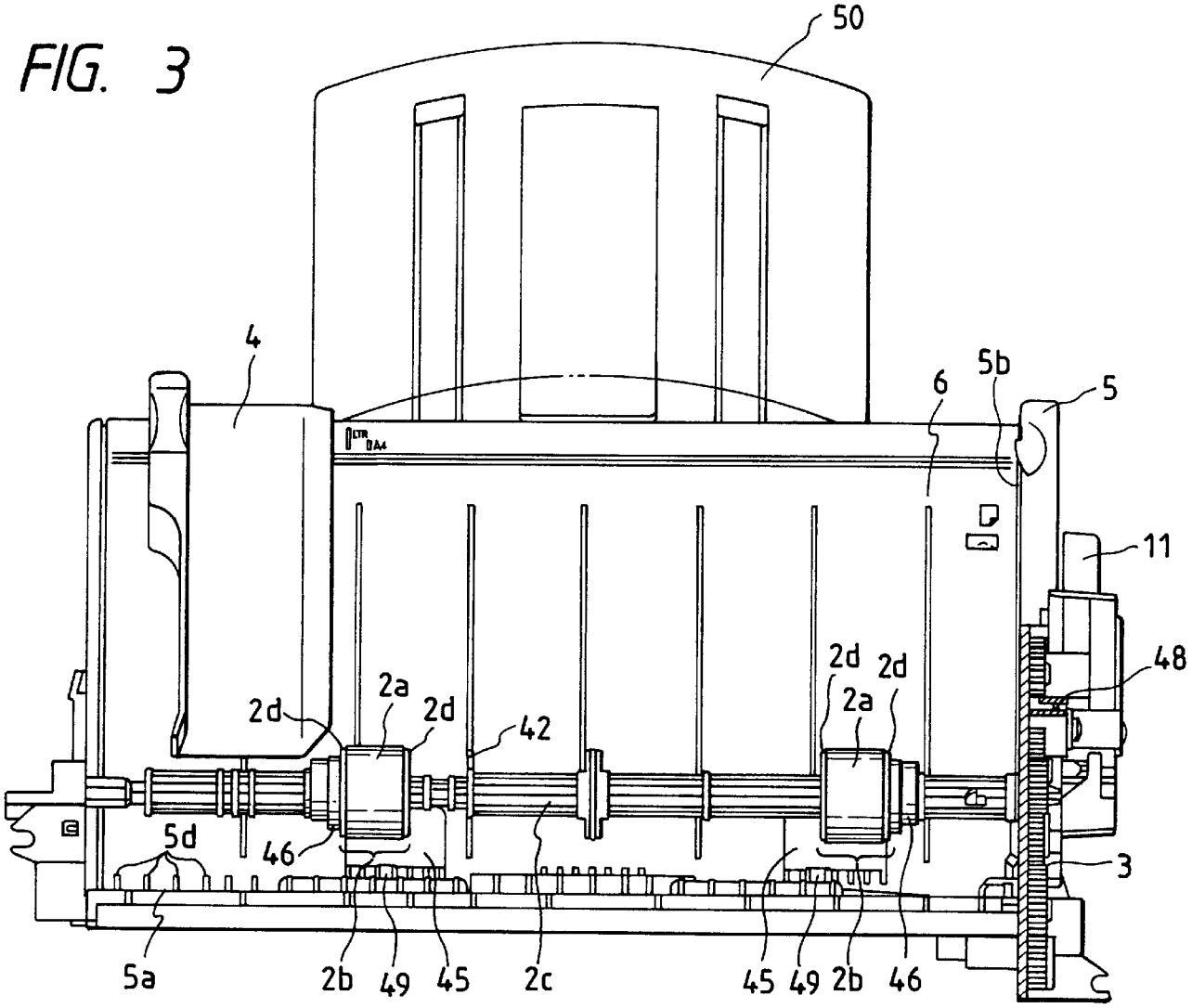
FIG. 3 is a plan view of the sheet supply portion of a sheet supplying apparatus according to a first embodiment of the present invention.

As shown in FIGS. 1 to 3, the sheet supplying apparatus 1 has the base (sheet stacking means) 5 inclined with respect to a body of the apparatus by an angle of 30° to 60°. An upper end portion of the pressure plate 6 is pivotally connected to the base 5 via a pressure plate shaft 6*a* so that the pressure plate 6 can be rocked with respect to the base 5. The pressure plate springs 7 are disposed below the pressure plate 6 in a confronting relation to roller portions 2*b* of the sheet supply roller 2 so that the pressure plate 6 is biased toward the sheet supply roller 2 by the pressure plate springs 7.

As shown in FIG. 3, separation pad 45 made of material having relatively great coefficient of friction (for example, artificial leather) are provided on the pressure plate 6 in a confronting relation to the roller portions 2*b* of the sheet supply roller 2 to prevent double-feed of sheets when the number of sheets is decreased. Further, the movable side guide (side regulating member) 4 is provided on the pressure plate 6 for sliding movement in a direction (referred to as "lateral direction" hereinafter) perpendicular to a sheet supplying direction so that, the sheets P are stacked on the pressure plate 6, one lateral edge of the sheet stack P is contacted with a right side plate (sheet reference surface) 5*b* and the movable side guide 4 abuts against the other lateral edge of the sheet stack P, thereby regulating the posture of the sheet stack and setting the sheet stack.

Figure 12:
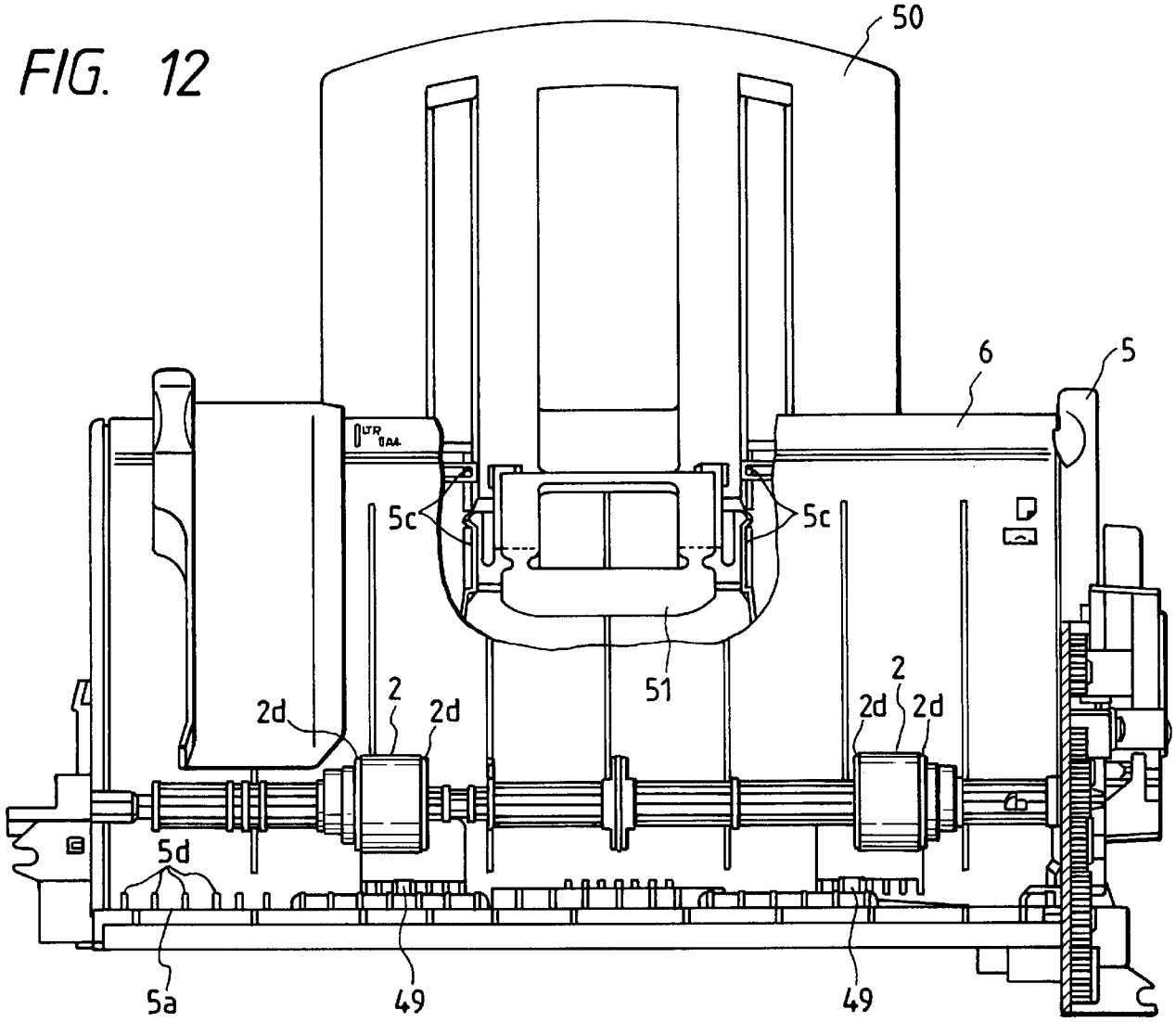
FIG. 12 is a plan view of the sheet supply portion according to the first embodiment, showing a condition that a sheet supporter is lifted.

Further, as shown in FIG. 12, a sheet supporter (sheet back surface support member) 50 for supporting a back surface of the sheet stack is supported on slide guide portions 5*c* of the base 5 for sliding movement in the sheet conveying direction. When the sheet supporter 50 is used, the sheet supporter 50 is pulled or extended upwardly; whereas, when the sheet supporter is not used, the sheet supporter is retracted into a space between the base 5 and the pressure plate 6.

Figure 4:
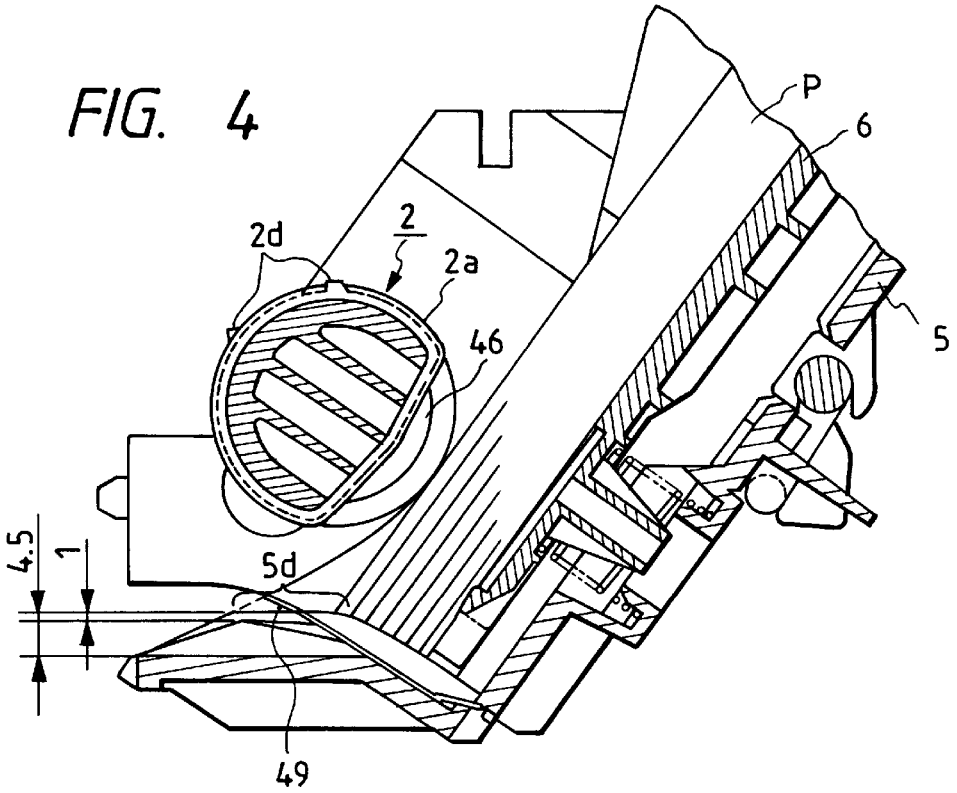
FIGS. 4 and 5 are partial enlarged views of an abutment portion against which a tip end of a sheet stack abuts, according to the first embodiment.

Further, as shown in FIGS. 3 and 4 in detail, a sheet tip end abutment portion 5*d* providing a feature of the present invention is formed on a lower surface 5*a* of the base 5, which sheet tip end abutment portion is constituted by a plurality of ribs (each having a height of 1 to 4.5 mm) disposed in parallel with each other along the sheet supplying direction. In the illustrated embodiment, the ribs are formed on the entire lower surface 5*a* of the base 5.

A sheet abutment (contact) surface of the sheet tip end abutment portion 5*d* constituted by the ribs performs an auxiliary supporting function in association with sheet regulation of the separation pawl 3 (described later) regarding sheets having relatively small resiliency such as thin sheets and also performs a sheet supporting function and a function for regulating the tip end of the sheet stack and separating the sheets one by one regarding sheets having relatively great resiliency such as thick sheets.

Further, by constituting the sheet tip end abutment portion 5*d* by the plurality of ribs provided on the entire area with which the tip end of the sheet stack is contacted, even when a special sheet having a surface on which special coating agent capable of improving coloring ability and preventing ink-stain to achieve high quality image is coated is used, fine particles of the coating agent scraped from the surface of the special sheet are hard to be deposited on the sheet abutment surface of the sheet tip end abutment portion 5*d* and are dropped between the ribs.

Accordingly, unlike to the above-mentioned conventional recording apparatus, frictional resistance between the sheet abutment surface of the sheet tip end abutment portion 5*d* and the tip end of the sheet stack is prevented from increasing, thereby keeping the frictional resistance substantially constant to achieve the stable sheet separation and sheet supply.

Figure 5:
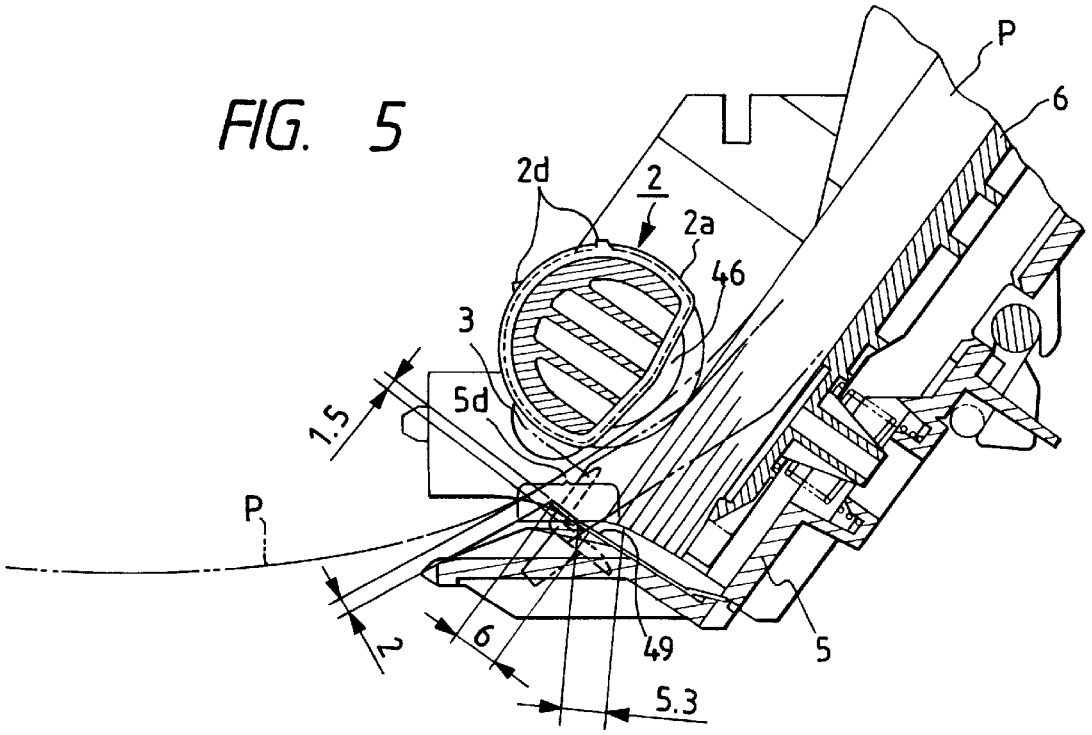

Further, as shown in FIGS. 3 and 5, sheet tip end abutment members (second abutment members) 49 providing a feature of the present invention are disposed between the ribs of the sheet tip end abutment portion 5*d* in a confronting relation to the roller portions 2*a* of the sheet supply roller 2 and protruded from the ribs. As shown in FIG. 5, the sheet tip end abutment members 49 is formed from elastic members (for example, PET sheets) and each has a width of 5 mm, a thickness of 0.25 mm and a flexion length of 6 mm. Each sheet tip end abutment member 49 is supported by the base in a cantilever fashion. The sheet tip end abutment members 49 are inclined with respect to the surface of the sheet stack P rested on the pressure plate 6 by an angle of about 90 degrees.

Further, the sheet tip end abutment members 49 are disposed at an upstream side of the separation pawl (sheet separating means) 3 also acting as a sheet regulating member shown in FIG. 5 and are spaced apart from the separation pawl by a distance of about 1.5 mm. Incidentally, as an alteration, the sheet tip end abutment members 49 may be disposed at positions corresponding to a sheet regulating surface of the separation pawl 3 in the sheet supplying direction.

With the arrangement as mentioned above, in the case where the sheet stack P is rested on the pressure plate 6, after the sheet stack is set so than the tip end of the sheet stack P abuts against the sheet tip end abutment member 5*d* at a position where the front corner of the sheet stack P is not regulated by the separation pawl 3, when the sheet stack is slid laterally along the sheet tip end abutment member 5*d* until an edge of the sheet stack parallel with the sheet supplying direction (referred to as "lateral edge") abuts against the right side plate for positioning the sheet stack in a lateral direction, since the tip end portion of the sheet stack P is supported by the sheet tip end abutment members 49, the tip end of the sheet stack P is prevented from protruding from the sheet tip end abutment member 5*d* toward a downstream side, with the result that, when the lateral edge of the sheet stack P abuts against the right side plate 5*b*, the front corner of the sheet stack P can surely be regulated by the separation pawl 3.

By constituting the sheet tip end abutment members 49 by the elastic material, since the inclination angle of the sheet tip end abutment members 49 with respect to the tip end of the sheet stack P is increased toward the downstream side, the regulation of the sheets stacked on the sheet tip end abutment members 49 at their upstream ends is increased, thereby preventing the double-feed of sheets. Further, since the sheet tip end abutment members 49 are disposed spaced apart from the upstream end of the sheet tip end abutment member 5*d* by a distance of about 5.3 mm along the sheet tip end abutment member 5*d*, first of all, after the regulation of the tip end of the sheet stack P is loosened by the sheet tip end abutment member 5*d*, the tip end of the sheet stack P abuts against the sheet tip end abutment members 49. As a result, even when the sheet having the great resiliency are used, the excessive resistance can be prevented. Further, if the excessive force acts on the sheet tip end abutment members 49, the sheet tip end abutment members 49 are flexed to be completely retracted between the ribs of the sheet tip end abutment member 5*d*, thereby permitting the stable sheet supply.

With the arrangement as mentioned above, even if the ability for supporting the sheets P having the small resiliency is insufficient in the sheet tip end abutment member 5*d*, the sheet tip abutment members 49 can make up for the insufficient supporting ability so that the tip end portion of the sheet stack P not regulated by the separation pawl 3 is prevented from advancing toward the downstream side in the sheet supplying direction, thereby permitting the correct supplying of the sheet to the recording portion 25.

As mentioned above, the sheet tip end abutment members 49 permit the separation and stable supply of both the sheets having small resiliency and the sheet having great resiliency. Further, as shown in FIG. 5, tip ends of the sheet tip end abutment members 49 are spaced apart from a sheet conveying path by a distance of 2 mm, so that, while the sheet is being conveyed by a sheet convey portion 13, a convey resistance does not act on the sheet.

Incidentally, as an alteration, the sheet tip end abutment members 49 may formed from plates resiliently supported with respect to the base 5. In this case, the same advantage can be obtained.

As shown in FIG. 3, the sheet supply roller 2 is held by the base 5 at its both ends and is secured to a rotatable shaft 2*c*. The sheet supply roller 2 is comprised of the roller portions 2*b* and the shaft 2*c* and is a single part formed from plastic and the like, and each roller portion 2*b* includes a supply rubber roller 2*a* for conveying the sheet P.

Each roller portion 2*b* has D-shaped (semi-circular) section, and, as shown in FIGS. 4 and 5, a roller 46 having a radius smaller than a radius of the supply rubber roller 2*a* of the roller portion 2*b* by 3 mm is disposed adjacent to and at an out side of the corresponding roller portion 2*b*. The rollers 46 can prevent smudge of image on the sheet and positional deviation of the sheet supply roller due to the contact between the sheet and the rollers 46 of the sheet supply roller 2 other than the sheet supplying operation, and reduction in conveying accuracy due to sheet conveying resistance.

As shown in FIG. 3, two roller portions 2*b* are provided on the shaft 2*c* and are fixed at positions spaced apart from the sheet reference position of the right side plate 5*b* by distances of about 40 mm and 170 mm, respectively. Accordingly, a sheet having a size such as A4 size is conveyed by the two roller portions 2*b* and a sheet having a small size such as a post card is conveyed by the single roller portion 2*b* near the right side plate 5*b*.

Figure 6:
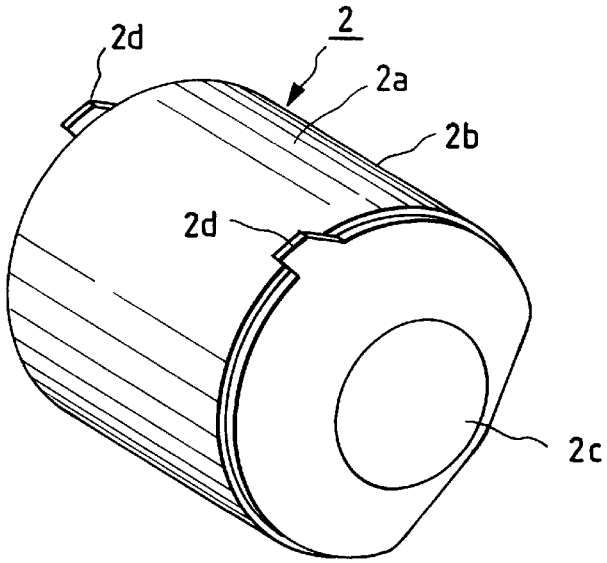
FIG. 6 is a perspective view showing ribs disposed on both sides of a sheet supply roller.
Figure 7A:
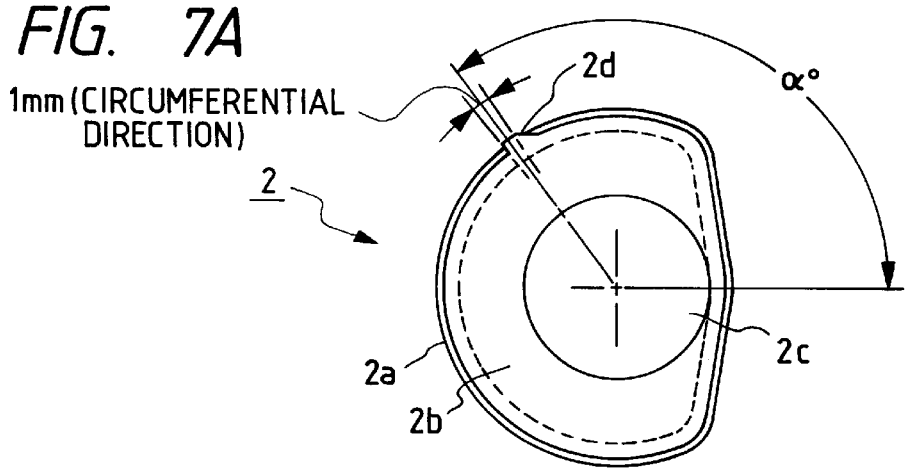
FIGS. 7A and 7B are sectional views of the sheet supply roller.
Figure 7B:
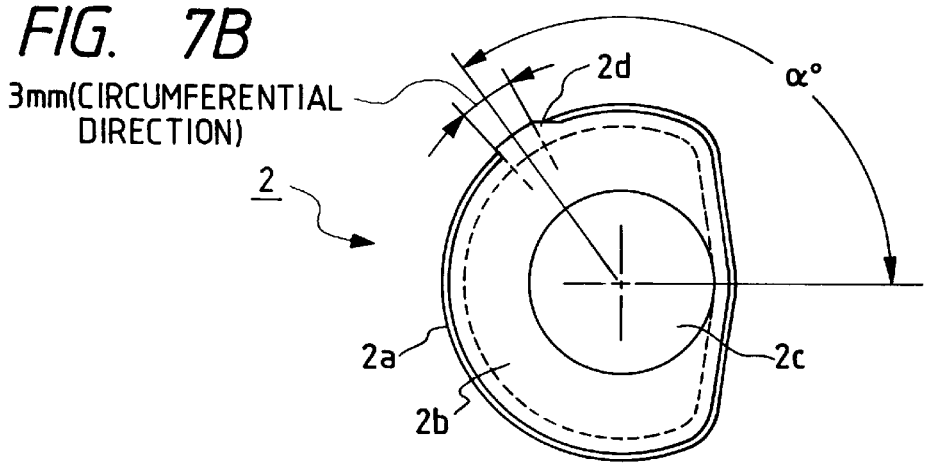

Further, as shown in FIGS. 6, 7A and 7B, ribs 2*d* each having a radius greater than the radius of the rubber roller 2*a* (by 0.3 mm) and spaced apart by a predetermined distance are disposed on both sides of each roller portion 2*b*. As shown in FIGS. 7A and 7B, the ribs 2*d* have circumferential lengths (referred to as "separation areas" hereinafter) of 1 mm (regarding the roller portion 2*b* near the right side plate 5*b*) and 3 mm (regarding the roller portion 2*b* remote from the right side plate 5*b*). An angle a between a line connecting a center of rotation of one of the roller portions 2*b* to a central position of the D-cut portion thereof and a central position of the associated separation area is the same as an angle $\alpha$ between a line connecting a center of rotation of the other roller portion 2*b* to a central position of the D-cut portion thereof and a central position of the associated separation area. That is to say, both separation areas can be contacted with the sheet P at the same timing.

Figure 10:
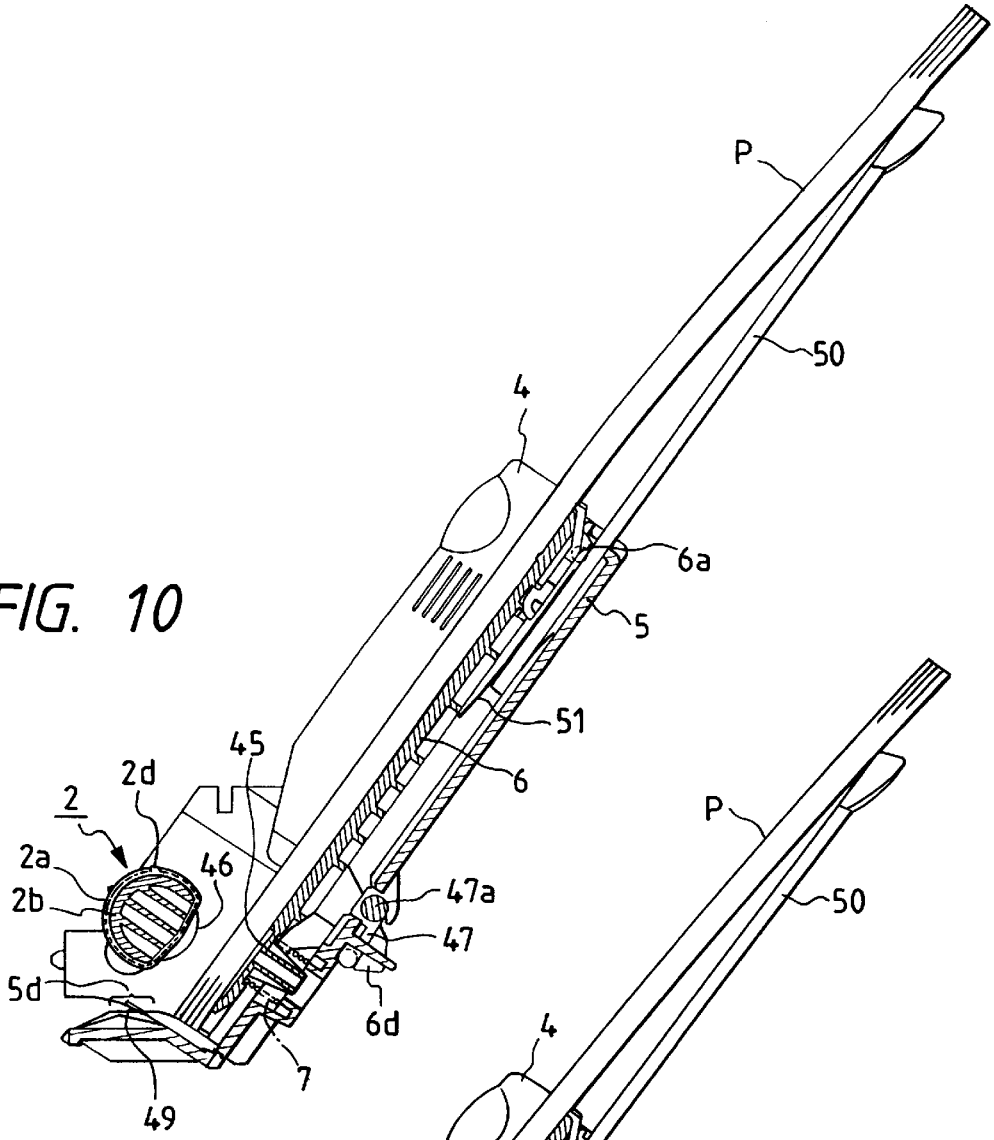
FIG. 10 is a side sectional view of the sheet supply portion in a waiting condition.

Further, as shown in FIGS. 2 and 3, the sheet supply roller 2 is provided with a sensor plate 42 having a radius smaller than those of the supply rubber rollers 2*a*. The sensor plate 42 is designed so that light from a roller sensor 44 comprised of a photo-interrupter provided on an electrical substrate 44 (FIG. 2) is blocked by the sensor plate only when the sheet supply roller 2 and the release cam gear 9 are in an initial position for releasing the pressure plate 6 as shown in FIG. 10. By detecting a condition of the sensor plate 42, an angular position of the sheet supply roller 2 and an angular position of the release cam gear driven in synchronous with the sheet supply roller (in the same phase) can be detected, thereby obtaining the control timing of a sheet supplying sequence.

Figure 8:
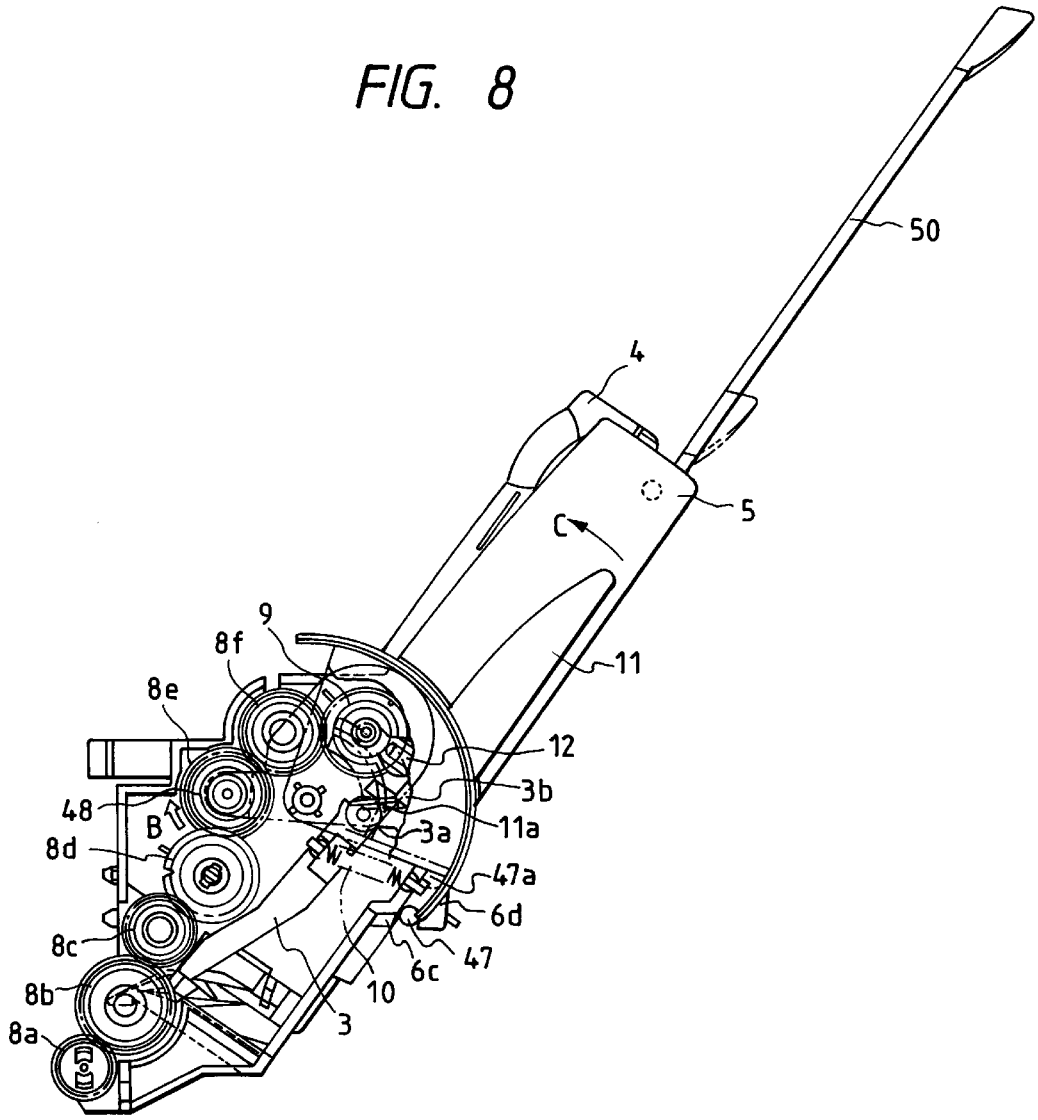
FIGS. 8 and 9 are side sectional views of a drive transmission system of the sheet supply portion according to the first embodiment.

The separation pawl 3 constituting the sheet separation means and acting as the sheet regulating member for abutting against the front corner of the sheet stack P can be rocked around a fulcrum 3*a* as shown in FIG. 8 and is biased toward the pressure plate 6 by means of a pawl spring 10 with a force of 20 to 100 gf. The separation pawl 3 serves to separate the thin sheets P (for example, plain sheets), and, as shown in FIG. 3, the separation pawl is disposed near the right side plate 5*b*. As shown in FIG. 5, a sheet regulating surface of the separation pawl 3 covers the front corner (upper surface and front and lateral edge portions) of the sheet stack P in a triangular fashion.

Since the tip end of the sheet stack P is regulated and resisted by the triangular portion of the separation pawl 3 and the surface of the pressure plate, the sheets can be separated and supplied one by one. Further, regarding the thick sheets other than the thin sheets, the sheet stack is not caught by the separation pawl 3, but, the sheet stack is urged against the sheet tip end abutment portion 5*d* and the sheet tip end abutment portions 49. In this way, the thick sheets can be separated one by one by the contact frictional resistance between the tip end of the sheet stack and the sheet tip end abutment portions 5*d*, 49.

Next, a switching means for switching the separation pawl between a separation position where the sheets are separated one by one and a waiting position where the sheets are not separated will be explained. First of all, operations of a separation pawl release lever 11 and a release cam 12 formed integrally with the release cam gear 9 will be described. The separation pawl release lever 11 is pivotally supported so that it can be shifted between a thin sheet set position for shifting the separation pawl to the separation position and a thick sheet set position for shifting the separation pawl to the waiting position.

Figure 9:
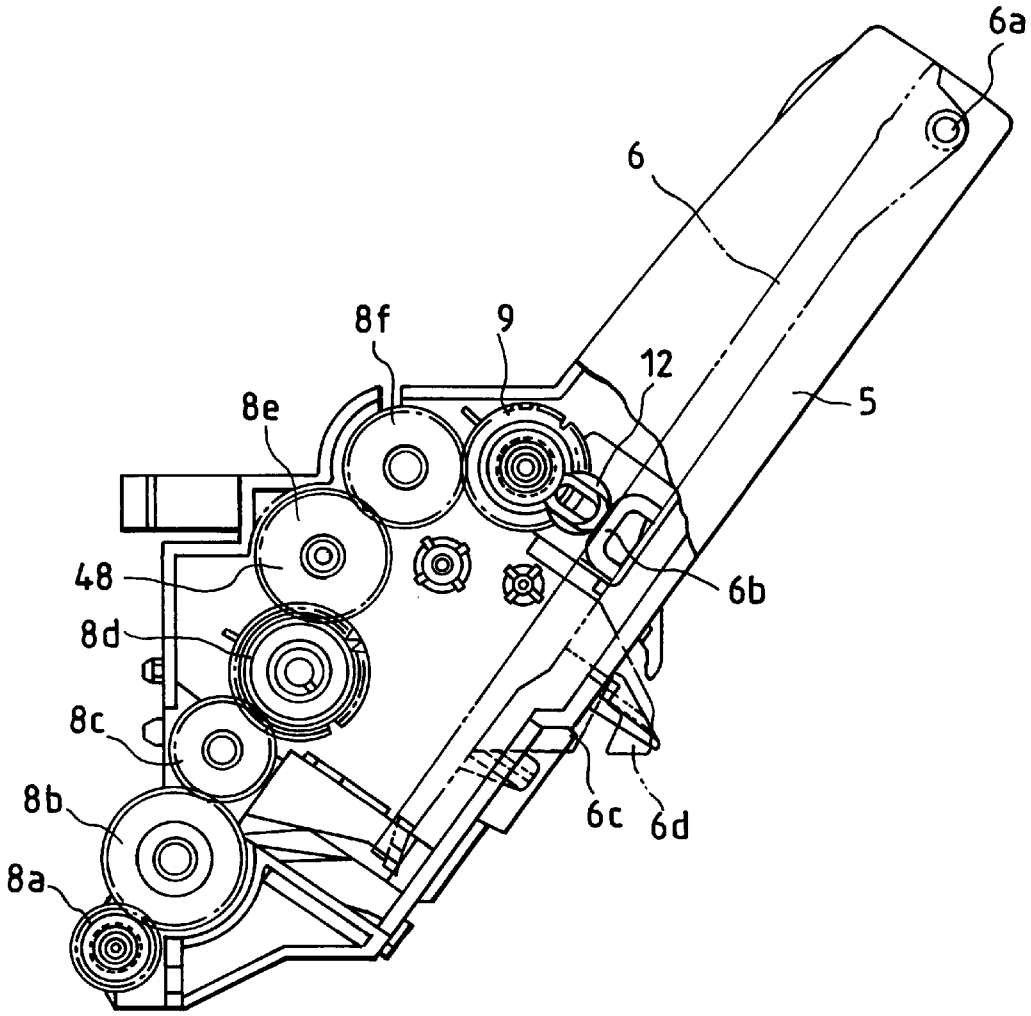

When the separation pawl release lever 11 is inclined toward a direction (front side of the apparatus) shown by the arrow C in FIG. 8, the lever is set to the thin sheet set position. In this case, a push-down portion 3*b* of the separation pawl 3 is pushed toward the release cam 12 by a cam member 11*a* integrally formed on the separation pawl release lever 11. As shown in FIG. 9, in a condition that a push-down portion 6*b* of the pressure plate 6 is pushed down by the release cam 12, the push-down portion 3*b* of the separation roller 3 is set to a pushed-down condition by the action of the cam member 11*a*.

At the same time, the separation pawl 3 is rocked around the fulcrum 3*a* to separate the sheet regulating surface of the separation pawl 3 from the pressure plate 6. When the sheets P are set in this condition, the sheet stack can surely be set between the separation pawl 3 and the pressure plate 6. Further, when the sheet supplying operation is started, the release gear 9 is rotated and the pushed-down condition of the pressure plate 6 by means of the release cam 12 is released. As a result, the push-down portion 3*b* of the separation pawl 3 is also released, so that the sheet regulating surface of the separation pawl 3 is urged against the front corner of the sheet stack P by the pawl spring 10.

On the other hand, when the separation pawl release lever 11 is inclined toward a direction (rear side of the apparatus) opposite to the direction C, the lever is set to the thick sheet set position. In this case, the cam member 11*a* integrally formed with the separation pawl release lever 11 is displaced from a position where the push-down portion 3*b* of the separation pawl 3 is pushed toward the release cam 12 by the cam member. As a result, when the separation pawl is subjected to a force of a pawl slide spring 37, interconnection between the push-down portion 3*b* of the separation pawl 3 and the release cam 12 is released. The sheet regulating surface of the separation pawl 3 is biased toward the pressure plate 6. In this condition, when the sheets P are set, the sheets P are not regulated by the sheet regulating surface of the separation pawl 3, and, thus, even when the release cam gear 9 is rotated, only the pressure plate 6 is subjected to the action of the release cam 12, and the sheet regulating surface of the separation pawl 3 is still contacted with the upper surface of the pressure plate 6 and is shifted together with the pressure plate 6.

Incidentally, the above-mentioned separation pawl 3, separation pawl release lever 11 and release cam 12 are pivotally supported by a shaft disposed on the right side plate 5*b* of the base 5.

When the release cam 12 of the release cam gear 9 shown in FIG. 8 abuts against the push-down portion 6*b* of the pressure plate 6 to push the pressure plate 6 downwardly up to a position shown in FIG. 10, the sheet stack P is separated from the sheet supply roller 2. In this condition, the sheets P are set on the pressure plate 6. A rotational driving force of the convey roller 14 is transmitted to the release cam gear 9 through drive gears 8*a* to 8*e*.

Figure 11:
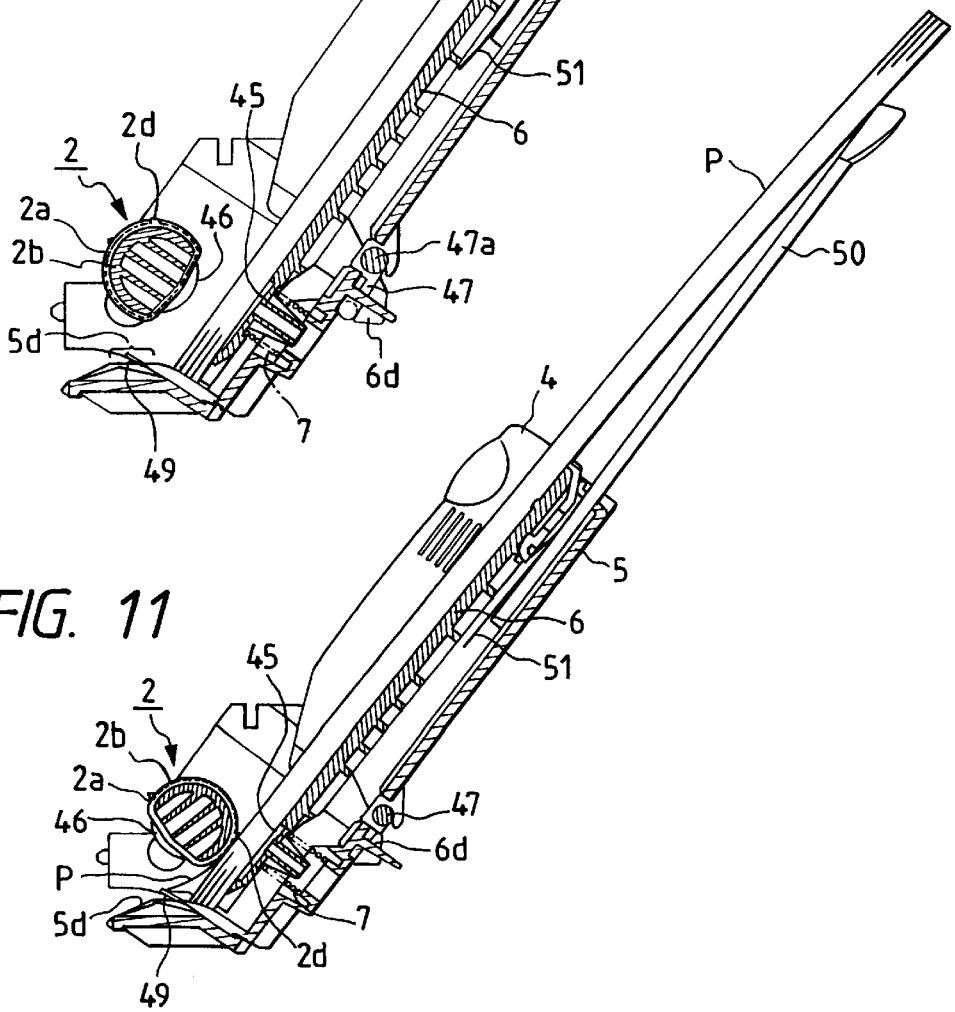
FIG. 11 is a side sectional view of the sheet supply portion in a sheet supplying condition.

When the release cam 12 is separated from the push-down portion 6*b*, the pressure plate 6 is lifted up to a position shown in FIG. 11, with the result that the upper surface of the sheet stack P is contacted with the sheet supply roller 2. In this condition, when the sheet supply roller 2 is rotated, the sheets are picked up by the sheet supply roller and the uppermost sheet is separated from the other sheet(s) by the separation pawl 3. The separated sheet P is sent to the sheet feed portion 13 shown in FIG. 2. The sheet supply roller 2 and the release cam gear 9 are rotated until the sheet P is sent to the sheet feed portion 13. Thereafter, by releasing the pressure plate 6 from the sheet supply roller 2, the rotational driving force from the sheet supply roller 2 is interrupted, thereby keeping the initial condition.

The sheet feed portion 13 shown in FIG. 2 includes the convey roller 14, a pinch roller 15, a pinch roller guide 16, a pinch roller spring 17, an edge (PE) sensor lever 18, an edge (PE) sensor 19, an edge (PE) sensor spring 20, an upper guide 21 and a platen 22.

The sheet P sent to the sheet feed portion 13 is guided by the platen 22, upper guide 21 and pinch roller guide 16 to reach a nip between the convey roller 14 and the pinch roller 15. The PE sensor lever 18 is pivotally supported by the upper guide 21 at an upstream side of the pair of rollers 14, 15 in the sheet conveying direction so that, if the sheet P does not exist in a sheet convey path, a downstream end of the PE sensor lever 18 is located to block the sheet convey path, and an upstream light blocking portion 18*a* blocks light to the PE sensor (for example, photo-interrupter) 19.

When the tip end of the sheet P reaches the tip end of the PE sensor lever 18, the tip end of the PE sensor lever 18 is lifted and rotated by the sheet P to shift the light blocking portion 18*a*, with the result that the light can reach the PE sensor 19, thereby detecting the sheet P. This detection is used as reference for determining a record start position of the sheet P.

The pinch roller 15 is urged against the convey roller 14 by biasing the pinch roller guide 16 by means of the pinch roller spring 17 so that the pinch roller is driven by rotation of the convey roller to generate a conveying force between the rollers. The sheet P sent to the nip between the convey roller 14 and the pinch roller 15 is conveyed on the platen 22 by a predetermined amount to reach the record start position by rotating the convey roller 14 and the pinch roller 15 by using an LF motor 23 shown in FIG. 1. Then, an image is recorded on the sheet by the recording head 24 on the basis of predetermined image information.

The recording head 24 serves to record the image on the sheet (conveyed by the convey roller 14 and the pinch roller 15) with ink. In the recording apparatus, the recording head 24 is of ink jet recording type wherein the ink is discharged from the recording head. That is to say, the recording head 24 includes fine liquid discharge openings (orifices), liquid passages, energy acting portions disposed in the corresponding liquid passages, and energy generating means for generating liquid droplet forming energy acting on the corresponding energy acting portions.

A recording method in which electrical/mechanical converters such as piezo-electric elements are used as the energy generating means, a recording method having energy generating means in which liquid is heated by illuminating electromagnetic wave such as laser to discharge liquid droplets, or a recording method having energy generating means in which liquid is heated by electrical/thermal converters such as heating elements including heat generating resistors to discharge the liquid may be used. Among them, regarding a recording head used in an ink jet recording method in which the liquid is discharged by thermal energy, since liquid discharge openings (orifices) for discharging recording liquid droplets can be arranged with high density, it is possible to obtain an image having high resolving power. Among them, it is desirable to use a recording head utilizing the electrical/thermal converters as the energy generating means, since it can easily be made compact, it can make use of the advantages of IC techniques and/or micro-working techniques in which semi-conductor technique and reliability have remarkably been progressed, it can be manufactured with high density and it can be made cheaper.

As shown in FIG. 1, the recording portion 25 includes a carriage 26 on which the recording head 24 is mounted, a guide shaft along which the carriage 26 can be reciprocally shifted (scanned) in directions perpendicular to the sheet conveying direction, and a guide 28 for holding a rear end of the carriage 26 to keep a distance between the recording head 24 and the sheet P substantially constant. The recording portion 25 further includes a timing belt 30 for transmitting a driving force of a carriage motor 29 to the carriage 26, an idle pulley for supporting the timing belt 30, and a flexible substrate 32 for transmitting a head drive signal from an electric substrate to the recording head 24.

The recording head 24 is integrally formed with an ink tank to provide a replaceable recording head unit and is scanned (shifted) together with the carriage to record the image (with ink) on the sheet P conveyed on the platen 22.

The cleaning portion 38 includes a pump 39 for cleaning the recording head 24, a cap 40 for preventing the drying of the recording head 24, and a drive switching arm 41 for switching the driving force from the convey roller 14 between the sheet supplying apparatus 1 and the pump 39. The drive switching arm 41 is located at the position shown in FIG. 1, other than the sheet supplying operation and the cleaning operation. In this condition, since a planetary gear (not shown) rotated around a shaft of the convey roller 14 is fixed at a predetermined position, the driving force of the convey roller 14 is not transmitted to the pump 39 and the sheet supplying apparatus 1.

When the drive switching arm 41 is shifted in a direction shown by the arrow A in FIG. 1 by shifting the carriage 26, the planetary gear is shifted in response to normal/reverse rotation of the convey roller 14 so that the driving force is transmitted to the sheet supplying apparatus upon the normal rotation of the convey roller 14 and is transmitted to the pump 39 upon the reverse rotation of the convey roller 14. The LF motor 23 for driving the convey roller 14 and the carriage motor 29 for driving the carriage 26 may be stepping motors rotated by a predetermined angle in response to signals sent from corresponding motor drivers (not shown).

When the drive switching arm 41 of the cleaning portion 38 is shifted in the direction by the carriage 26 and the convey roller 14 is rotated in the normal direction, the planetary gear (not shown) is shifted to be engaged by the input gear 8*a* (FIG. 5), thereby transmitting the driving force to the sheet supplying apparatus 1. The input gear 9*a* serves to transmit the driving force to the sheet supply roller gear 8*d* through the idler gears 8*b*, 8*c*, thereby rotating the sheet supply roller 2 to supply the sheet P.

The sheet supply roller gear 8*d* serves to transmit the driving force to the release cam gear 9 through the clutch gear 8*e* and idler gear 9*f*. In this case, the sheet supply roller 2 and the release cam gear 9 are rotated in phase with each other every revolution. Further, in the condition (FIGS. 8 and 9) that the pressure plate 6 is released, as shown in FIG. 10, the D-cut portion of the sheet supply roller 2 is opposed to the pressure plate 6. The release cam gear 9 is designed so that the pressure plate 6 is released only regarding the D-cut portion (having a circumferential angle of 120°) of the sheet supply roller 2 so that, whenever any portion of the sheet supply roller 2 other than the D-cut portion is opposed to the pressure plate 6, such a portion is always contacted with the sheet P or the pressure plate 6 with pressure of 200 to 500 gf.

As shown in FIG. 9, the release cam gear 9 can release the pressure of the pressure plate 6 by depressing the push-down portion 6*b* of the pressure plate 6 protruded upwardly through an opening formed in the right side plate 5*b* of the base 5. In this case, the pressure plate cam 47 attached to the base 5 shown in FIG. 2 is pushed downwardly by the cam 6*c* near the push-down portion 6*b* of the pressure plate 6 to rotate the pressure plate cam 47 around a shaft 47*a*, thereby pushing the cam 6*d* remote from the push-down portion 6*b* downwardly. In this way, the base 5 is rocked in parallel with respect to both lateral edges without distortion.

With the arrangement as mentioned above, even when the push-down portion 6*b* formed on the end of the pressure plate 6 is pushed downwardly, the pressure plate 6 is not inclined with respect to the base 5, and the pressure of the pressure plate is released substantially in parallel with respect to both lateral edges. As shown in FIG. 8, a clutch spring 48 is disposed within the clutch gear 8*e* so that, when the clutch gear 8*e* tries to rotate in a direction shown by the arrow B in FIG. 8, the clutch spring 48 is tightened to prevent a reverse rotation of the clutch gear.

As shown in FIG. 1, the discharge portion 33 includes a discharge roller 34, a transmission roller 35, and spurs 36 for helping the discharge of the sheet P. By using the discharge roller 34 and the spurs 36, the sheet P can be discharged without smudging the imaged surface of the sheet.

Next, an arrangement regarding manual sheet insertion (manual sheet supply) providing a feature of the present invention will be explained with reference to FIGS. 12 to 16. Below the sheet supporter 50, a manual insertion sheet member 51 formed from PET film sheet (having a thickness of 0.25 mm) and having a shape as shown in FIG. 14 is attached via a fix portion 53 thereof in such a manner that a free end portion of the sheet member can be freely flexed.

Figure 13:
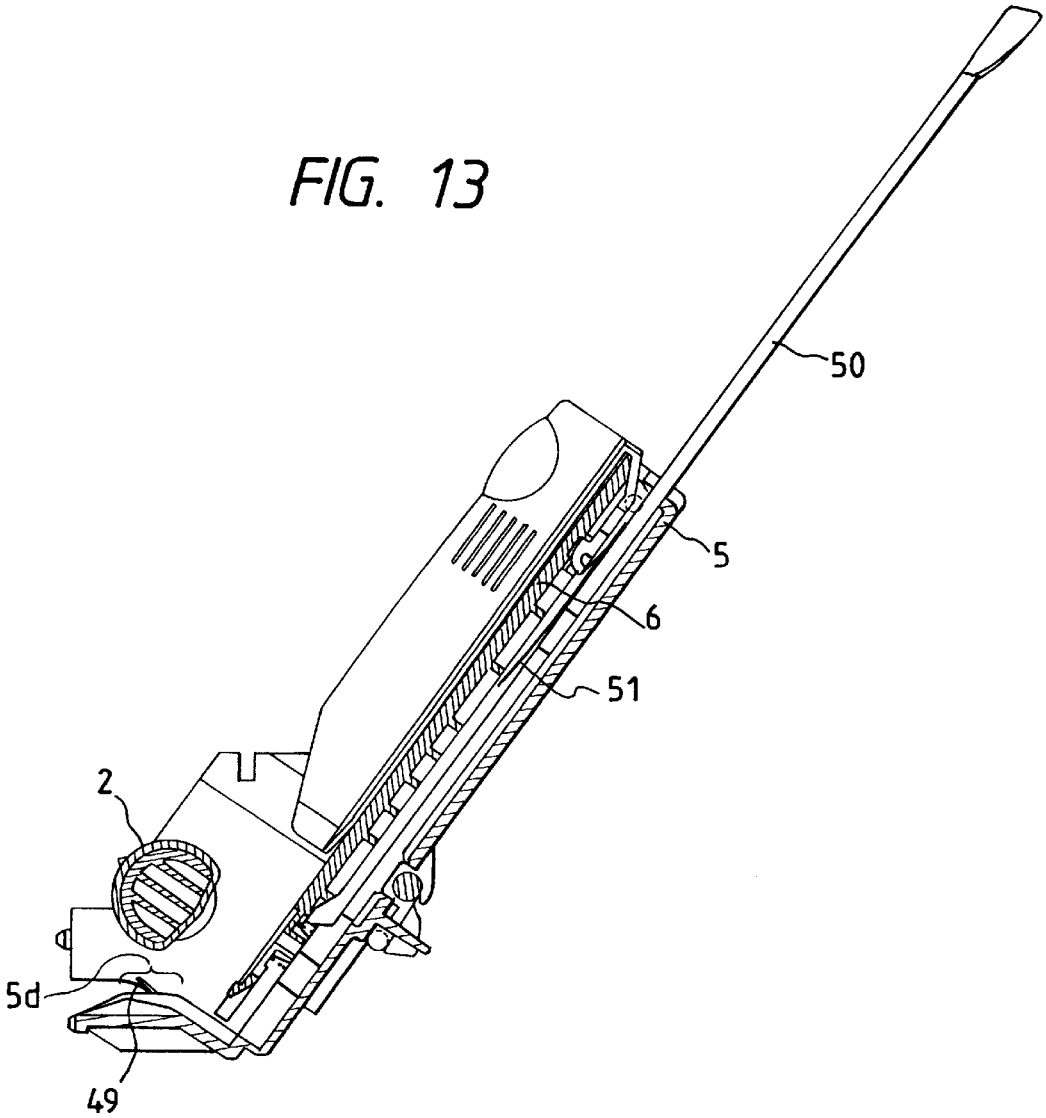
FIG. 13 is a side sectional view of the sheet supply portion of FIG. 12.
Figure 15:
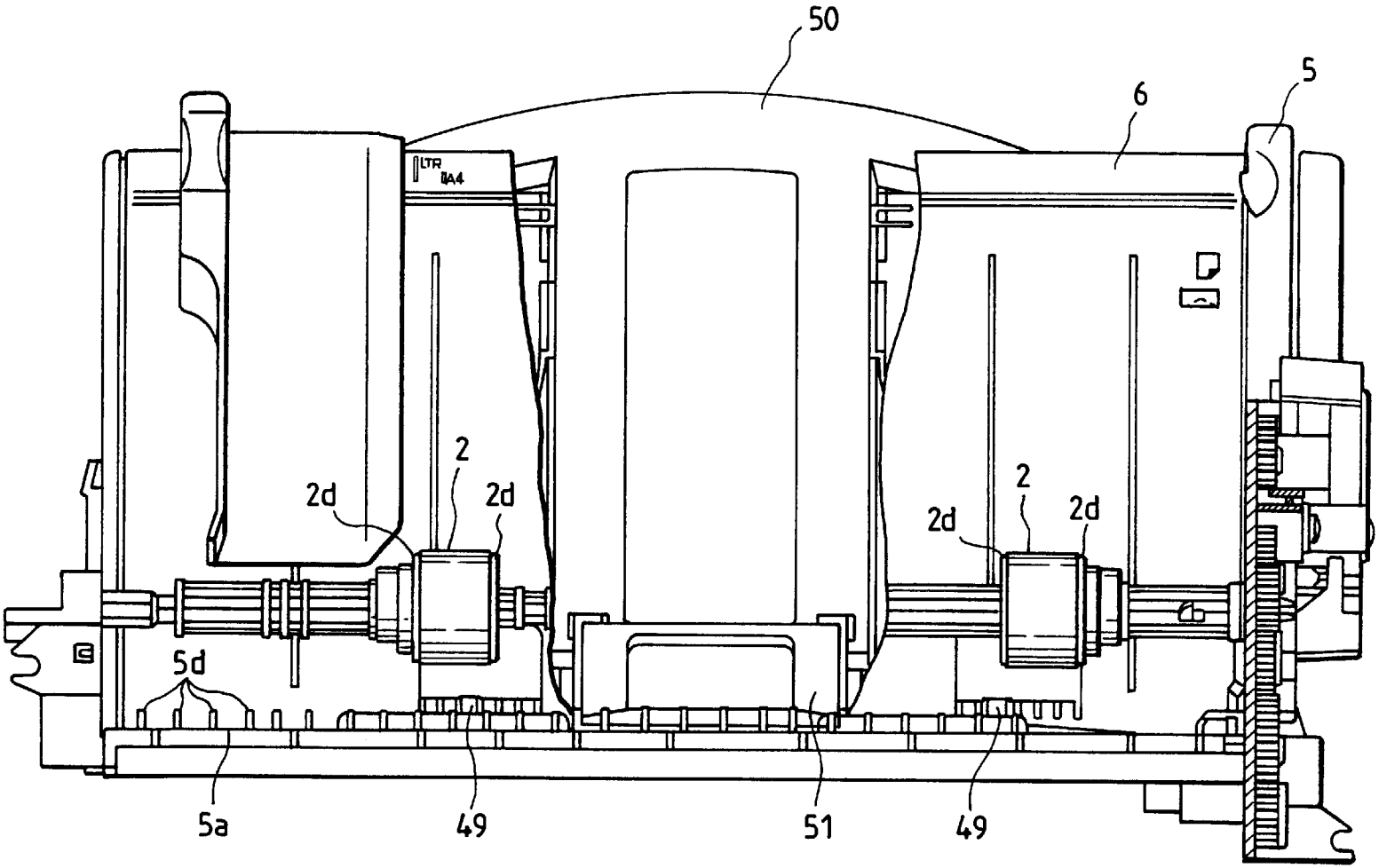
FIG. 15 is a plan view of the sheet supply portion according to the first embodiment, showing a condition that the sheet supporter is lowered.
Figure 16:
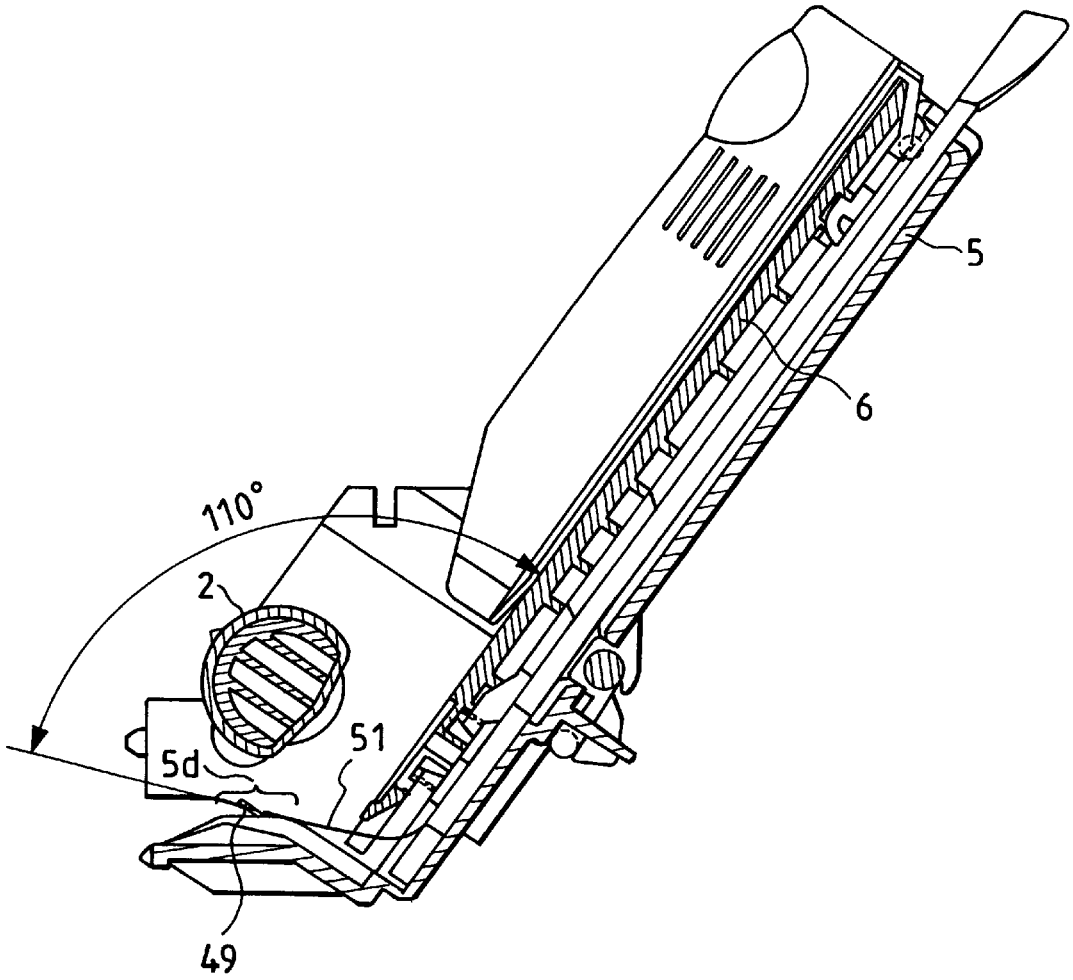
FIG. 16 is a side sectional view of the sheet supply portion of FIG. 15.

The manual insertion sheet member 51 can be shifted together with the sheet supporter 50 so that, when the sheet supporter 50 is extended, as shown in FIGS. 12 and 13, the manual insertion sheet member is concealed between the base 5 and the pressure plate 5, and, when the sheet supporter 50 is retracted, as shown in FIGS. 15 and 16, the free end portion of the manual insertion sheet member is flexed along the sheet tip end abutment portion 5*d* of the base 5 to be inclined by an angle of about 110° (greater than the angles of the sheet tip end abutment portion 5*d* and the sheet tip end abutment portions 49) with respect to the surface of the sheet stack P rested on the pressure plate 6 as shown in FIG. 16. With this arrangement, when the sheet is manually supplied, an abutment angle of the tip end of the sheet P with respect to the sheet tip end abutment portion 5*d* is increased, thereby improving the sheet supplying ability in the manual sheet supply.

Figure 14:
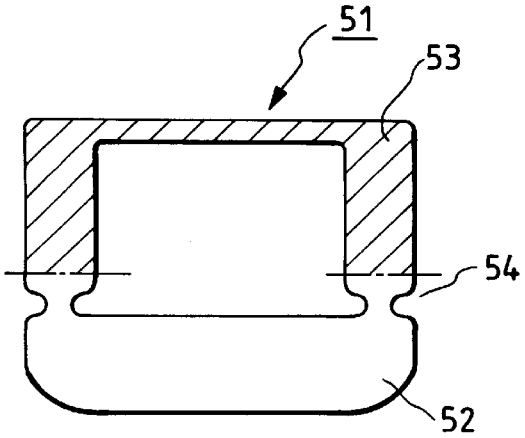
FIG. 14 is a front view showing a manual sheet insertion portion.

Further, as shown in FIG. 14, a narrower bent portion 54 is formed between the fix portion 53 and a manual insertion guide portion 52 of the manual insertion sheet member 51 to keep the manual insertion guide portion 52 in a flat condition as much as possible, thereby improving the sheet supplying ability in the manual sheet supply.

Figure 17A:
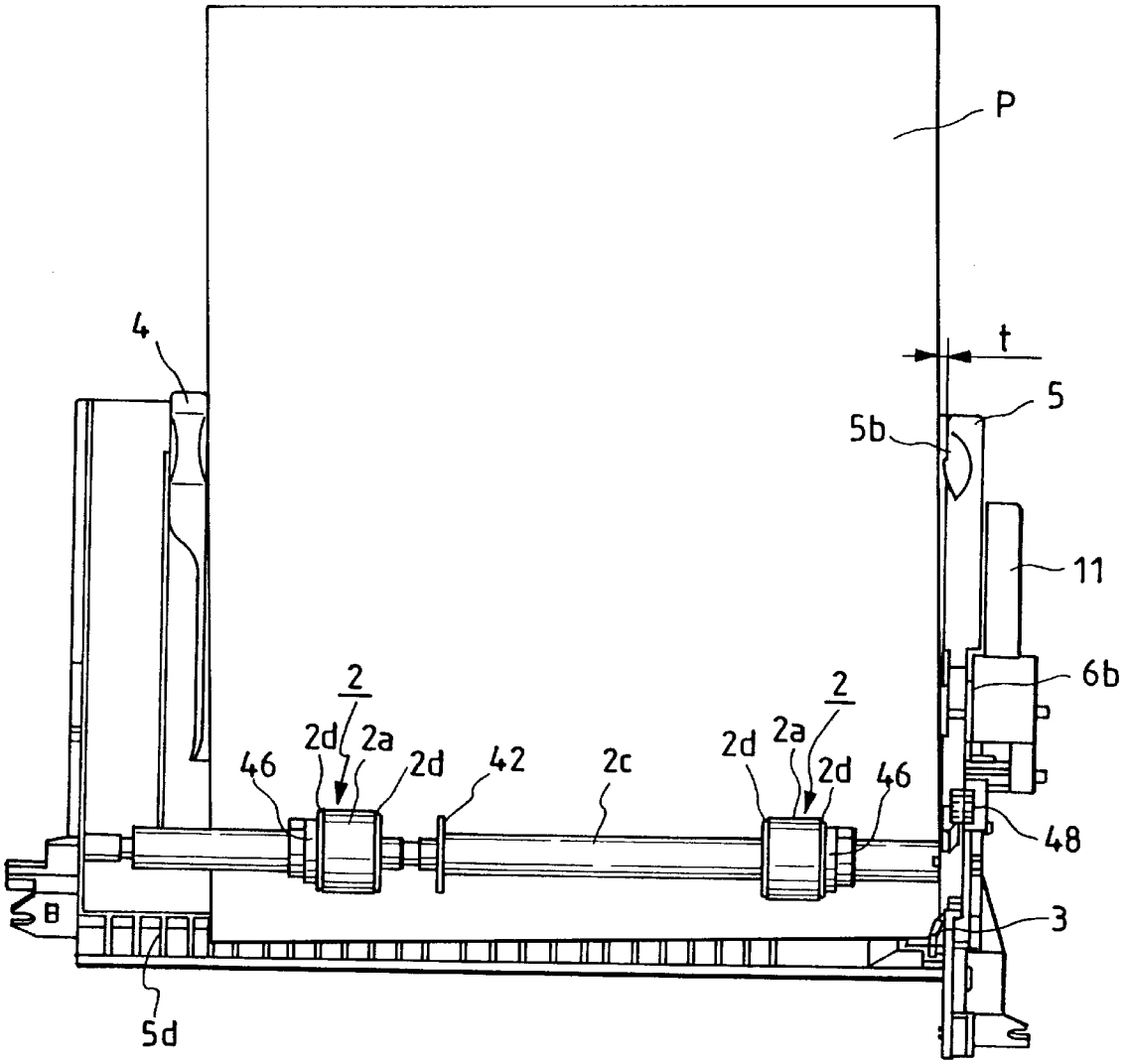
FIGS. 17A, 17B, 18A, 18B, 19A, 19B and 20A, 20B are views for explaining the sheet supplying operation of a sheet supply means.
Figure 17B:
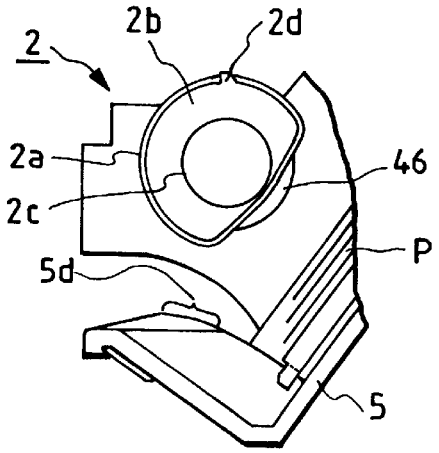

Next, a method for stabilizing the posture of the supplied sheet P by the effect of the separation areas of the sheet supplying apparatus 1 will be explained with reference to FIGS. 17A to 20B. First of all, in the sheet supplying apparatus 1 according to the illustrated embodiment, since the separation pawl 3 for regulating the front corner of the sheet stack P is disposed only at one side of the apparatus, as shown in FIGS. 17A and 17B, although the sheet tip end regulating action can be obtained by the sheet tip end abutment portion 5*d* and the sheet tip end abutment portions 49, the sheet stack P is set in a condition that the front corner of the sheet stack not regulated by the separation pawl 3 is slightly advanced toward the downstream side. From this condition, by rotating the sheet supply roller 2, the sheet stack P rested on the pressure plate 6 is urged against the sheet supply roller 2, thereby starting the sheet supplying operation.

Figure 18A:
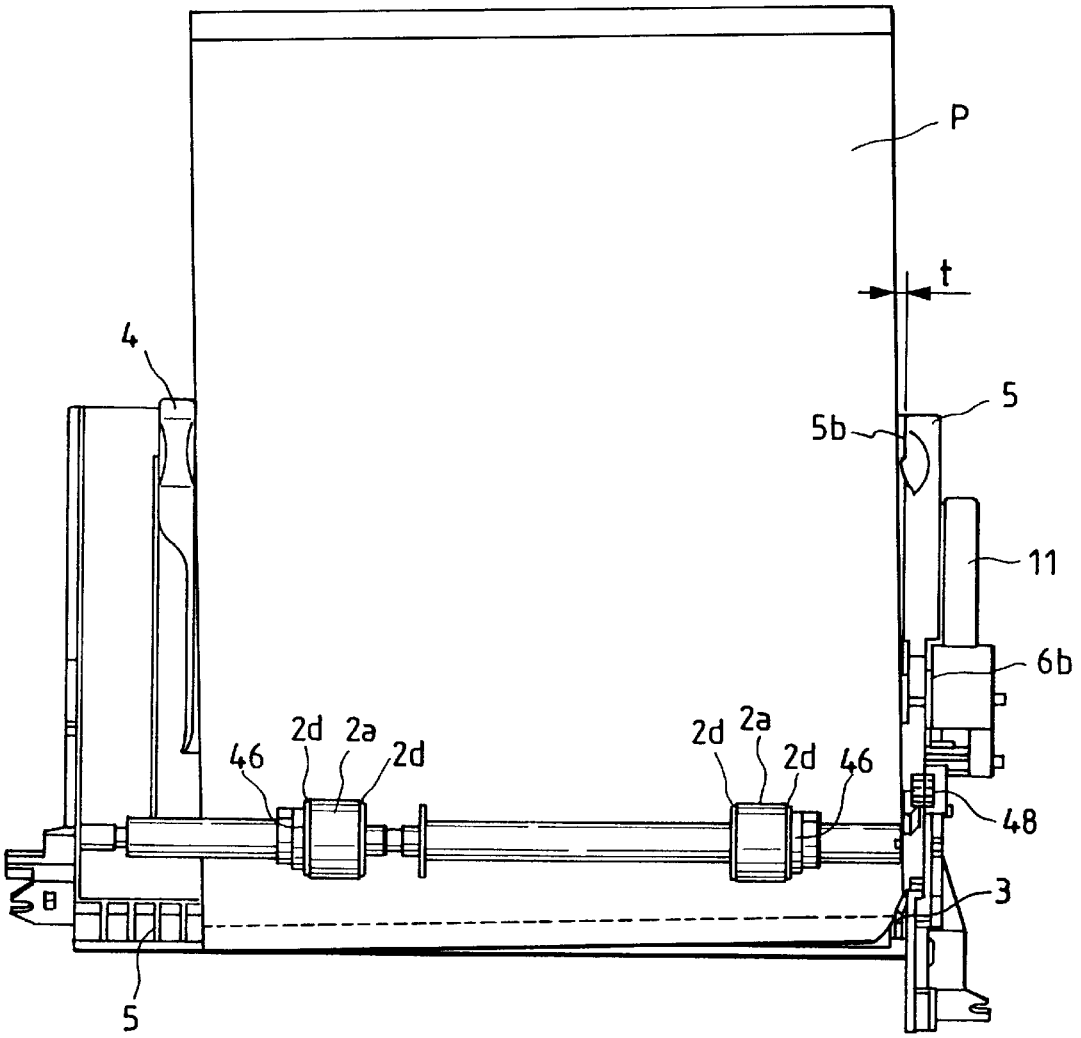
Figure 18B:
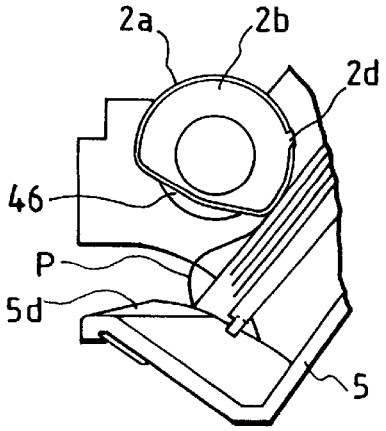
Figure 19A:
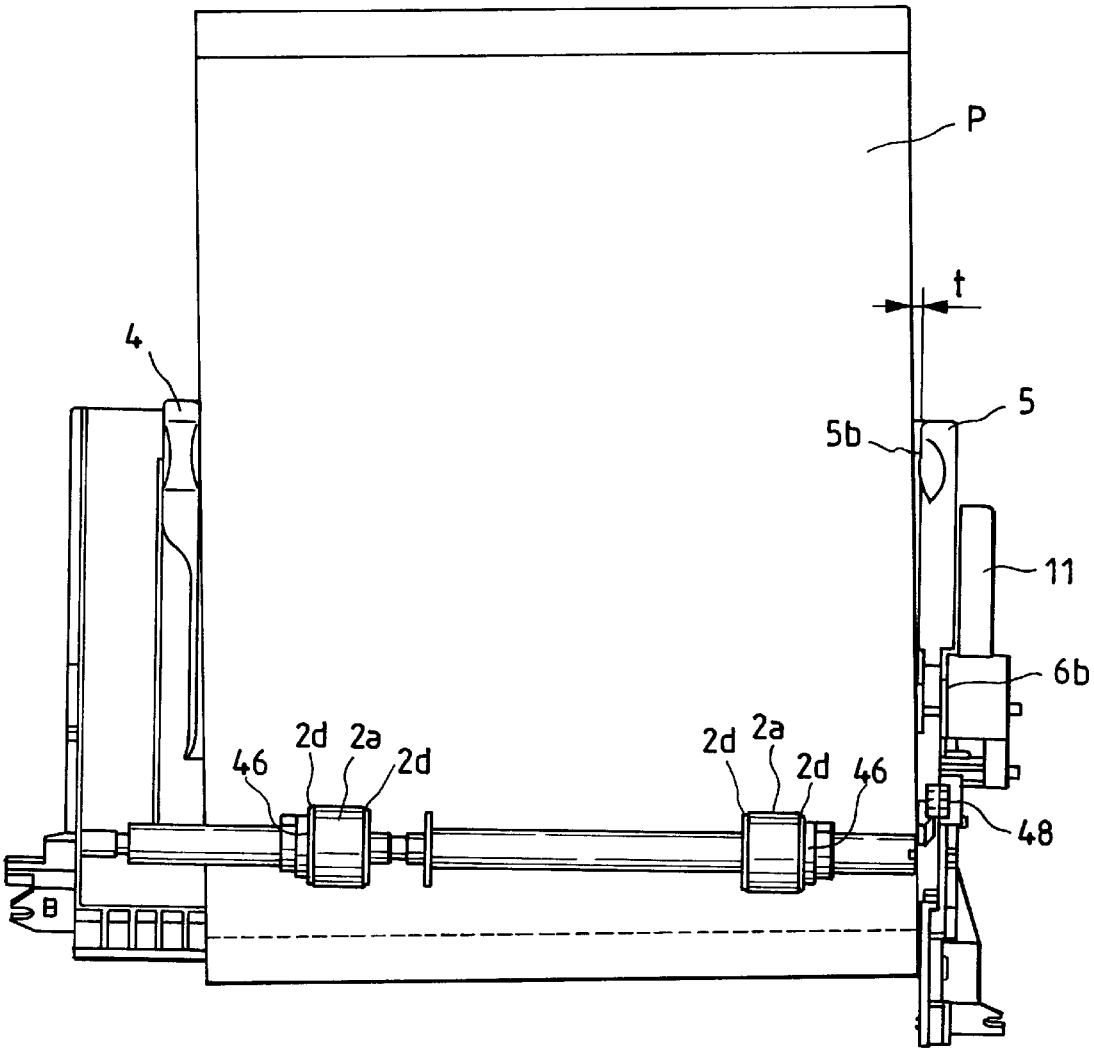
Figure 19B:
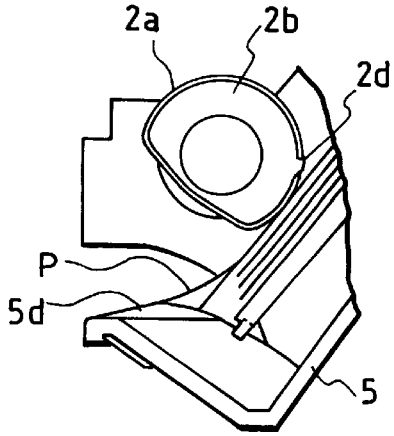

Then, as shown in FIGS. 18A and 18B, as the sheet supply roller 2 is further rotated, the sheet P starts to separate from the separation pawl 3. FIGS. 19A and 19B show a condition that the sheet has been separated from the separation pawl 3. At this point, for example, as shown in FIGS. 17A and 17B, if the sheet stack is rested on the pressure plate in a skew condition, the separated sheet is also skewed.

After the sheet is separated from the separation pawl 3, the ribs 2*d* of the sheet supply roller 2 start to contact with the tip end of the sheet P and the supply rubber rollers 2*a* are separated from the sheet P. Since the ribs 2*d* are made of the same low friction material as the sheet supply roller 2, a friction force between the sheet P being supplied and the sheet stack P rested on the pressure plate 6 becomes greater than a friction force between the sheet P being supplied and the sheet supply roller 2, with the result that the sheet P being supplied becomes in a stopped condition.

In the illustrated embodiment, the ribs 2*d* acts as both a separation means and a regulating means for regulating the movement of the sheet P. Since the separation areas of the ribs 2*d* of the roller portion 2*b* remote from the right side plate 5*b* are longer than the separation areas of the ribs 2*d* of the roller portion 2*b* near the right side plate 5*b*, the sheet P being supplied is rotated around the roller portion 2*b* remote from the right side plate 5*b* (i.e., sheet reference surface) in a direction shown by the arrow D in FIGS. 20A and 20B, thereby abutting the lateral edge (near the sheet reference surface) of the sheet P against the right side plate 5*b* of the base 5.

In this way, if the sheet P is skewed in a direction opposite to the direction before the sheet P is separated from the supply rubber rollers 2*a*, due to the difference in length between the separation areas of both roller portions 2*b*, the sheet is rotated in the direction D. And, when the lateral edge of the sheet P abuts against the right side plate 5*b* of the base 5, a force for rotating the sheet in the direction opposite to the direction D in FIGS. 20A and 20B is generated, which force overcomes the friction force between the sheet stack P and the sheet P being supplied, with the result that, when both roller portions 2*b* are in the slipped condition, the posture of the sheet P is corrected to direct to a direction parallel to the sheet supplying direction.

Figure 20A:
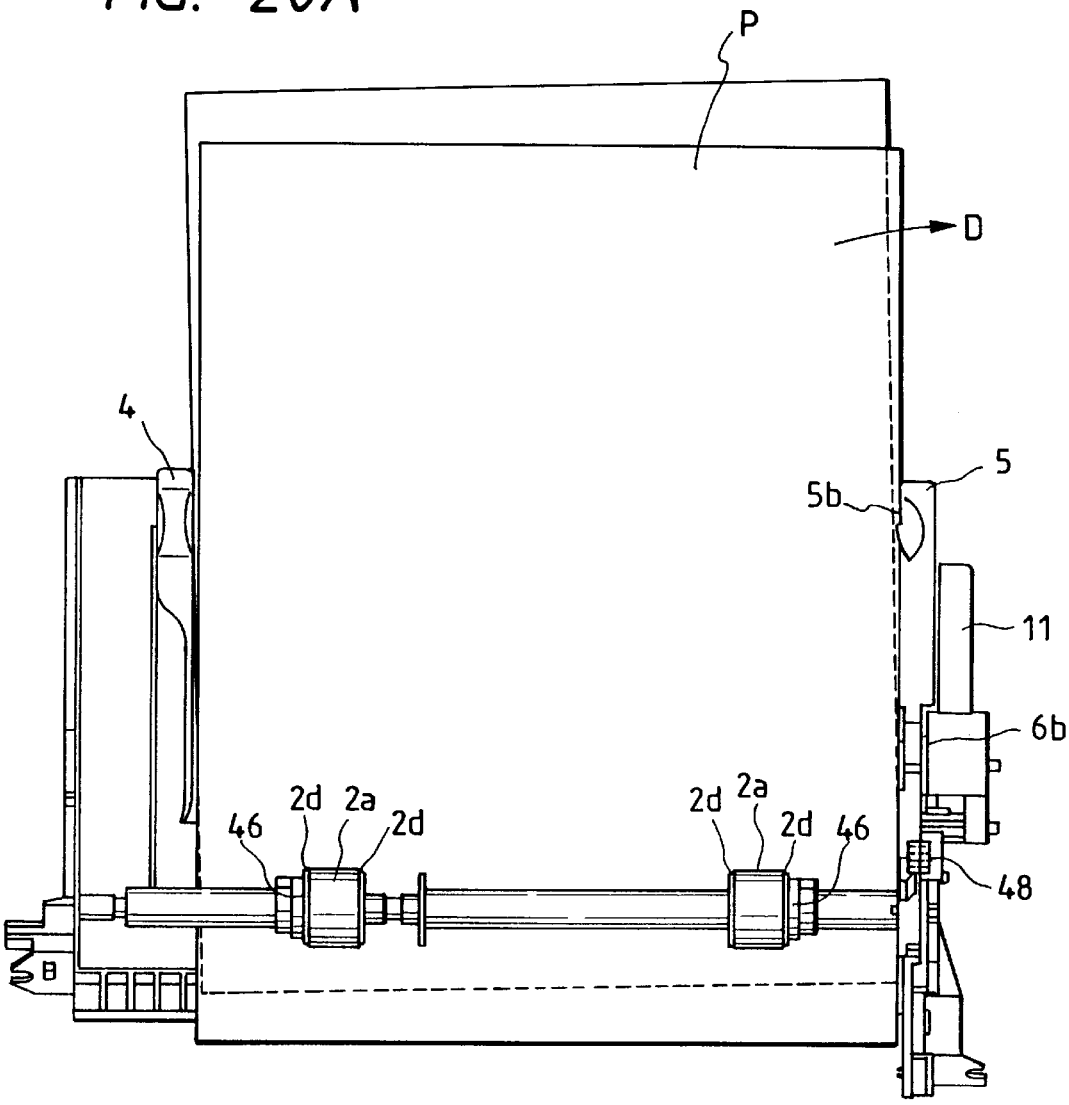
Figure 20B:
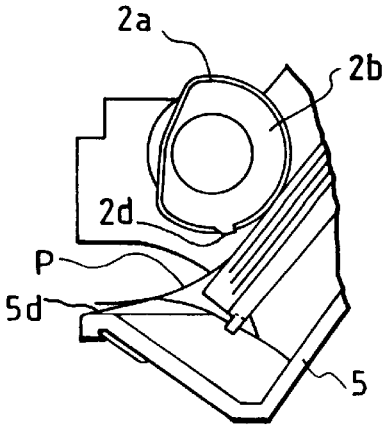

Before the sheet P is separated from the supply rubber rollers 2*a*, if the sheet P is skewed in the direction D in FIGS. 20A and 20B, due to the difference in length between the separation areas of both roller portions 2*b*, although the sheet P is further rotated in the direction D, when the separation areas of both roller portions 2*b* reach the sheet to generate the slipped condition of the sheet, the lateral edge (near the sheet reference surface) of the sheet P is subjected, from the right side plate 5*b* of the base 5, to the force for rotating the sheet in the direction opposite to the direction D in FIGS. 20A and 20B, which force overcomes the friction force between the sheet stack P and the sheet P being supplied, with the result that the posture of the sheet P is corrected to direct to a direction parallel to the sheet supplying direction.

Further, since the separation areas of the roller portion 2*b* near the sheet reference surface leaves the sheet P slightly faster than the separation areas of the other roller portion, the sheet P is prevented from being separated from the right side plate 5*b* of the base 5 due to the force for rotating the sheet P in the direction opposite to the direction D when the lateral edge abuts against the right side plate 5*b*. As shown in FIGS. 17A and 17B, the difference in slipped amount between both roller portions 2*b* is set as mentioned above on the basis of a clearance t (about 1 mm) created by the inclination of the sheet stack P caused by the fact that only one side of the sheet stack in supported by the separation pawl 3 and a sheet rotating amount required for changing the clearance from "t" to "zero" (calculated from a distance between two roller portions 2*b*).

Next, a controlling operation of the sheet supplying apparatus 1 will be explained in connection with a flow chart shown in FIG. 21, referring to operating conditions shown in FIGS. 22A to 22E. The controlling operation of the sheet supplying apparatus 1 when the sheet supply roller 2 is in a predetermined initial position differs from the controlling operation when the sheet supply roller is not in the initial position (for example, due to occurrence of trouble). First of all, the controlling operation when the sheet supply roller 2 is in the initial position will be described.

Figures 21, 21A:
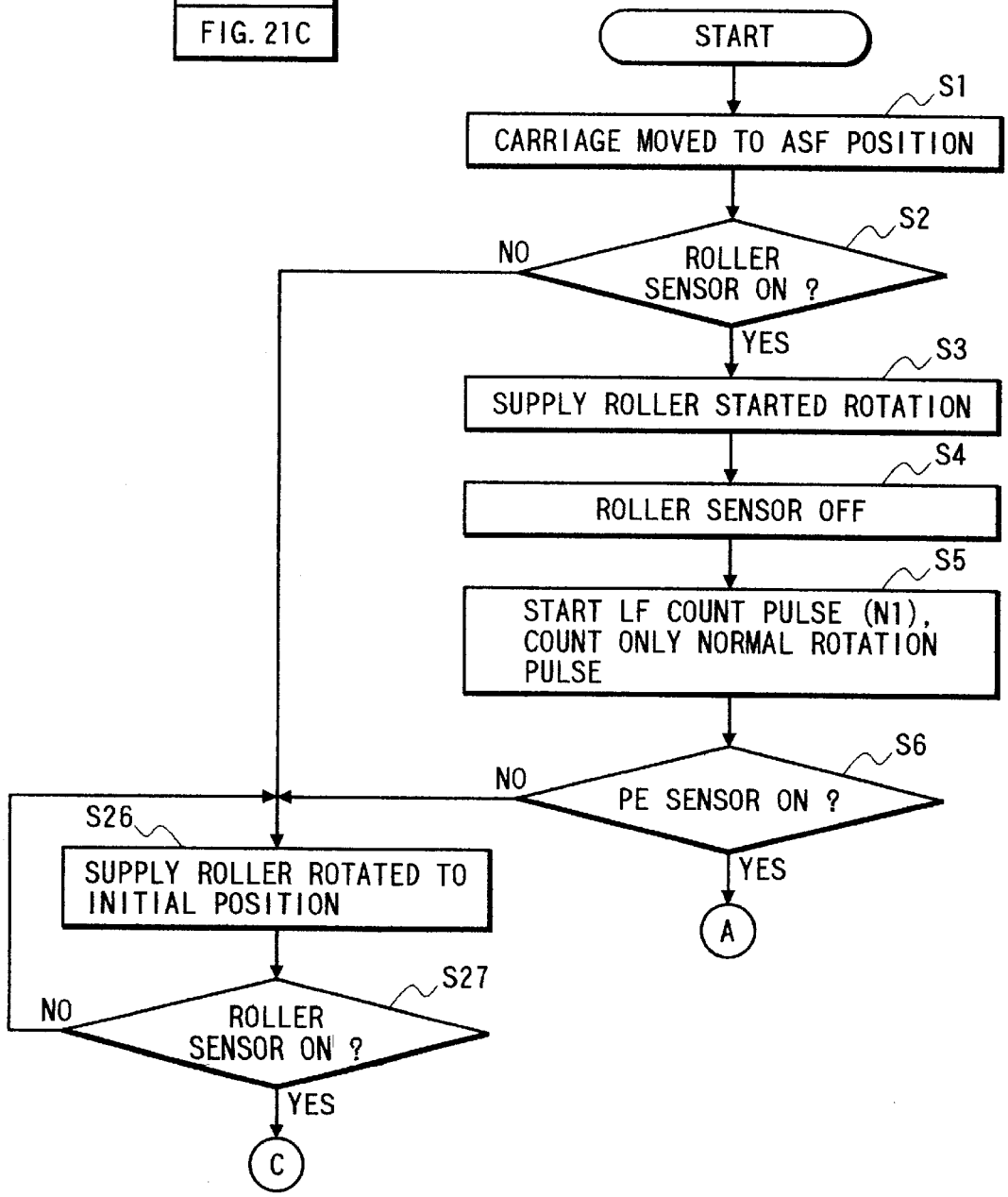
FIG. 21 is comprised of FIGS. 21A, 21B and 21C showing flow charts illustrating a control operation of the sheet supplying apparatus.
Figure 21B:
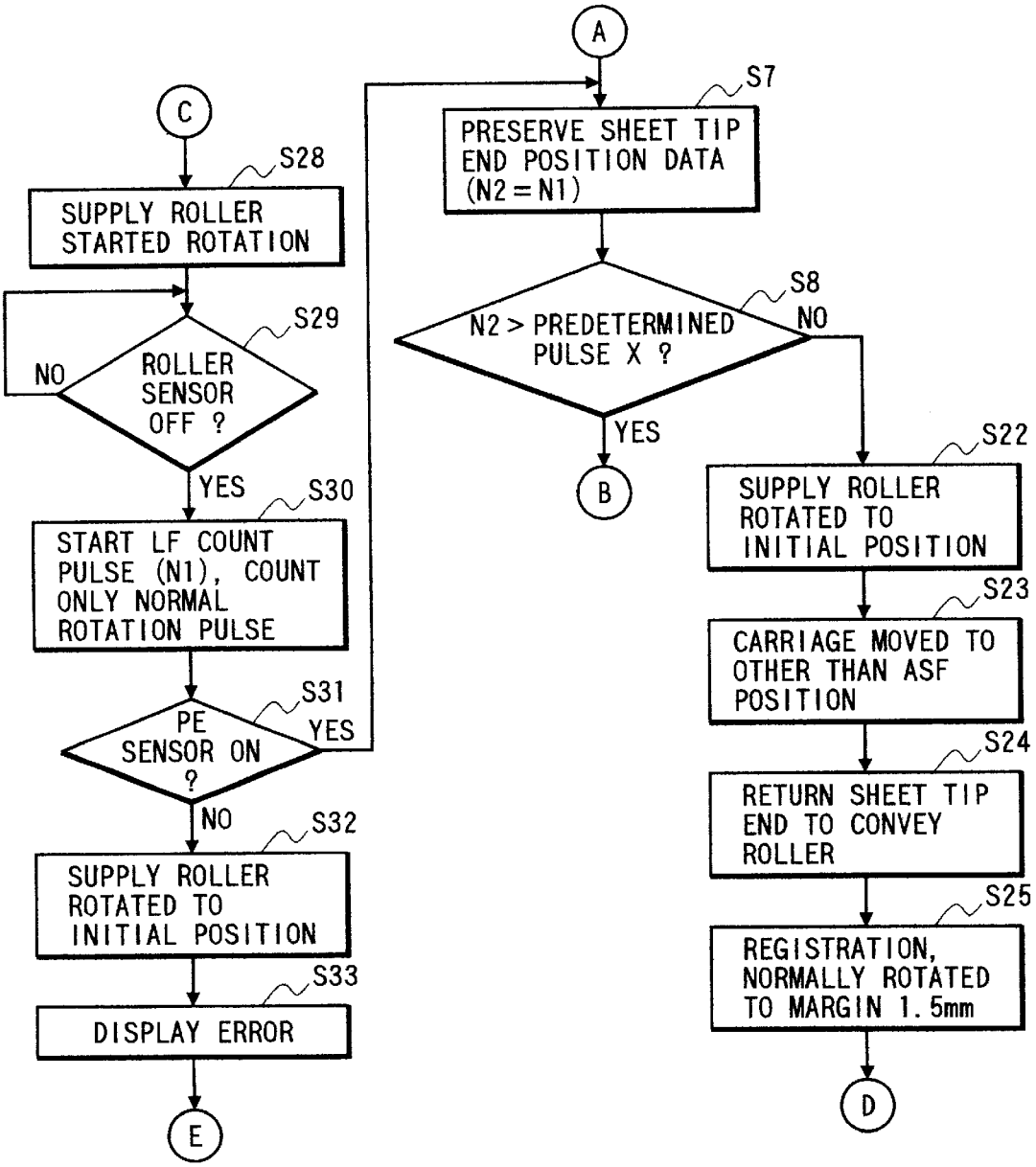
Figure 21C:
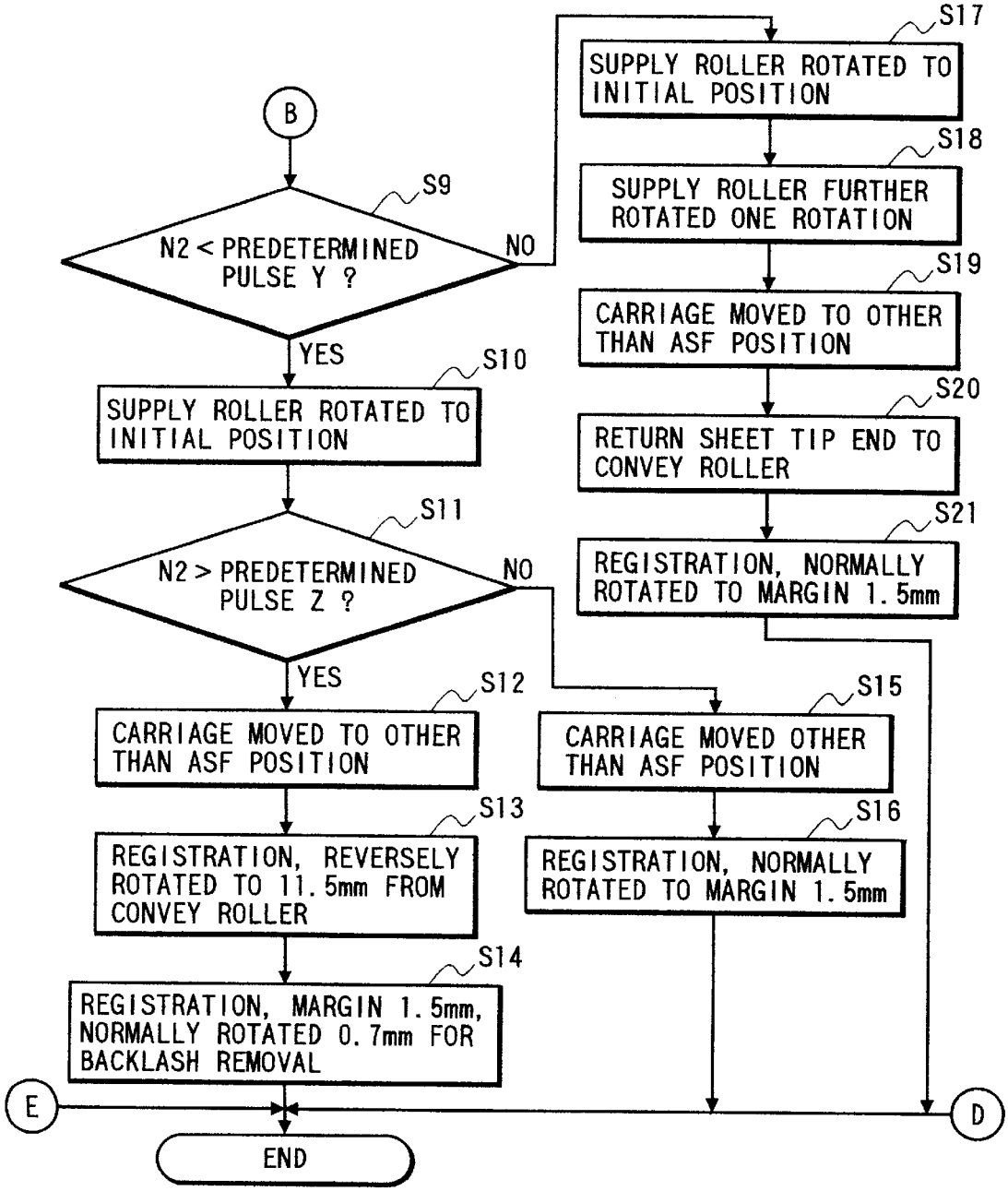
Figure 22A:
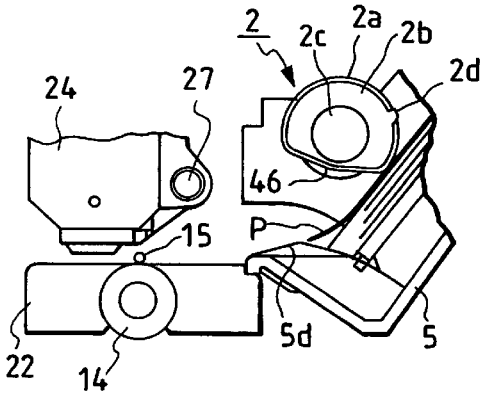
FIGS. 22A to 22E are views for explaining the sheet supplying operation of the sheet supply apparatus.
Figure 22D:
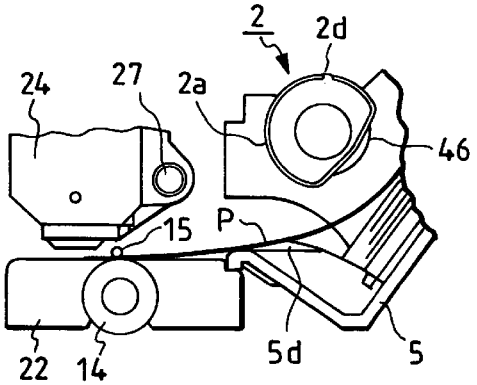
Figure 22B:
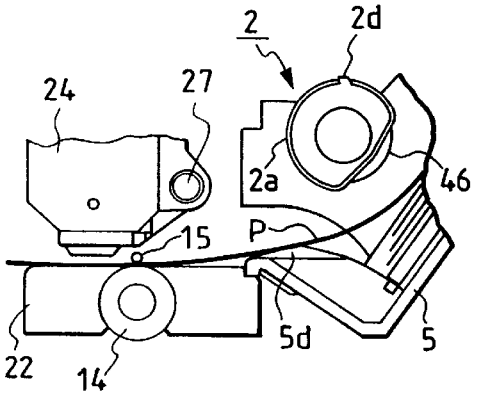
Figure 22E:
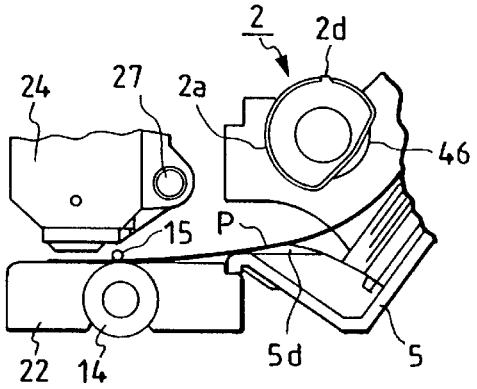
Figure 22C:
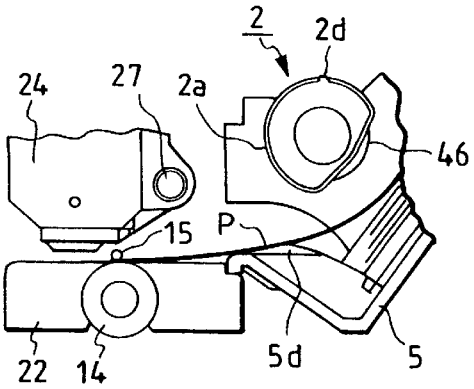

In FIG. 21, when a supply start signal is emitted, in a step S1, the carriage 26 is shifted and the drive switching arm 41 is shifted so that the driving force of the convey roller 14 can be transmitted to the sheet supply apparatus 1 (ASF position). Then, in a next step S2, the condition of the roller sensor 44 is judged. If the sheet supply roller 2 is positioned in the initial position, the program goes to a step S3; otherwise, the program goes to a step S26.

If the sheet supply roller 2 is positioned in the initial position, in the step S3, the sheet supply roller 2 is rotated, and the program goes to a step S4, where the edge of the sensor plate 42 is detected. Then, in a step S5, the number (N1) of drive pulses of the LF motor 23 after detection is counted to correctly control the angular position of the sheet supply roller 2, thereby effecting the control with high accuracy. When the sheet supply roller 2 is rotated by about 60° to oppose the cylindrical portions of the supply rubber rollers 2*a* to the sheet stack P, the release cam 12 rotated in synchronous with the sheet supply roller 2 releases the pressure plate 6, with the result that the sheet stack P is urged against the supply rubber rollers 2*a* by the biasing force of the pressure plate springs 7, thereby generating the sheet conveying force (refer to FIG. 22A).

Then, the program goes to a step S6, where the tip end of the sheet P being conveyed is detected by the PE sensor 19, and then, in a next step S7, the pulse count number "N1" of the LF motor 23 upon detection is preserved as "N2".

Then, in steps S8 and S9, if predetermined pulse number X<N2<predetermined pulse number Y, it is judged as a normal condition, and the program goes to a step S10, where the sheet supply roller 2 is rotated up to the initial position where the D-cut portions of the roller portions 2*b* are opposed to the sheet stack P. During this rotation, the push-down portion 6*b* of the pressure plate 6 is again pushed downwardly by the release cam 12, thereby releasing the pressure plate 6 again (refer to FIG. 22B). When the rotation of the sheet supply roller 2 is completed, the tip end of the sheet P has passed between the convey roller 14 and the pinch roller 15. In this case, when the sheet supply roller 2 is rotated up to the initial position, the position of the tip end of the sheet P is calculated on the basis of the drive pulse count number N2.

Then, in a step S11, if the value is greater than a predetermined pulse number Z, it is judged that the tip end of the sheet P is positioned at a downstream side of a tip end of the nozzle of the recording head 24, and, in a step S12, the carriage 26 is shifted, and, then, in a step S13, the LF motor 23 is rotated reversely to return the tip end of the sheet to a position spaced apart from the convey roller 14 by 11.5 mm. The reverse rotation amount of the LF motor 23 is calculated on the basis of the value N2. In this case, in the step S12, since the drive switching arm 41 has been shifted by the carriage 26, the driving force of the convey roller 14 is not transmitted to the sheet supply apparatus 1. Then, in a step S14, the convey roller 14 is rotated in the normal direction to convey the sheet by 0.7 mm, thereby eliminating the backlash of the gears. As a result, a margin of 1.5 mm from the tip end of the nozzle of the recording head 24 can be set (refer to FIG. 22E), and the sheet supply is finished.

In the step S11, if the value N2 is smaller than the predetermined pulse number Z, it is judged that the tip end of the sheet P is positioned at an upstream side of the tip end of the nozzle of the recording head 24 (refer to FIG. 22D), and the program goes to a step S15, where the carriage 26 is shifted. In this condition, by rotating the convey roller 14 in the reverse direction, the drive switching arm 41 is shifted so that the driving force of the convey roller 14 cannot be transmitted to the sheet supplying apparatus 1.

Then, in a next step S16, the convey roller 14 is rotated in the normal direction so that a margin of 1.5 mm from the tip end of the nozzle of the recording head 24 can be set (refer to FIG. 22E), and the sheet supply is finished. On the other hand, in the step S9, if the pulse count number N2 of the LF motor 23 upon detection of the tip end of the sheet P is greater than the predetermined pulse number Y, it is judged that there arises a trouble condition that slip is caused between the sheet P and the sheet supply roller 2 not to reach the tip end of the sheet P the nip between the convey roller 14 and the pinch roller 15. Then, the program goes to a step S17. In the step S17, the sheet supply roller 2 is rotated up to the initial position, and, in a step S18, the sheet supply roller is further rotated by one revolution. Then, in a step S19, the carriage 26 is shifted. Then, in a step S20, the convey roller 14 is rotated in the reverse direction to return the tip end of the sheet P to the convey roller 14 (refer to FIG. 22C). As a result, the drive switching arm 41 is shifted so that the driving force of the convey roller 14 cannot be transmitted to the sheet supplying apparatus 1. Then, in a step S21, the convey roller 14 is rotated in the normal direction by a predetermined pulse number so that a margin of 1.5 mm from the tip end of the nozzle of the recording head 24 can be set (refer to FIG. 22E), and the sheet supply is finished.

In the step S8, if the pulse count number N2 of the LF motor 23 upon detection of the tip end of the sheet P is smaller than the predetermined pulse number X, it is judged that there arises a trouble condition that the sheet stack P is protruded toward the downstream side before the sheet supplying operation and the ribs 2*d* of the sheet supply roller 2 are contacted with the sheet after the tip end position is detected to separate the supply rubber rollers 2*a* from the sheet P, thereby making the recognition of the correct position of the tip end of the sheet impossible, and the program goes to a step S22. In the step S22, the sheet supply roller 2 is rotated up to the initial position, and, in a step S23, the carriage 26 is shifted. Then, in a step S24, the convey roller 14 is rotated in the reverse direction to return the tip end of the sheet P to the convey roller 14 (refer to FIG. 22C). As a result, the drive switching arm 41 is shifted so that the driving force of the convey roller 14 cannot be transmitted to the sheet supplying apparatus 1.

Then, in a step S25, the convey roller 14 is rotated in the normal direction by a predetermined pulse number so that a margin of 1.5 mm from the tip end of the nozzle of the recording head 24 can be set (refer to FIG. 22E), and the sheet supply is finished. In the step S6, if the PE sensor 19 is not turned ON, in the step S26, the sheet supply roller 2 is rotated up to the initial position, and, in a step S27, when it is ascertained that the roller sensor 44 is turned ON, the program goes to a step S28, where the sheet supply roller 2 is rotated again.

Then, in a step S29, when the edge of the sensor plate 42 is detected (in this case, the roller sensor 44 is turned OFF), the program goes to a step S30, where the angular position of the sheet supply roller 2 is correctly controlled by counting the number (N1) of drive pulses of the LF motor 23 after the edge was detected. Then, in a step S31, if the tip end position of the sheet P is detected (in this case, the PE sensor 19 is turned ON), the program goes to the step S27; whereas, if the tip end position is not detected, the program goes to a step S32, where the sheet supply roller 2 is rotated up to the initial position and stopped there, and, in a step S33, error display is effected, and then, the sheet supply is finished.

Second Embodiment

Next, a sheet supplying apparatus according to a second embodiment of the present invention will be explained with reference to FIGS. 23 to 26.

In this embodiment, in order to set the sheet abutment surfaces of the sheet tip end abutment portions 5*d*, 49 to the angle permitting the automatic sheet supply and the angle permitting the manual sheet insertion, by rotating the sheet tip end abutment portions 5*d*, 49 entirely or partially, the angle of the sheet abutment surfaces with respect to the surface of the sheet stack P can be changed by an angle change means. Incidentally, the same elements as those of the first embodiment are designated by the same reference numeral and explanation thereof will be omitted.

Figure 23:
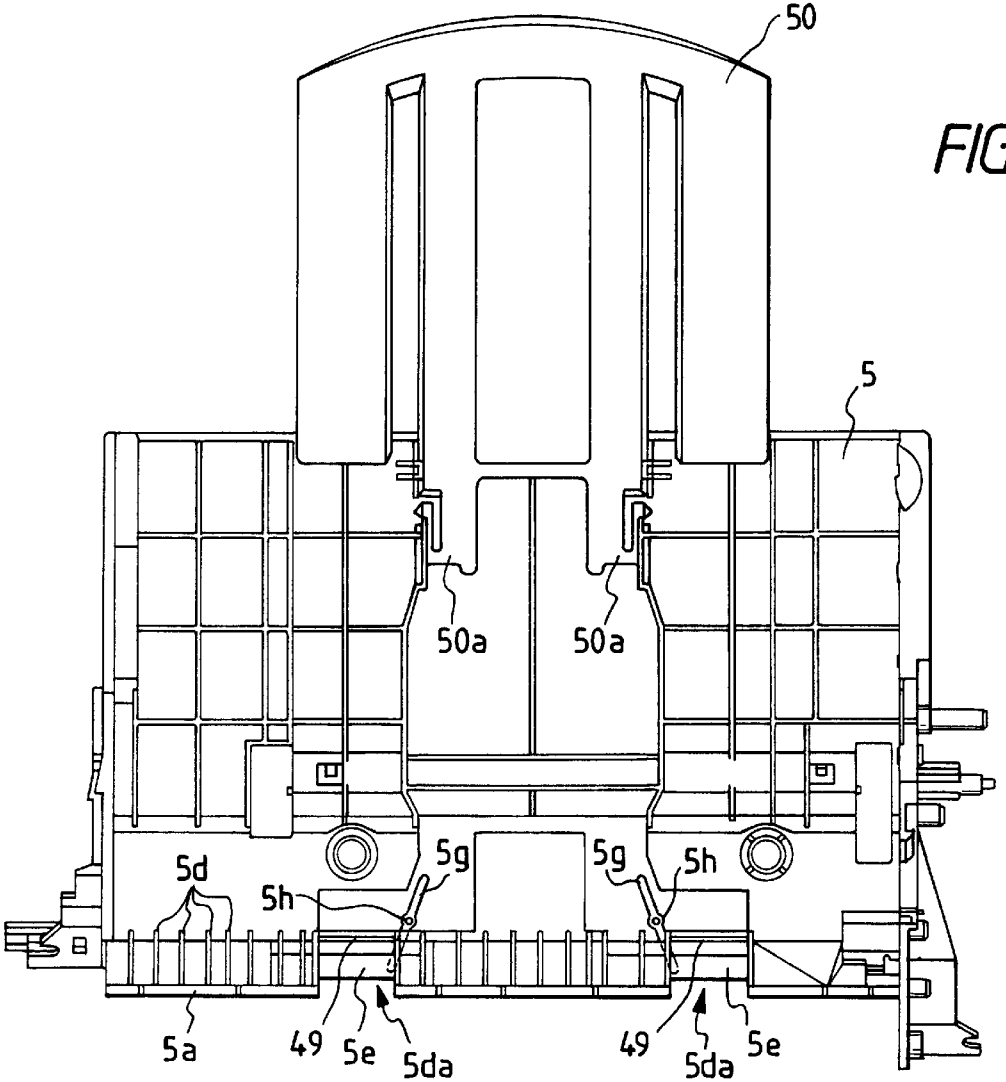
FIG. 23 is a plan view of a sheet supply portion of a sheet supplying apparatus according to a second embodiment of the present invention, showing a condition that a sheet supporter is lifted.
Figure 24:
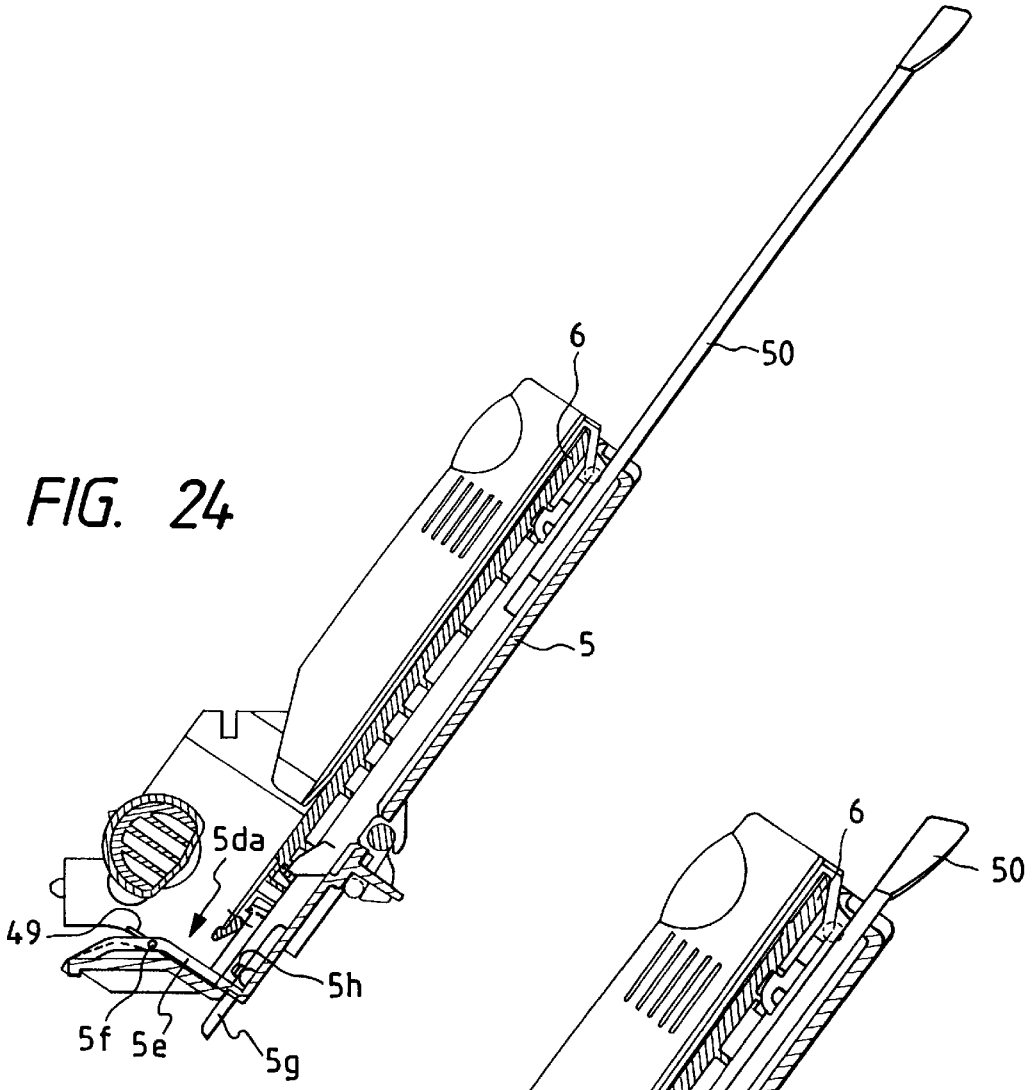
FIG. 24 is a side sectional view of the sheet supply portion of FIG. 23.
Figure 26:
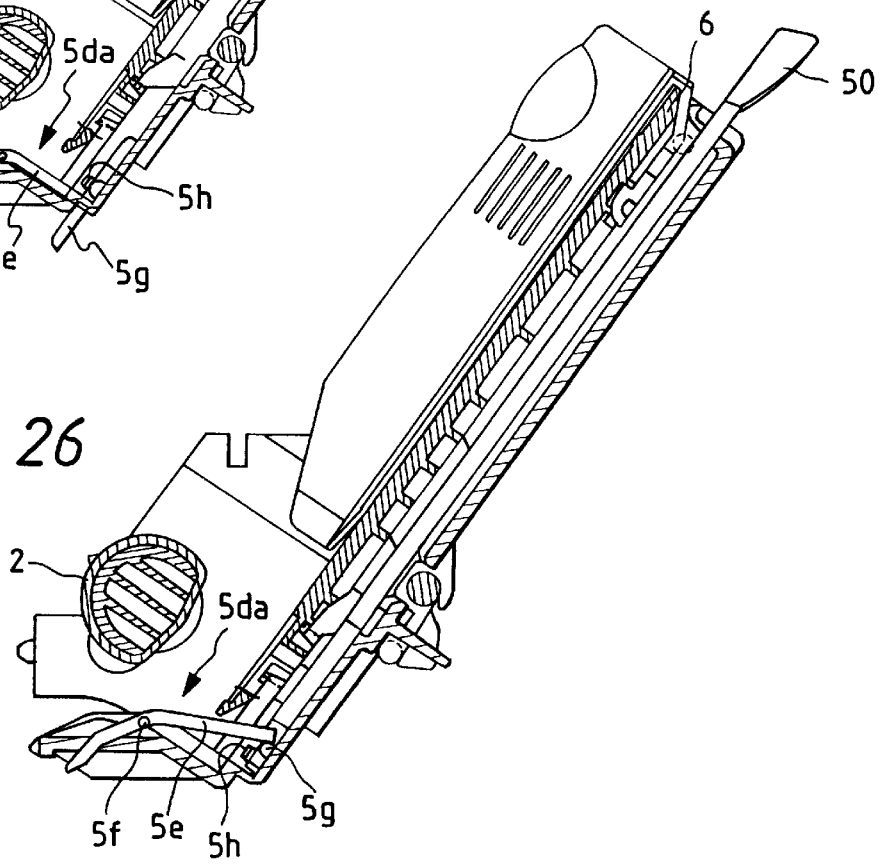
FIG. 26 is a side sectional view of the sheet supply portion of FIG. 25.
Figure 25:
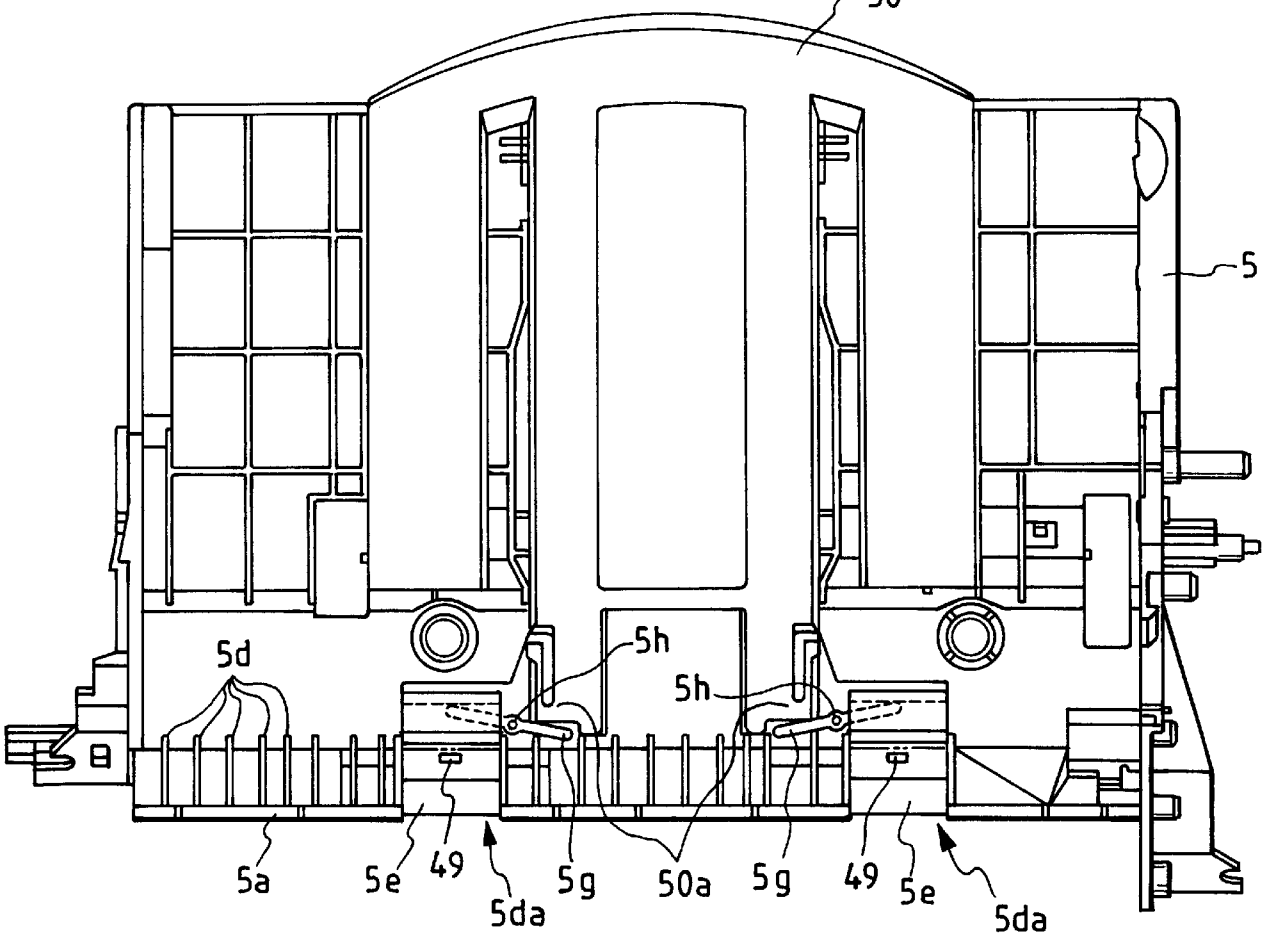
FIG. 25 is a plain view of the sheet supply portion according to the second embodiment, showing a condition that the sheet supporter is lowered.
Figure 27:
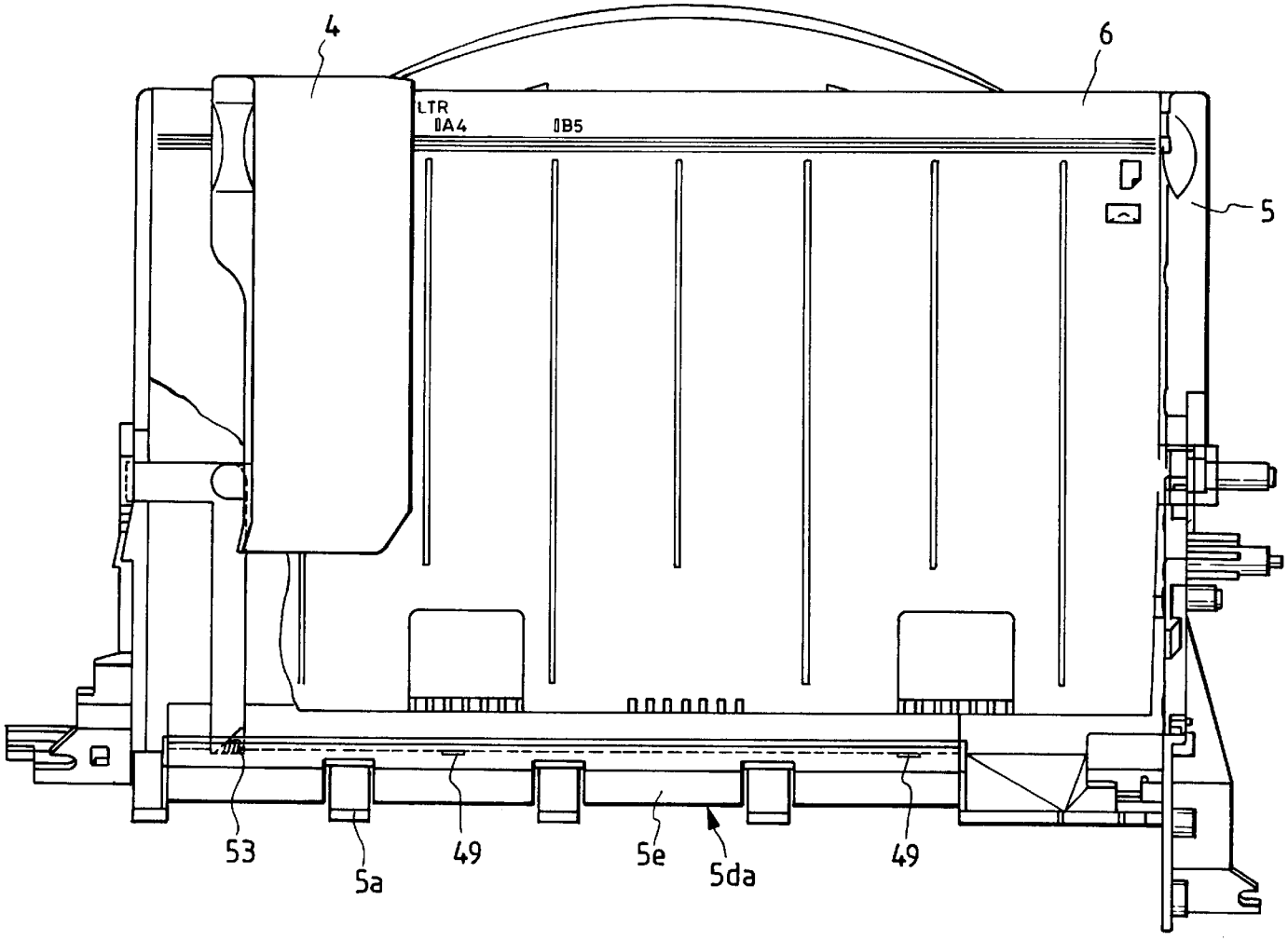
FIG. 27 is a plan view of a sheet supply portion of a sheet supplying apparatus according to a third embodiment, of the present invention.
Figure 28:
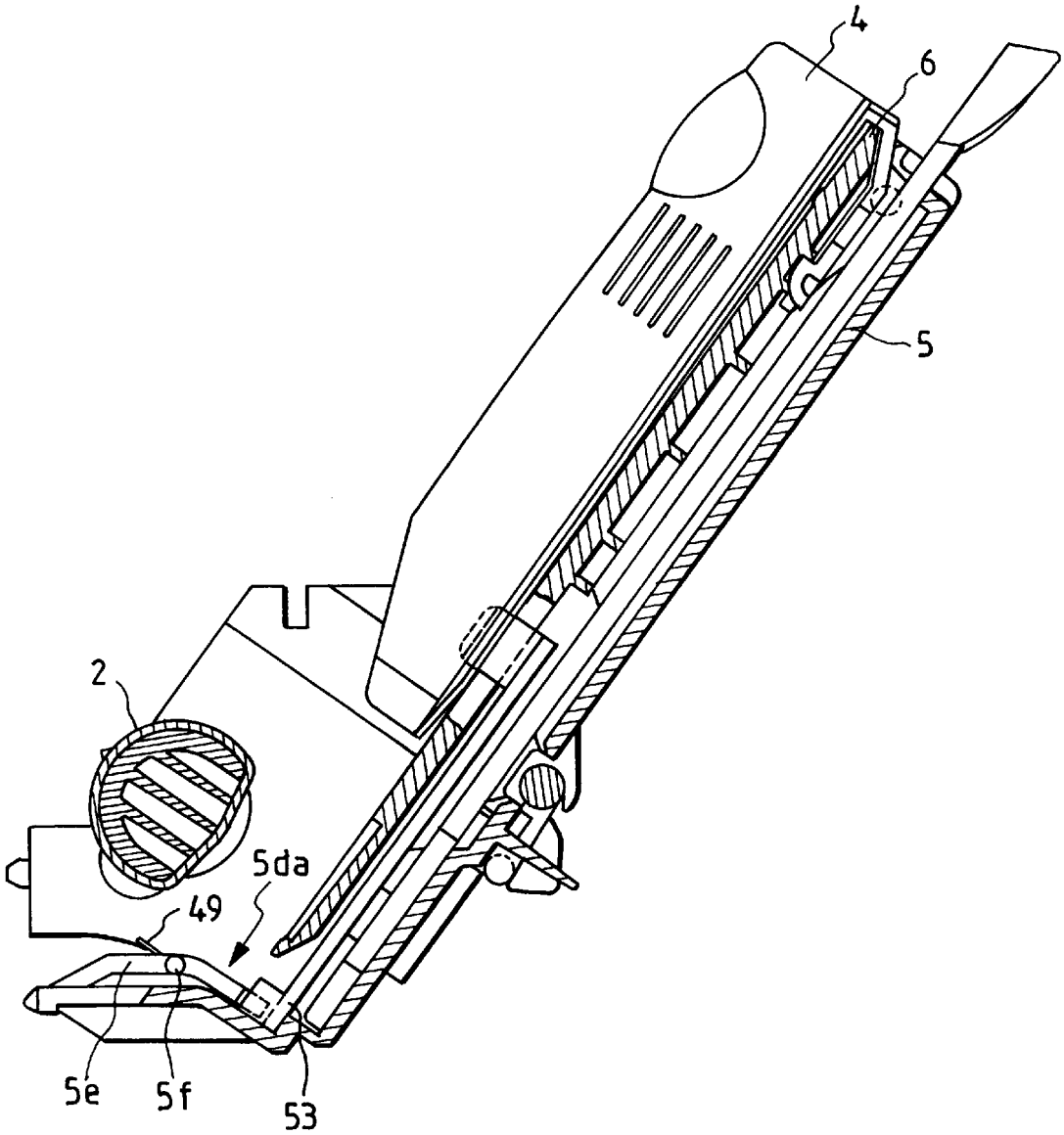
FIG. 28 is a side sectional view of the sheet supply portion according to the third embodiment.
Figure 29:
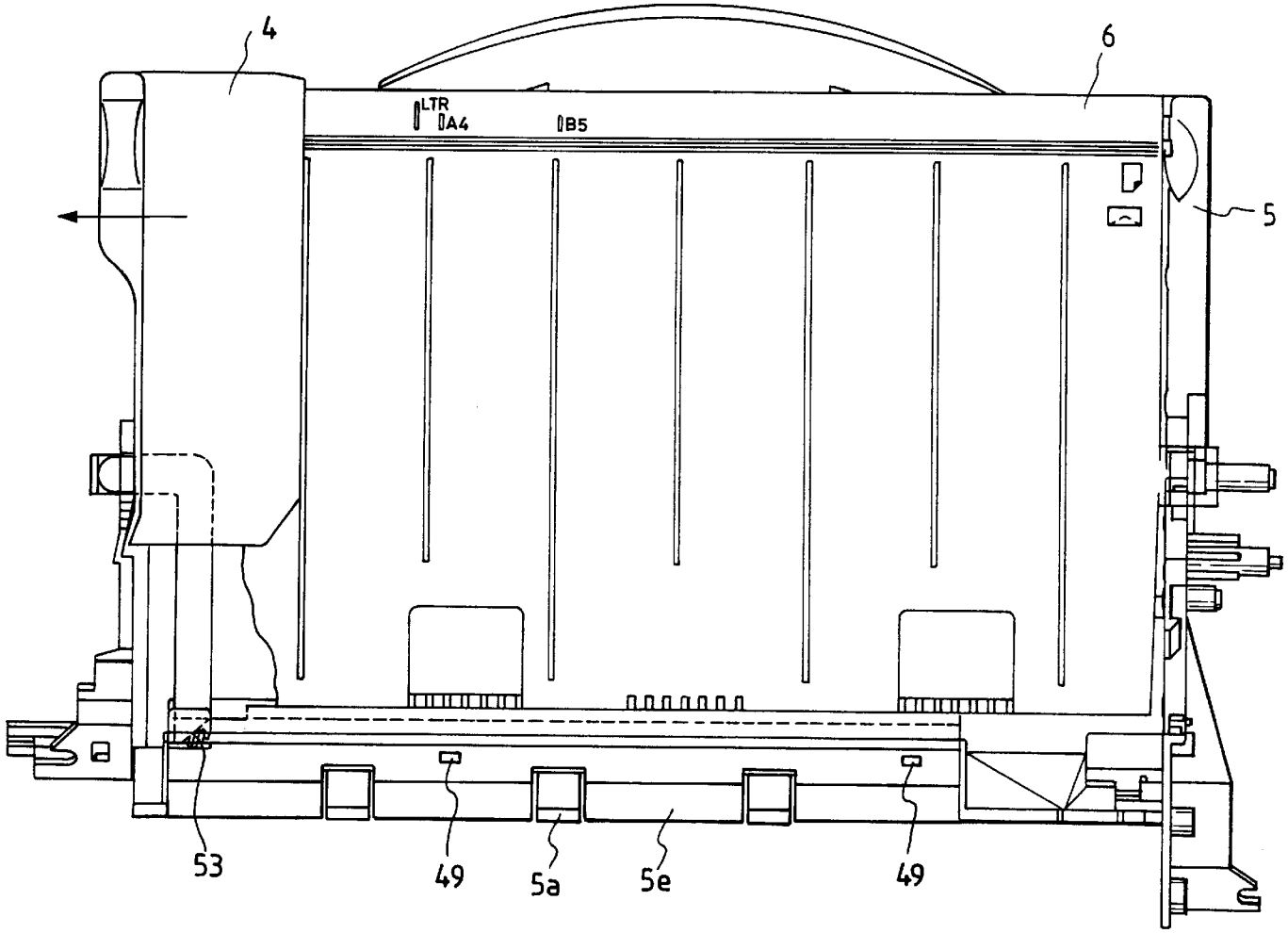
FIG. 29 is a plan view of the sheet supply portion according to the third embodiment, showing a condition that a movable side guide is shifted out of an operative area.
Figure 30:
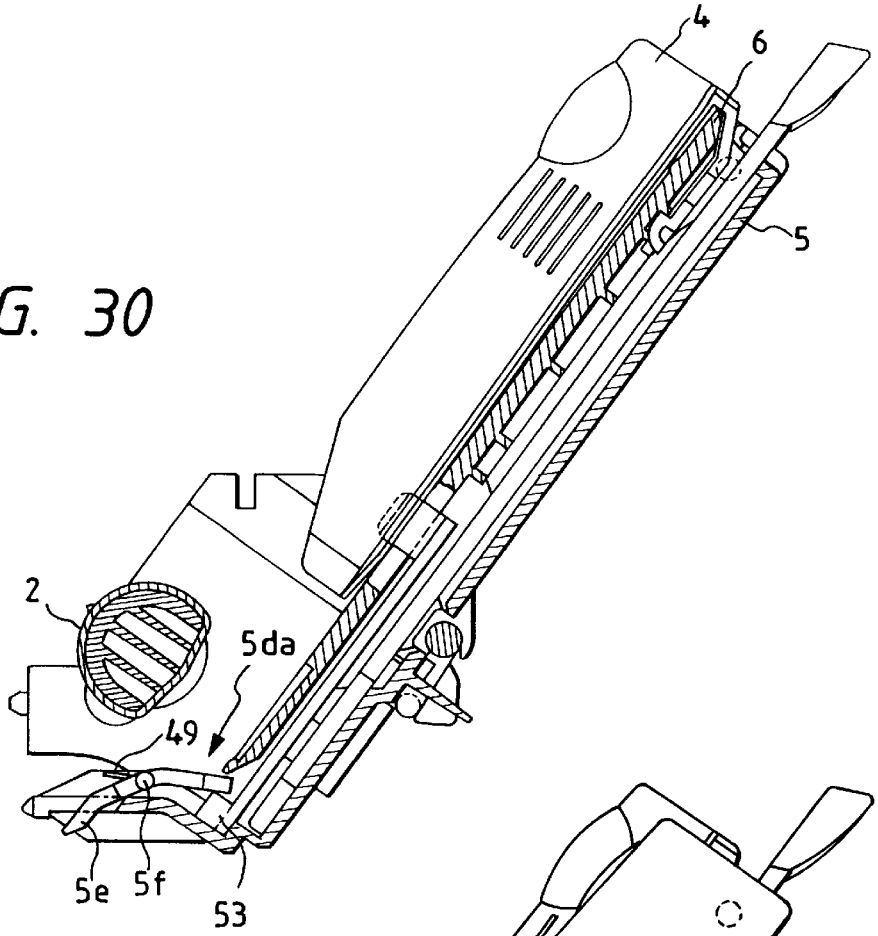
FIG. 30 is a side sectional view of the sheet supply portion of FIG. 29.

As shown in FIGS. 23 and 24, when the sheet supporter (sheet back surface support member) 50 is extended from the base 5, a sheet tip end abutment portion 5*da* and sheet tip end abutment portions 49 attached thereto are so designed that a rotation portion 5*e* supported for pivotal movement around a rotation shaft 5*f* provided on the sheet tip end abutment portion 5*da* is set to the angle permitting the automatic sheet supply by its own weight. Further, as shown in FIGS. 25 and 26, when the sheet supporter 50 is retracted within the base 5, a lower end 50*a* of the sheet supporter 50 pushes a lever 5*g* downwardly, with the result that the lever 5*g* is rotated around a rotation shaft 5*h* to rock the rotation portion 5*e,* thereby setting the angle permitting the manual sheet insertion. The other constructions are the same as those in the first embodiment and the same technical advantages can be achieved.

Third Embodiment

Next, a sheet supplying apparatus according to a third embodiment of the present invention will be explained with reference to FIGS. 27 to 30. In this embodiment, by shifting the movable side guide (side regulating member) 4 out of an operative area, the sheet tip end abutment portions 5*d*, 49 are set to the angle permitting the automatic sheet supply and the angle permitting the manual sheet insertion. Incidentally, the same elements as those in the first and second embodiments are designated by the same reference numerals and explanation thereof will be omitted.

First of all, a cam member 53 slidably supported by a guide member (not shown) provided on the base 5 is slid to push a rear portion of the rotation portion 5*e* pivotally supported on the rotation shaft 5*f* of the sheet tip end abutment portion 5*d* upwardly, thereby changing the angle to set the angle permitting the manual sheet insertion. When the movable side guide 4 is returned within the operative area, the cam member 53 is also returned to the right by a spring (not shown), with the result that the rotation portion 5*e* is returned to the angle permitting the automatic sheet supply by its own weight. The other constructions are the same as those in the first embodiment and the same technical advantages can be achieved.

Fourth Embodiment

Figure 31:
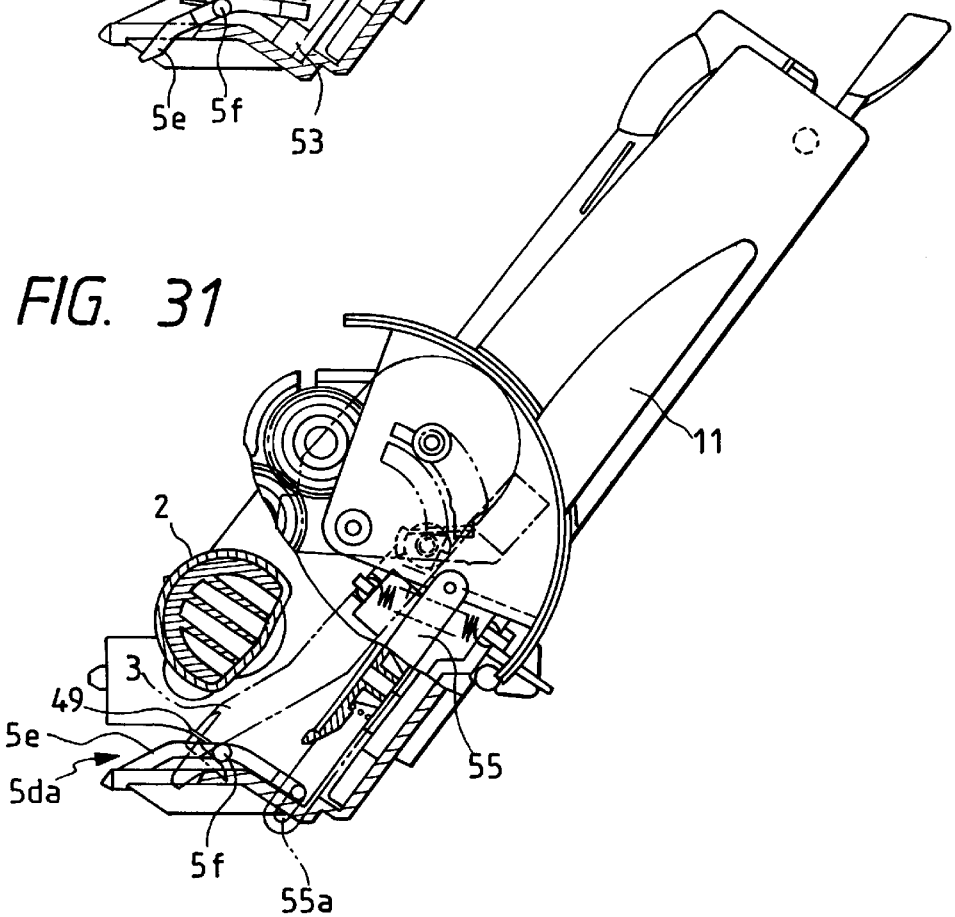
FIG. 31 is a side sectional view of a sheet supply portion of a sheet supplying apparatus according to a fourth embodiment of the present invention.

Next, a sheet supplying apparatus according to a fourth embodiment of the present invention will be explained with reference to FIGS. 31 and 32. In this embodiment, by switching the separation pawl release lever 11, the sheet tip end abutment portions 5*d*, 49 are set to the angle permitting the automatic sheet supply and the angle permitting the manual sheet insertion. Incidentally, the same elements as those in the first and second embodiments are designated by the same reference numerals and explanation thereof will be omitted.

A rear shaft portion of the rotation portion 5*e* pivotally supported on the rotation shaft 5*f* is rotatably and slidably received in an elongated slot 55*a* of a connection member 55 pivotally supported by the separation pawl release lever 11. In the automatic sheet supply, when the separation pawl release lever 11 is inclined toward a rear side of the apparatus, the elongated slot 55*a* of the connection member 55 and the rear shaft portion of the rotation portion 5*e* are positioned not to interfere with each other, with the result that the rotation portion 5*e* is set to the angle permitting the automatic sheet supply by its own weight.

Figure 32:
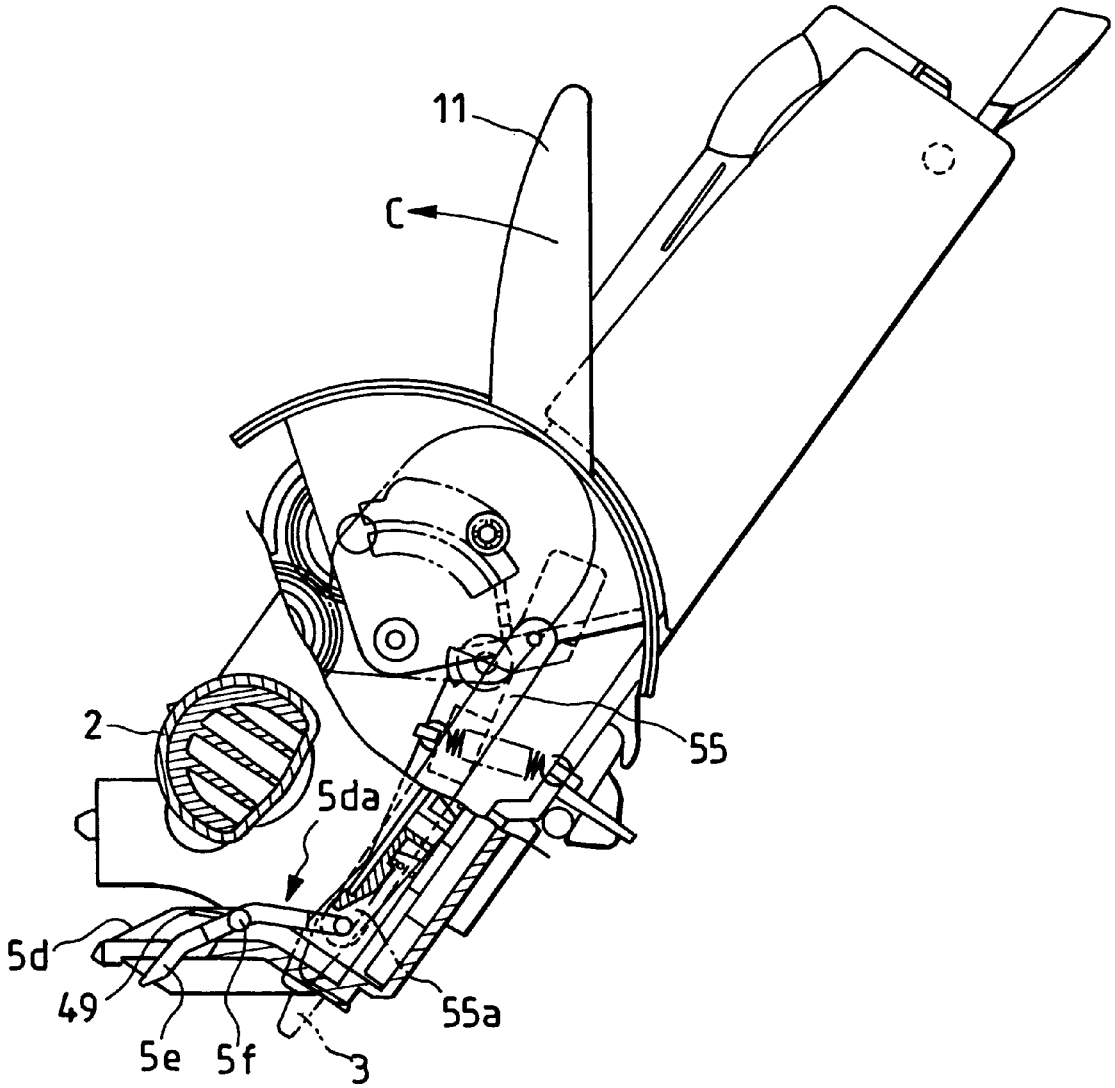
FIG. 32 is a side sectional view of the sheet supply portion according to the fourth embodiment, showing a condition that a separation pawl release lever is pulled.

When the separation pawl release lever 11 is rocked in a direction shown by the arrow C in FIG. 32 to be inclined toward a front side of the apparatus, the connection member 55 is lifted to lift the rear shaft portion of the rotation portion 5*e* through the elongated slot 55*a*, thereby setting the angle permitting the manual sheet insertion. The other constructions are the same as those in the first embodiment and the same technical advantages can be achieved.

Fifth Embodiment

Figure 33:
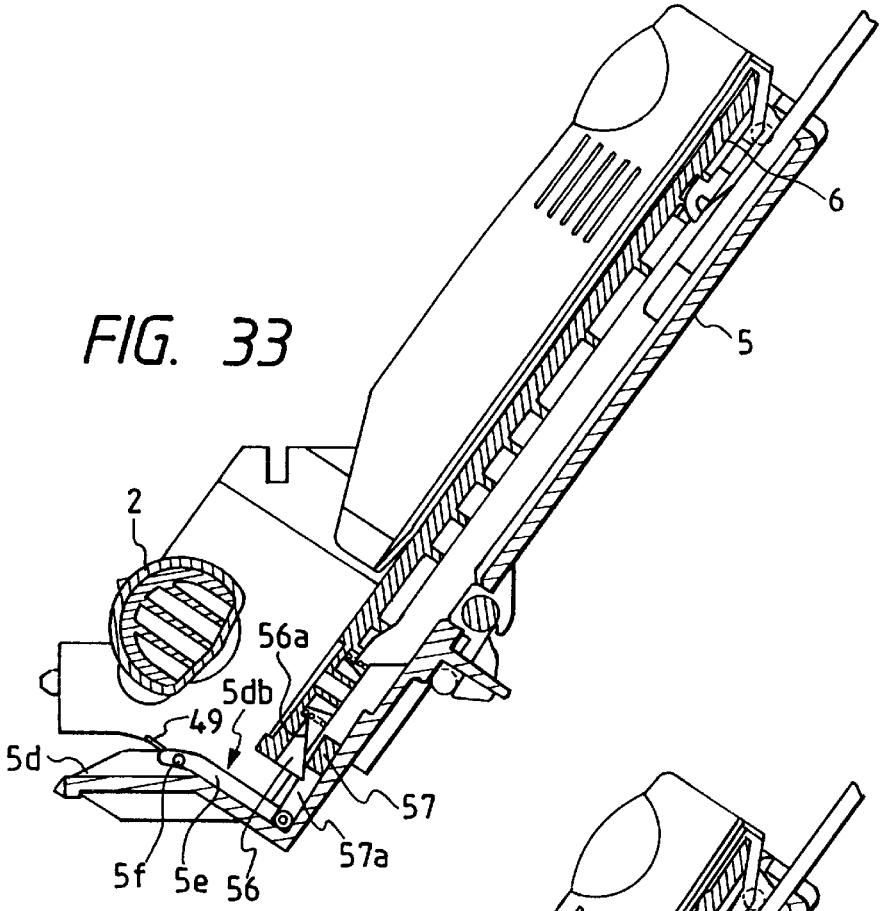
FIGS. 33 and 34 are side sectional views of a sheet supply portion of a sheet supplying apparatus according to a fifth embodiment of the present invention.
Figure 34:
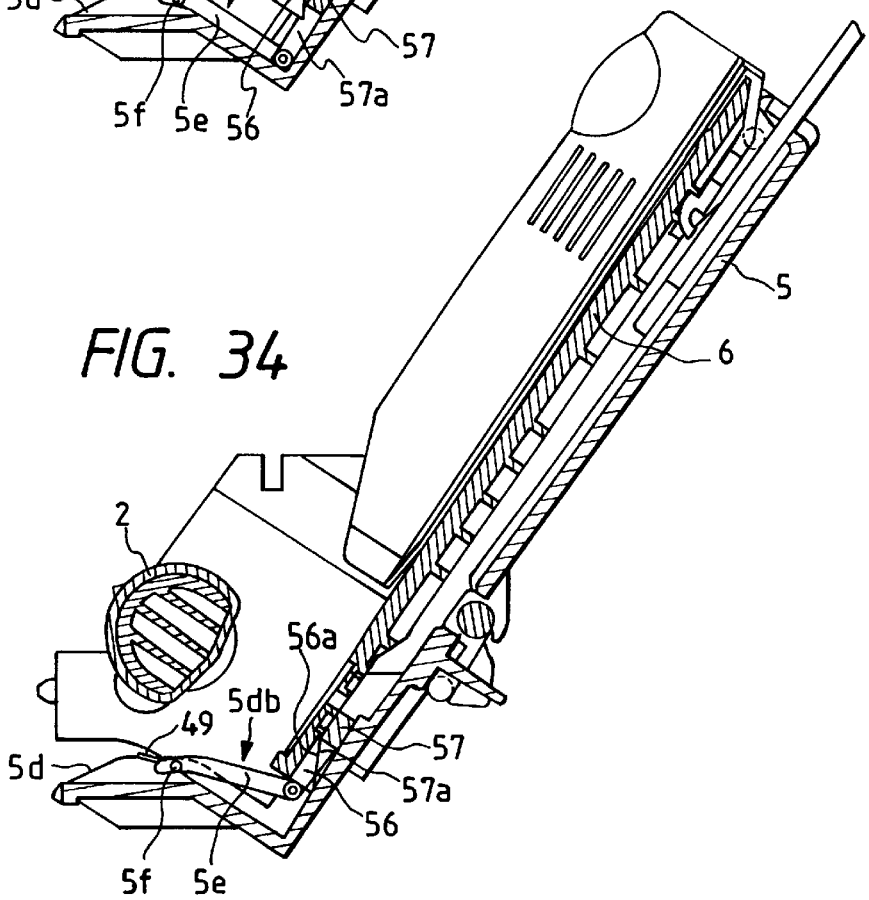

Next, a sheet supplying apparatus according to a fifth embodiment of the present invention will be explained with reference to FIGS. 33 and 34. In this embodiment, by pushing the pressure plate from its operative area toward the base 5, the sheet tip end abutment portions 5*d*, 49 are set to the angle permitting the automatic sheet supply and the angle permitting the manual sheet insertion. Incidentally, the same elements as those in the first and second embodiments are designated by the same reference numerals and explanation thereof will be omitted.

First of all, when the pressure plate 6 is located within its operative area, the rotation portion 5*e* is set to the angle permitting the automatic sheet supply by its own weight. On the other hand, when the pressure plate 6 is pushed from its operative area toward the base 5, a projection 56 provided on a lower end of the pressure plate 6 is entered into a hole 57*a* formed in a lever 57 pivotally supported on a rear shaft of the rotation portion 5*e*, with the result that the lever 57 is lifted by an inclined surface 56*a* of the projection 56 to rotate the rotation portion 5*e* around the rotation shaft 5*f,* thereby setting the angle permitting the manual sheet insertion. The other constructions are the same as those in the first embodiment and the same technical advantages can be achieved.

Sixth Embodiment

Figure 35:
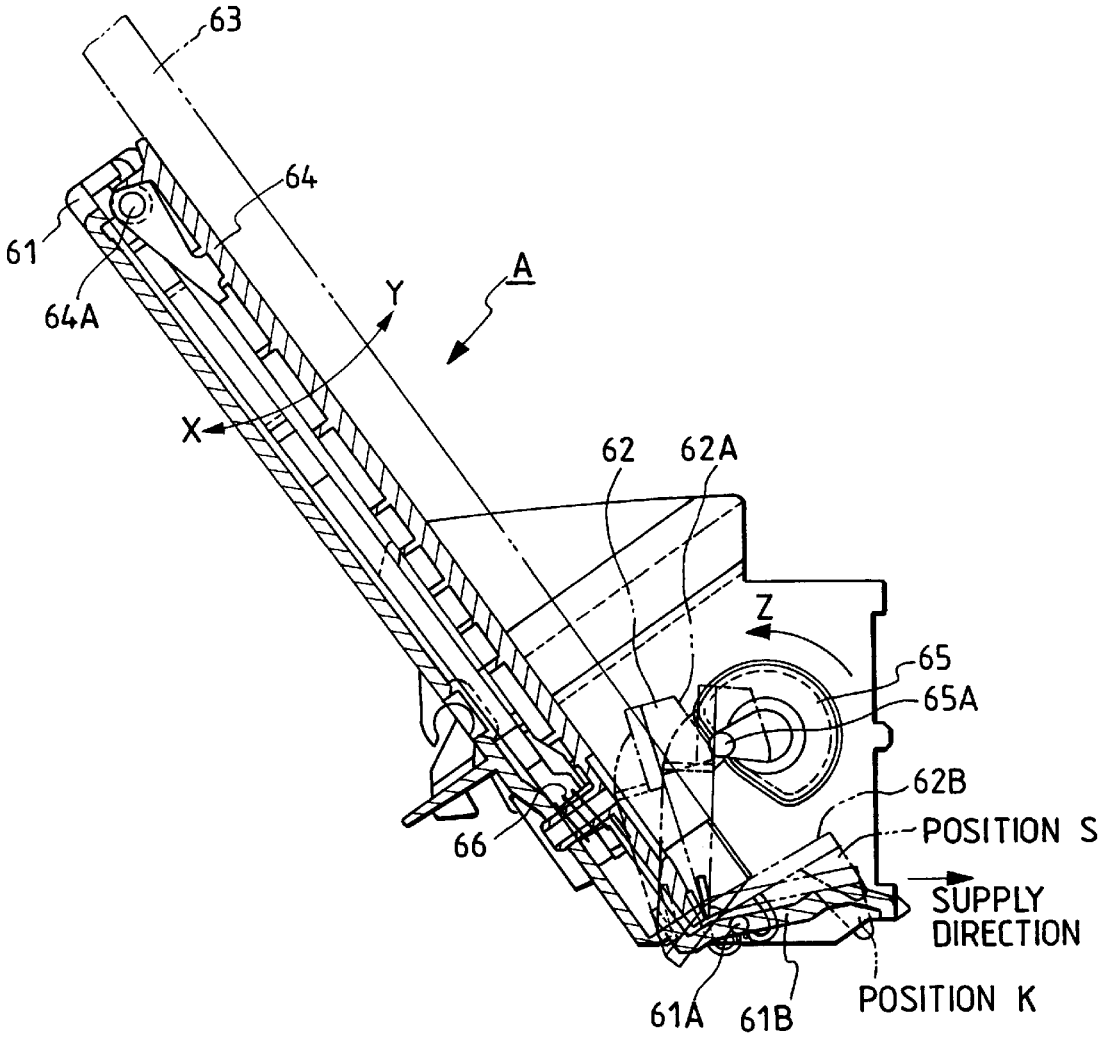
FIG. 35 is a side sectional view of an automatic sheet supplying apparatus according to a sixth embodiment of the present invention.

FIG. 35 is a side sectional view of an automatic sheet supplying apparatus according to a sixth embodiment of the present invention. In FIG. 35, the sheet supply apparatus has a base 61. A holding plate (operation means) 62 is pivotally supported by a holding plate rotation shaft 61A of the base 61. The holding plate 62 has a holding plate cam portion 62A and a separation bank portion 62B, and an inclination angle of the holding plate 62 is changed in accordance with a force acting on the holding plate cam portion 62A. The separation bank portion 62B of the holding plate 62 is formed to extend from the holding plate cam portion 62A uprightly so that a tip end of a sheet 63 is blocked at a position (regulating position) S and the supplying of the sheet 63 is permitted at a position (retard position) K.

The tip ends of the sheets 63 on which images are to be formed are aligned with each other by a regulating surface of the separation bank portion 62B and the sheets are stacked on a pressure plate (stacking means) 64. The pressure plate 64 is pivotally connected to the base 61 via a pressure plate shaft 64A and is biased toward a sheet supply roller (supply means) 65 (direction Y) by pressure plate springs 66 to urge the sheet stack 63 against the sheet supply roller 65. As a result, in the sheet supplying operation, a desired friction force is generated between the sheet supply roller 65 and the sheet 63, which friction force acts as a supplying force for the sheet 63. Incidentally, the pressure plate 64 can be reciprocally rocked around the shaft 64A in directions X, Y under the action of a cam (not shown). Further, as mentioned above, the holding plate 62 is attached to the base 61 (i.e., stacking means side) to which the pressure plate 64 is attached.

The sheet supply roller 65 serves to send the sheet 63 to an image forming apparatus (not shown). A sheet supply roller cam lever (rotation regulating means) 65A for regulating the rotation of the holding plate 62 is secured to the sheet supply roller 65. The sheet supply roller cam lever 65A acts on (contacts with) the holding plate cam portion 62A of the holding plate 62 to change the inclination angle of the holding plate 62.

Figure 36:
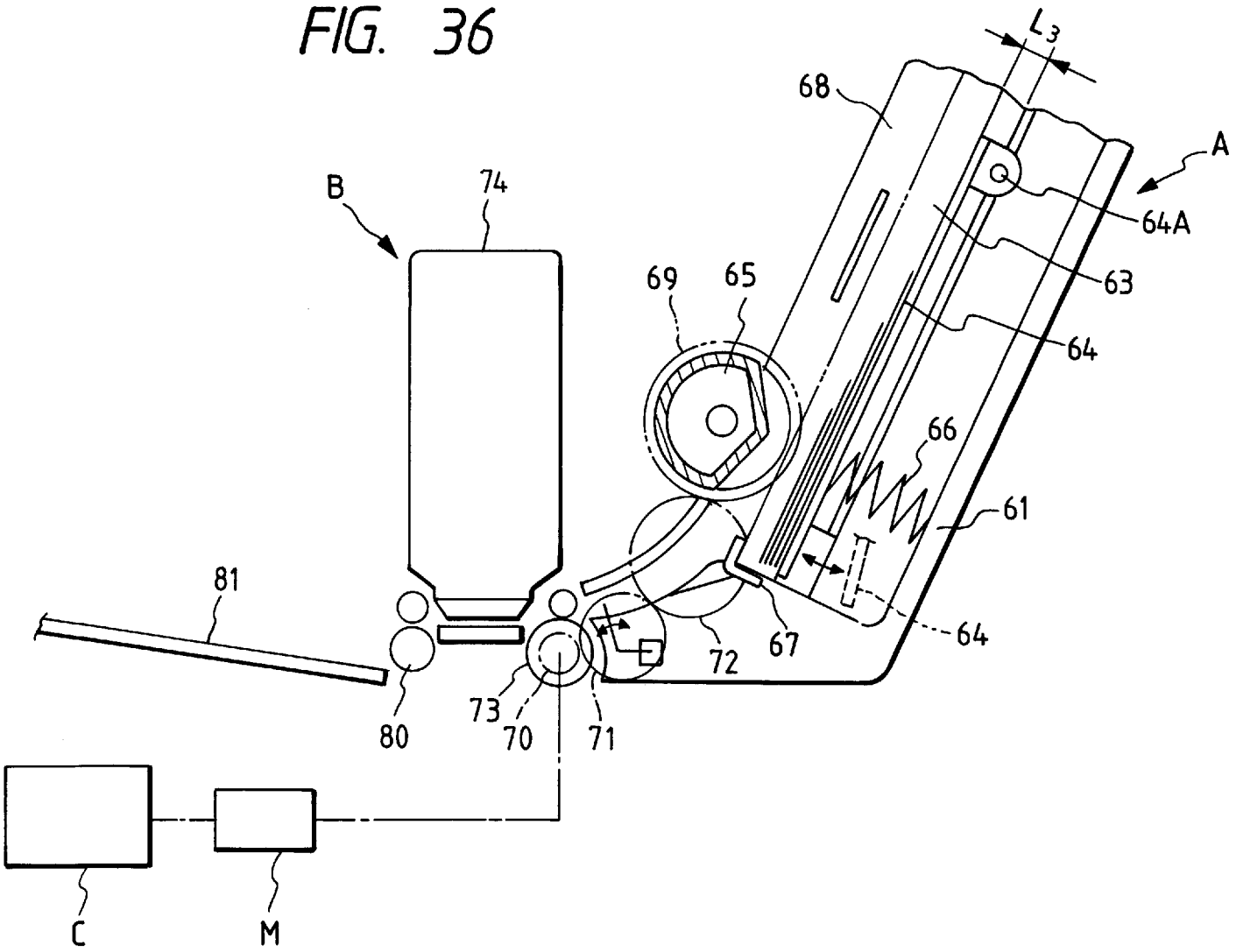
FIG. 36 is a schematic view of an image forming apparatus having the automatic sheet supplying apparatus of FIG. 35.

FIG. 36 schematically shows an image forming apparatus B having the automatic sheet supplying apparatus A according to the present invention.

In FIG. 36, a separation pawl 67 is attached to a base 61 and is engaged by a lateral edge of a sheet stack 63 so that the sheets 63 are separated one by one by the separation pawl in the sheet supplying operation. A movable side guide 68 for regulating the lateral edge of the sheet stack 63 is slidably mounted on the base 61.

A power of a drive motor M controlled by a control device C is transmitted from a drive gear 70 connected to the drive motor M to a drive gear 69 of a sheet supply roller 65 through gears 71, 72. A convey roller 73 is secured to a shaft of the gear 70 and the sheet supply roller 65 is secured to a shaft of the gear 69. Accordingly, the sheet supply roller 65 is secured to a shaft of the gear 69. Accordingly, the sheet supply roller 65 and the convey roller 73 are rotated by the drive motor M. Incidentally, the sheet 63 fed out by the sheet supply roller 65 is conveyed to a recording head (recording portion) 74 of the image forming apparatus B by the convey roller 73. A desired image formed on the sheet by the recording head 74. Then, the sheet 63 on which the image was formed by the recording head 74 is discharged onto a discharge tray 81 by a roller 80.

Next, an operation of the automatic sheet supplying apparatus A will be explained.

First of all, by rotating the drive motor M, the convey roller 73 is rotated. As a result, the drive gear 70 attached to the convey roller 73 is also rotated. The rotation of the drive gear 70 is transmitted to the gears 71, 72, 69 successively, so that the driving force of the drive motor M is transmitted to the sheet supply roller 65. Consequently, the sheet supply roller 65 is rotated in a direction shown by the arrow Z in FIG. 35. In this case, the rotation regulation of the pressure plate 64 regulated by the cam (not shown) driven in synchronous with the sheet supply roller 65 is released, with the result that the pressure plate 64 is shifted in a direction shown by the arrow Y by the pressure plate springs 66. As a result, the sheet stack 63 is urged against the sheet supply roller 65.

Further, the supply roller cam lever 65A is separated from the holding plate cam portion 62A, with the result that the holding plate is rotated in a clockwise direction in FIG. 36 by its own weight to reach a sheet supply position (retard position) K. When the sheet supply roller 65 is further rotated, the sheets 63 are separated one by one by the separation pawl 67 shown in FIG. 36, and the separated sheet is supplied to the image forming apparatus B.

After the sheet supply roller 65 is rotated by one revolution, when the initial condition shown in FIG. 35 is restored, the holding plate cam portion 62A of the holding plate 62 is shifted (rotated in an anti-clockwise direction in FIG. 35) by the supply roller cam lever 65A, thereby restoring the holding plate 62 to a sheet set position (waiting position) S. In this case, an angle between the pressure plate 64 on which the sheets 63 are set and the separation bank portion 62B of the holding plate 62 becomes acute more than that in the sheet supply position K. Thus, since the tip ends of the sheets 63 are blocked by the separation bank portion 62B, it is hard to ride the sheets over the separation bank portion 62B (i.e., preventing the dropping of the sheets).

Incidentally, in the illustrated embodiment, in the sheet set position S the inclination angle of the separation bank portion 62B with respect to the pressure plate 64 is set to about 90 degrees, thereby preventing the sheets 63 from riding over the separation bank portion 62B.

Figure 41:
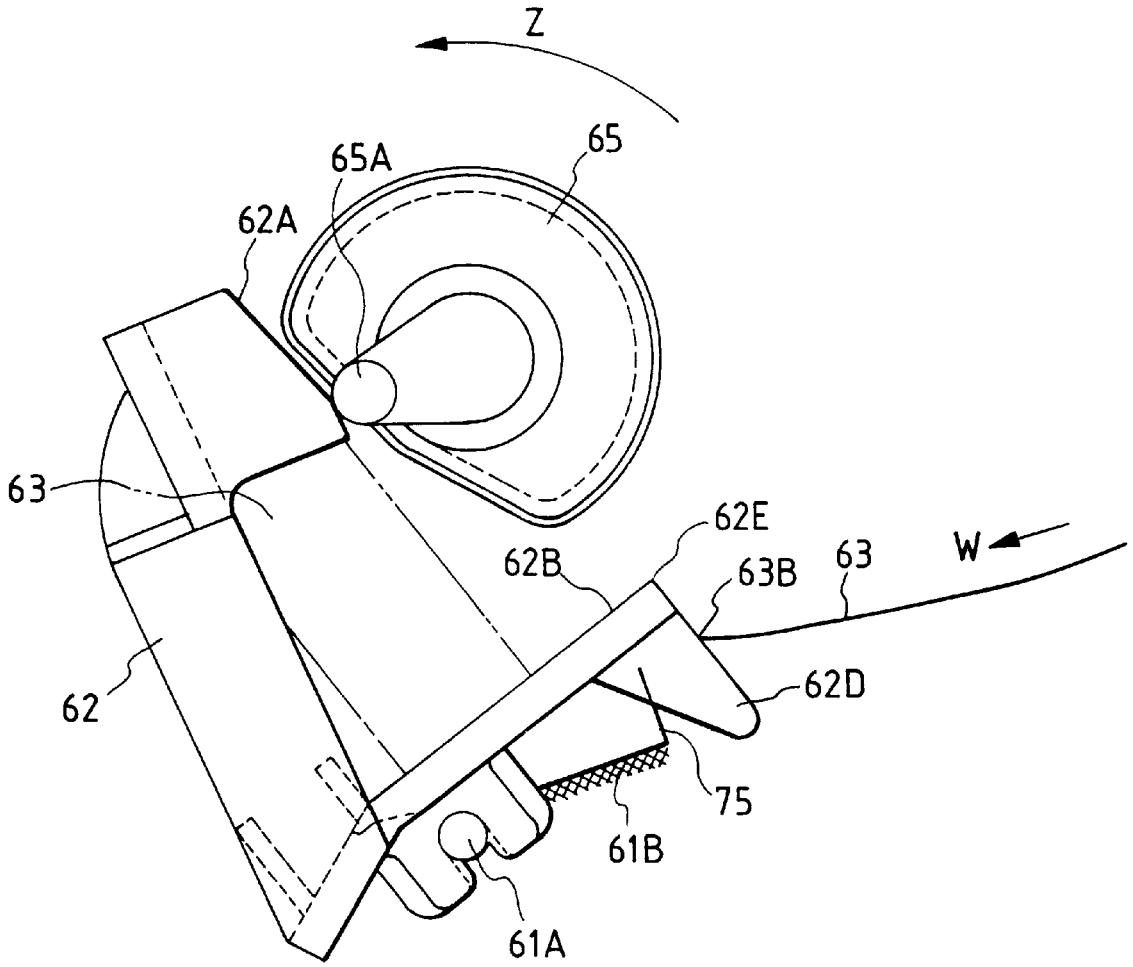
FIG. 41 is a view similar to FIG. 37, showing a fourth operating condition.
Figure 42:
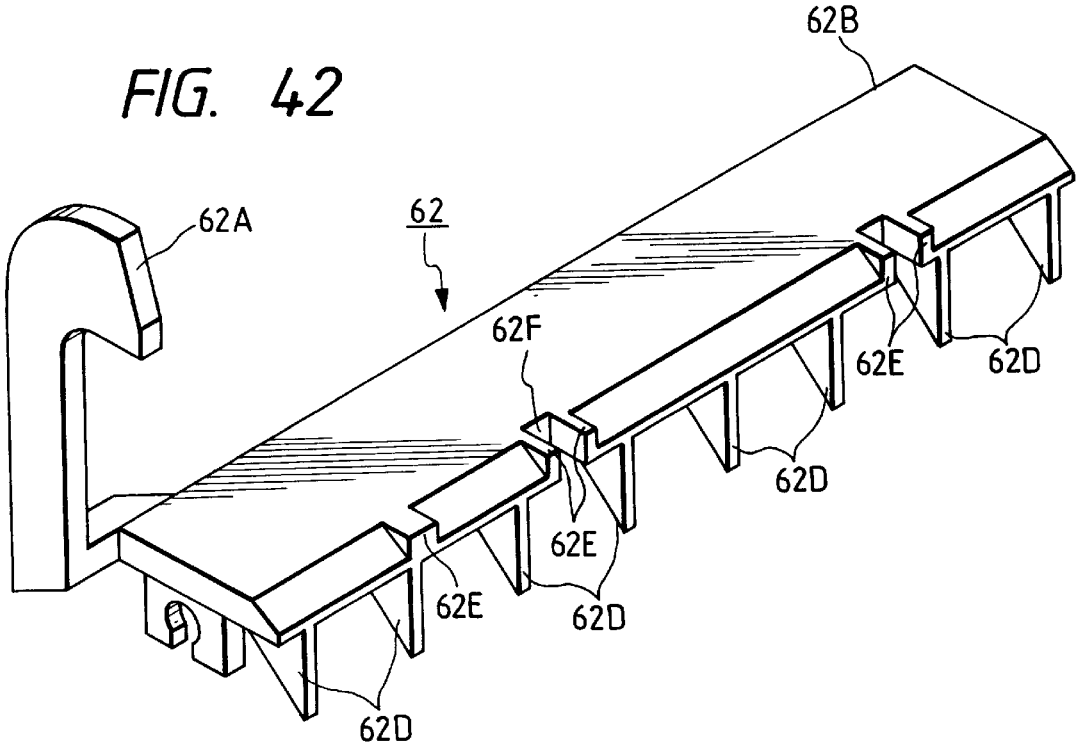
FIG. 42 is a perspective view of a guide means according to the sixth embodiment.

Now, further details will be explained with reference to FIGS. 37 to 41 showing a main portion of the present invention and FIG. 42 showing the details of the holding plate 62.

Figure 38:
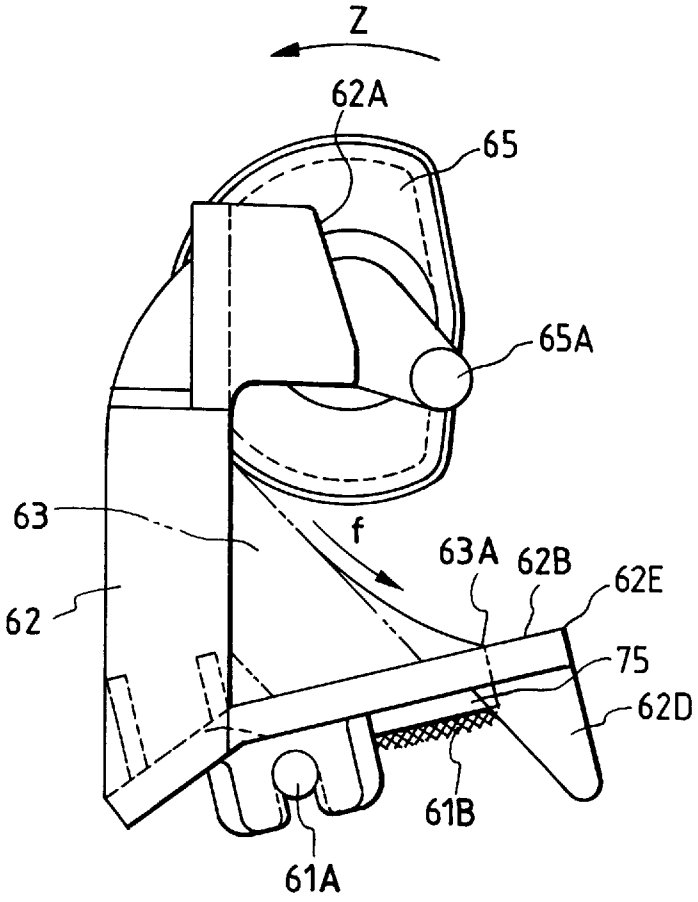
FIG. 38 is a view similar to FIG. 37, showing a first operating condition.
Figure 37:
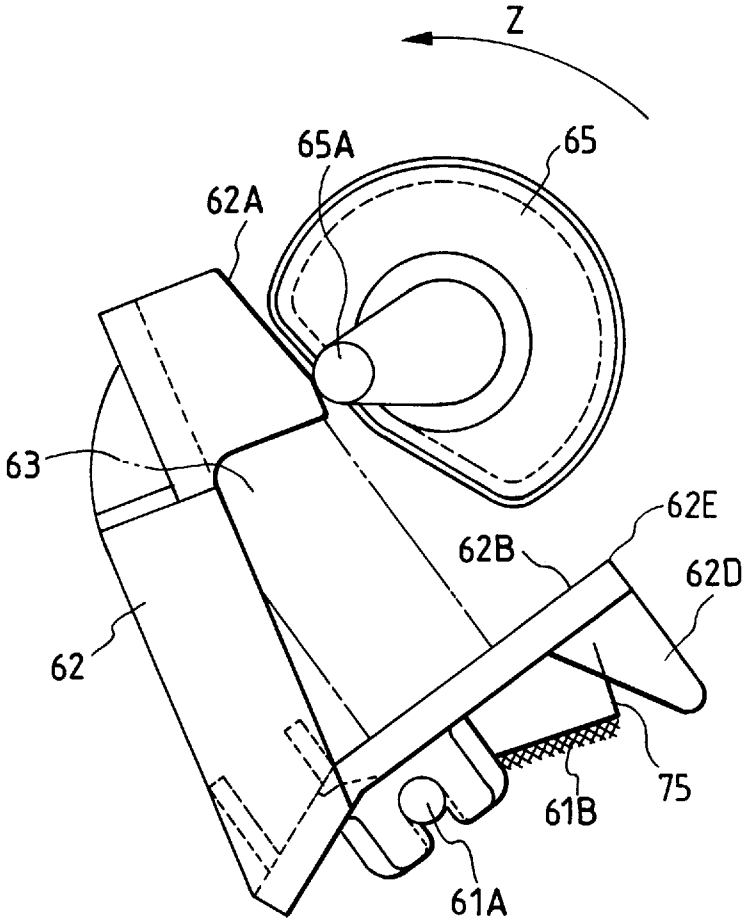
FIG. 37 is a side view of a main portion of the automatic sheet supplying apparatus according to the sixth embodiment.
Figure 40:
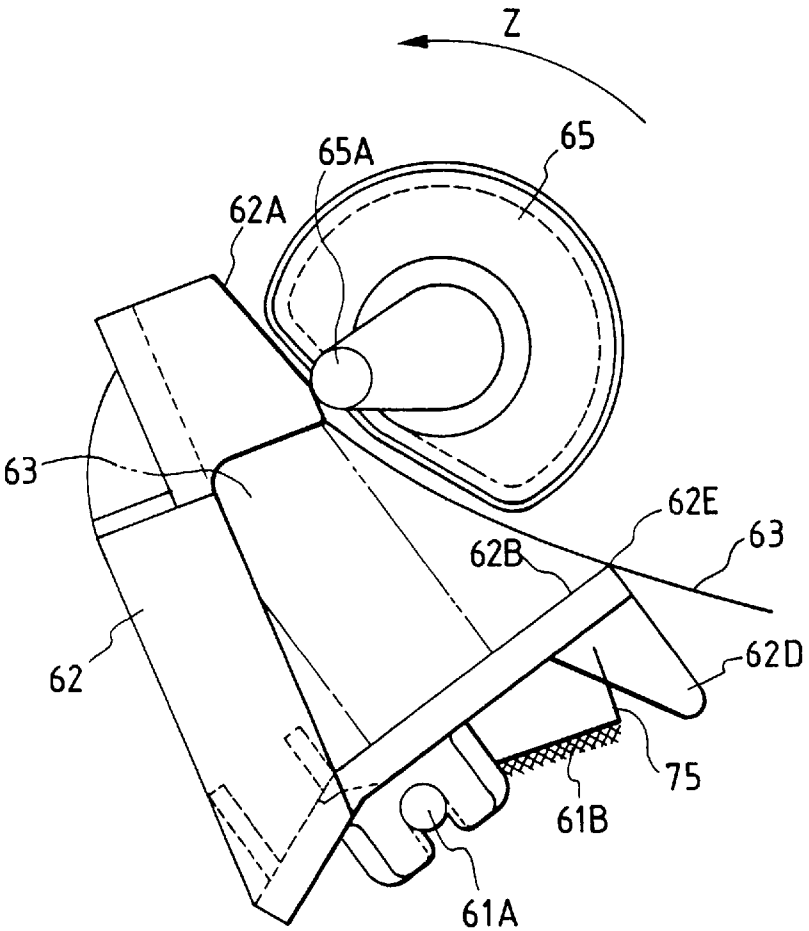
FIG. 40 is a view similar to FIG. 37, showing a third operating condition.
Figure 39:
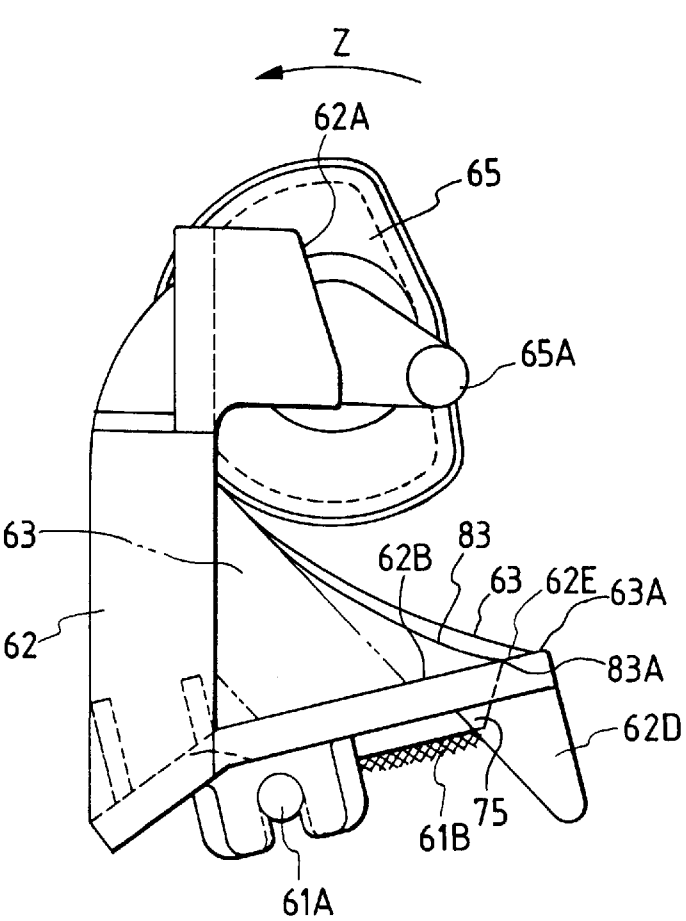
FIG. 39 is a view similar to FIG. 37, showing a second operating condition.

In FIG. 37, a sheet regulating member 75 is constituted by an elastic member formed from a resin film sheet (for example, PET film) or a metal plate and is attached to a sheet regulating member attachment portion 61B of the base 61 by adhesive. The sheet regulating member 75 serves to regulate a tip end 63A of the sheet 63 in the sheet supplying operation (FIG. 38). Incidentally, when the holding plate 62 is lifted (position S), the sheet regulating member 75 is retarded below the holding plate 62 (FIG. 37). On the other hand, when the holding plate is lowered (position K), the sheet regulating member 75 is positioned so that an end portion of the sheet regulating member is protruded upwardly from the holding plate 62 through a notch 62F (FIG. 42) formed in the holding plate.

With the arrangement as mentioned above, the sheet supply roller 65 is rotated in the direction Z to operate the holding plate 62 in the sequences shown in FIGS. 37 to 40, thereby supplying the sheet 63 toward the recording head 74. In the condition shown in FIG. 39, the sheet 63 is conveyed toward the recording head 24 by the convey roller 73 of the image forming apparatus B (refer to FIG. 36). In this case, the sheet 63 is slidably contacted with rib-shaped projections (conveying direction ribs) 62E of the holding plate 62. When the sheet 63 is slidably contacted with the projections 62E, if contact ranges (contact areas) between the sheet 63 and the projections 62E is great, sliding friction therebetween becomes great, thereby worsening the conveying ability for the sheet 63. To avoid this, as shown in FIG. 42, the free end of the holding plate 62 is cut obliquely to leave only the small projections 62E so that the sheet 63 is contacted with only these small projections 62E, thereby reducing the friction between the sheet 63 and the projections 62E. In this way, the sheet conveying ability can be prevented from being worsened. That is to say, in the illustrated embodiment, the sheet can be conveyed smoothly.

Next, a function of the sheet regulating member 75 will be explained.

When the holding plate 62 is in the position S, the sheet regulating member is in a retarded condition (FIGS. 35 and 37). When the sheet supply roller 65 is operated and the holding plate 62 is shifted to the position K, the sheet regulating member 75 is protruded from the holding plate 62 toward the sheet 63, thereby regulating a position of a tip end 63A of the sheet 63 (refer to FIGS. 35 and 38). In this case, a supplying force f of the sheet supply roller 65 acting on the sheet 63 is generally greater than an elastic force of the sheet regulating member 75. Thus, the tip end 63A of the sheet 63 pushes the sheet regulating member 75 downwardly while sliding on the separation bank portion 62B. In this way, the sheet is supplied.

When the sheet 63 is being supplied in this way, second, third and other sheets 83 are sometimes slid down on the separation bank portion 62B together with the preceding sheet 63. In this case, the supplying force of the sheet supply roller 65 does not act on the sheet 83 directly, and, thus, since a force (in the sheet supplying direction) acting on the sheet 83 is smaller than the resistance force (elastic force) of the sheet regulating member 75, the sheet 83 is blocked by the sheet regulating member 75, thereby preventing a tip end 83A of the sheet 83 is prevented from being slid down from the free end of the holding plate 62. If tip ends of several sheets 83 are slid down from the free end of the holding plate 62, in the next sheet supplying operation, such several sheets 83 are supplied at once to cause the double-feed of sheets. However, in the illustrated embodiment, such double-feed can be effectively prevented.

As mentioned above, the sheet regulating member 75 according to the illustrated embodiment serves to regulate the tip end 83A of the next sheet 83 and to prevent the double-feed of sheets.

Further, as shown in FIG. 42, a plurality of triangular ribs (anti-conveying direction ribs) 62D are provided on the free end of the holding plate 62. Accordingly, as shown in FIG. 41, if the sheet 63 is shifted in a direction (shown by the arrow W) opposite to the sheet supplying direction, a trail end 63B of the sheet 63 is blocked by the triangular ribs 62D so that the sheet 63 is prevented from entering below the holding plate 62. If there are no triangular ribs 62D, when the sheet 63 is shifted to the direction opposite to the sheet supplying direction, the trail end 63B of the sheet 63 will enter below the holding plate 62, thereby damaging or folding the trail end 63B of the sheet 63. However, in the illustrated embodiment, such inconvenience can be avoided. Further, in dependence upon the contacting condition between the sheet 63 and the holding plate 62, the sheet is subjected to a great load (resistance force), with the result that the correct returning amount of the sheet 63 cannot be ensured. However, in the illustrated embodiment, since the triangular ribs 62D are provided on the free end of the holding plate 62 and to permit the sliding movement of the trail end 63B of the sheet 63 along the ribs 62D, such inconvenience can be avoided.

As mentioned above, according to the illustrated embodiment, since the sheets 63 are stacked in such a manner that the sheet stack is rested substantially in perpendicular to the separation bank portion 62B of the holding plate 62, in the waiting condition, the sheets 63 can be prevented from dropping below the holding plate, thereby preventing the double-feed of sheets effectively. Further, in the illustrated embodiment, whenever the single sheet 63 is supplied, since the holding plate 62 is shifted (cocked) from the supply position K to the waiting position S, it is possible to re-arrange the sheet stack, thereby preventing the double-feed of sheets 63 effectively.

Seventh Embodiment

Figure 43:
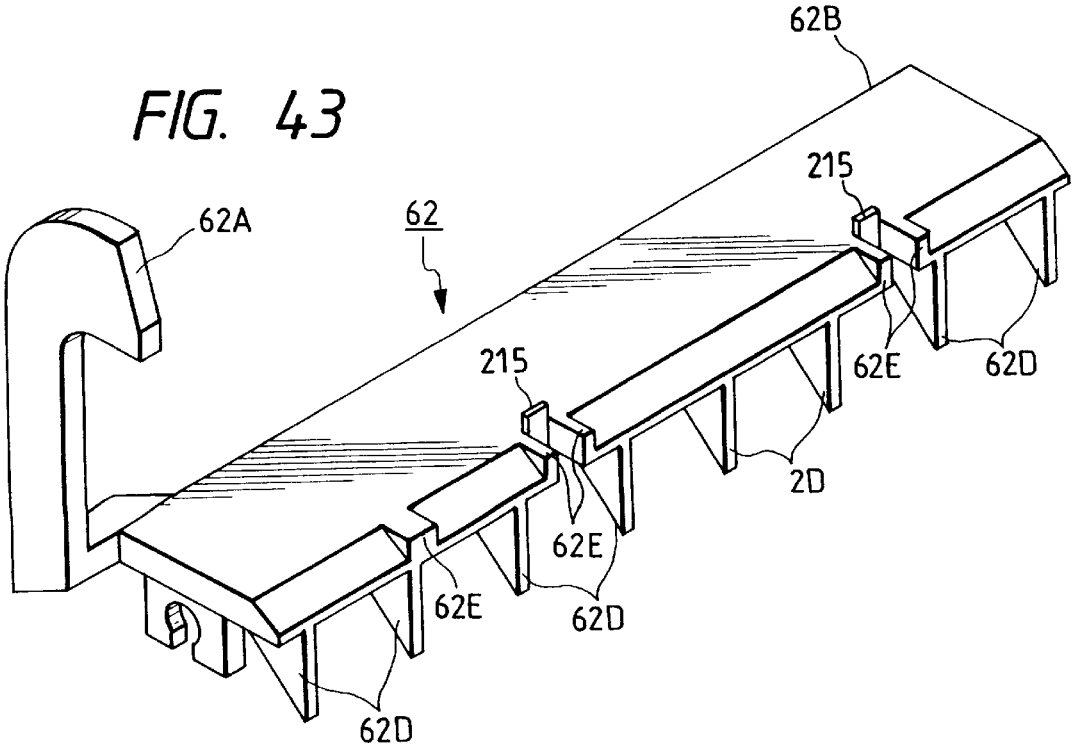
FIG. 43 is a perspective view of a guide means according to a seventh embodiment of the present invention.
Figure 44:
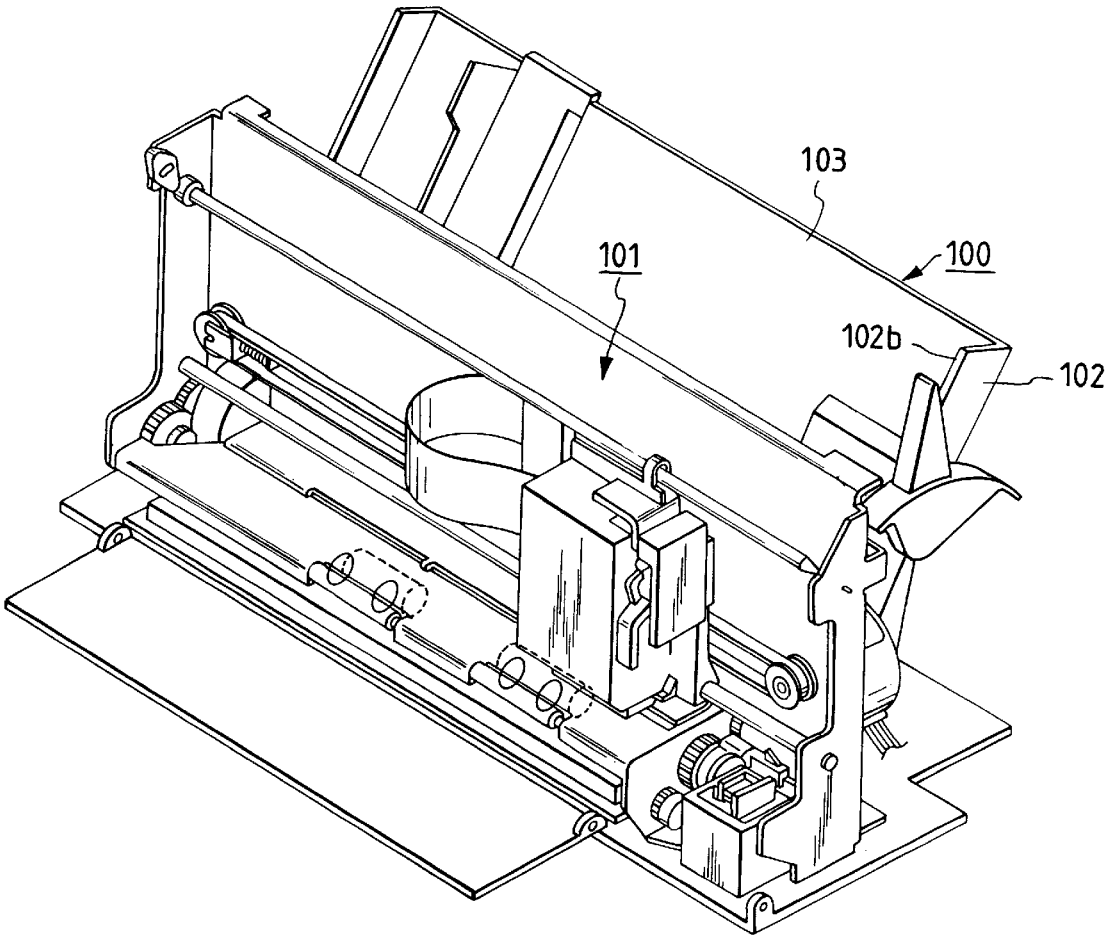
FIG. 44 PRIOR ART
FIG. 44 is a perspective view of a conventional recording apparatus.
Figure 45:
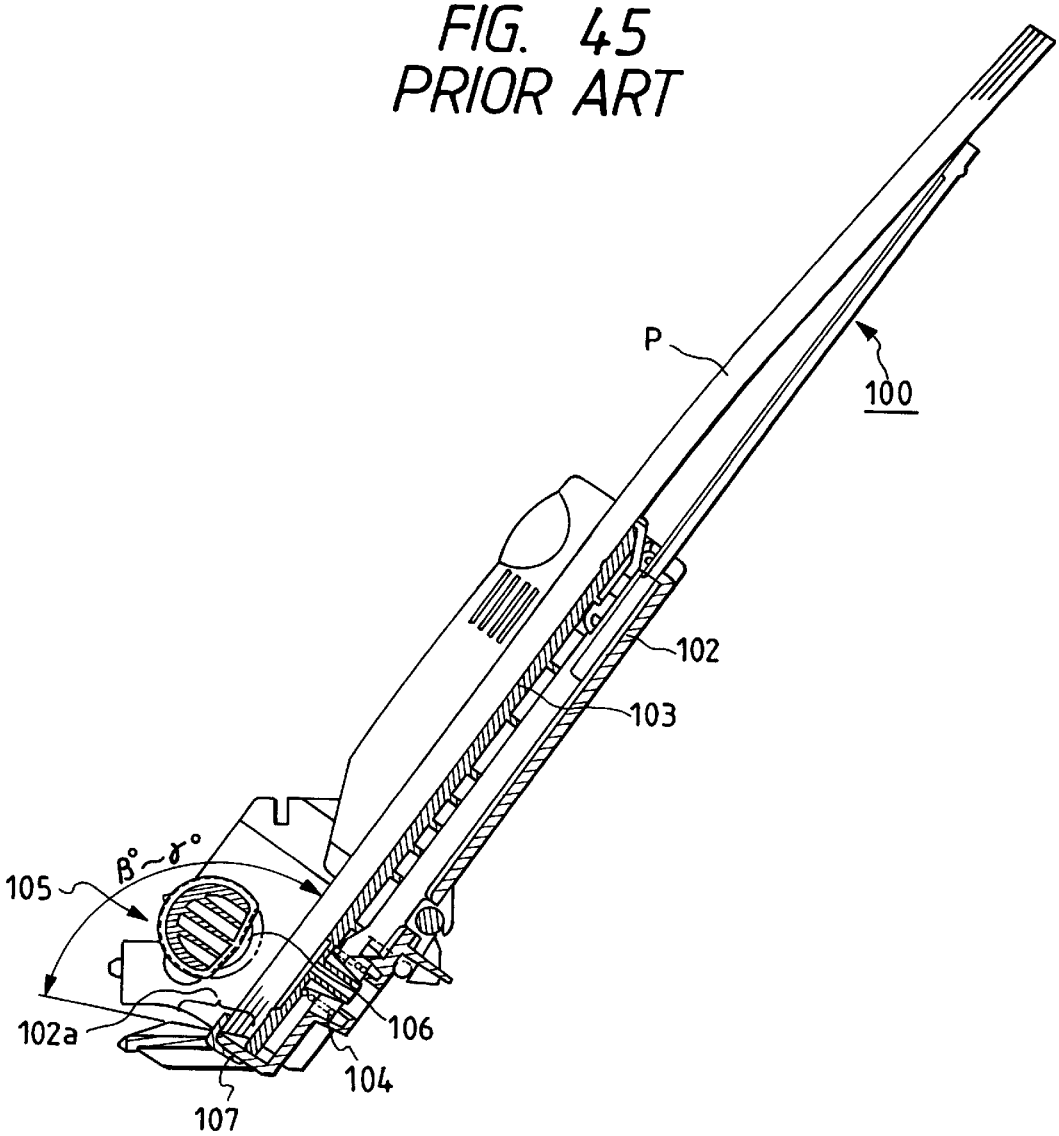
FIG. 45 PRIOR ART
FIG. 45 is a sectional view of the conventional recording apparatus.

Lastly, a seventh embodiment of the present invention will be explained with reference to FIG. 43. This embodiment differs from the above-mentioned sixth embodiment in the point that sheet regulating members 215 are provided on the holding plate 62. The sheet regulating members 215 are formed from elastic material as is in the sixth embodiment and are secured in recesses between the projections 62E by a double-sided or both-face adhesive tape or adhesive. In FIG. 43, the same elements as those in the sixth embodiment are designated by the same reference numeral and explanation thereof will be omitted.

With the arrangement as mentioned above, since the sheet regulating members 215 are provided on the free end of the holding plate 62, the sheet regulating members 215 are operated more positively than the sheet regulating member of the sixth embodiment, thereby preventing the sheets from being dropped more effectively. Further, since the holding plate 62 is provided with the sheet regulating members 215, assembling accuracy and accuracy of parts can easily be controlled in the production line.

Incidentally, in the above-mentioned embodiments, while an example that the sheet regulating member(s) are formed from elastic member such as resin film or metal plate was explained, the present invention is not limited to such an example, but, the sheet regulating member may be made of any material so that, when the sheet is supplied by the sheet supply roller, the sheet regulating member is flexed by the sheet not to afford great resistance to the sheet. For example, the sheet regulating member may be formed from a plate member pivotally supported and biased toward a spring toward the direction opposite to the sheet supplying direction. In this case, when the sheet is supplied, the sheet rocks the plate member in opposition to the spring, thereby supplying the sheet in a predetermined direction. Also in this case, the same advantage as the above-mentioned resin sheet regulating members can be obtained.

What is claimed is:

1. A sheet supplying apparatus comprising:

sheet supporting means for supporting sheets;

first abutment means and second abutment means both of which are disposed along a tip end of the sheets supported by said supporting means for regulating the tip end of the sheets, said first abutment means having a first sheet abutment surface and said second abutment means having a second sheet abutment surface, wherein an angle between a surface of the sheets supported by said sheet supporting means and the second sheet abutment surface is smaller than an angle between the surface of the sheets supported by said sheet supporting means and the first sheet abutment surface, and wherein said second sheet abutment surface is displaceable between a sheet regulating position and a sheet non-regulating position;

sheet supply means having a semi-circular roller for feeding out the sheets supported by said sheet supporting means and regulated by said first abutment means used by said second abutment means positioned in the regulating position, wherein said second abutment means is displaced to the sheet non-regulating position when said sheet supply means feeds out the sheets;

separation means disposed downstream of said sheet supply means for separating the sheets fed out by said sheet supply means;

convey means disposed downstream of said separation means for conveying the sheets separated by said separation means; and guide means for guiding the separated sheets to said convey means;

wherein, when conveying each separated sheet by said convey means, the separated sheet, guided by said guide means, is facing the cut portion of the semi-circular roller and remote from said second abutment means returned from the sheet non-regulating position to the sheet regulating position.

2. A sheet supplying apparatus according to claim 1, wherein said second abutment means is constituted by a deformable thin plate to be elastically deformed by the tip end of the sheets.

3. A sheet supplying apparatus according to claim 1, wherein said second abutment means is resiliently supported to be elastically deformed by the tip end of the sheet.

4. A sheet supplying apparatus according to claim 1, wherein said first abutment means is constituted by a plurality of ribs extending in parallel with a sheet supplying direction, and said second abutment means is disposed between said ribs.

5. A sheet supplying apparatus according to claim 4, wherein said second abutment means can be retracted between said ribs of said first abutment means.

6. A sheet supplying apparatus according to claim 1, wherein said second abutment means is disposed downstream of an upstream end of the sheet abutment surface of said first abutment means in a sheet supplying direction.

7. A sheet supplying apparatus according to claim 1, wherein said separation means is disposed at a front corner of the sheets supported by said supporting means and comprises a separation pawl having a tip end regulating surface for regulating the tip end of the sheets and an upper surface regulating surface for regulating an upper surface of the sheets.

8. A sheet supplying apparatus according to claim 7, wherein said separation pawl is disposed only at a front corner of the sheet suppported by said sheet supporting means.

9. A sheet supplying apparatus according to claim 7 or 8, wherein said second abutment means is disposed at the same position of the tip end regulating surface of said separation pawl or upstream of said tip end regulating surface.

10. A sheet supplying apparatus according to claim 7, wherein said separation pawl is shiftable from a separation position to regulate the sheets to a waiting position not to regulate the sheets, and further comprising switching means for switching between said separation position and said waiting position.

11. A sheet supplying apparatus according to claim 1, further comprising:

shifting means for shifting said sheet supporting means between a supplying position to cause the sheets supported by said sheet supporting means to contact said sheet supply means, and a waiting position to cause the sheets supported by said sheet supporting means to be out of contact with said sheet supply means, wherein after the sheet is separated by said separation means, said shifting means shifts said sheet supporting means from the supplying position to the waiting position.

12. A sheet supplying apparatus according to claim 11, wherein said second abutment means is constituted by a deformable thin plate to be elastically deformed by the tip end of the sheets fed by said sheet supply means.

13. A sheet supplying apparatus according to claim 11, wherein said sheet supporting means has a sheet supporting member and a biasing means for biasing said sheet supporting member toward the supply position, and said shifting means has a rotatable cam for shifting said sheet supporting member from the supply position to the waiting position against a biasing force by said biasing means.

14. An image forming apparatus comprising:

sheet supporting means for supporting sheets;

first abutment means and second abutment means both of which are disposed along a tip end of the sheets supported by said supporting means for regulating the tip end of the sheets, said first abutment means having a first sheet abutment surface and said second abutment means having a second sheet abutment surface, wherein an angle between a surface of the sheet supported by said sheet supporting means and the second sheet abutment surface is smaller than an angle between the surface of the sheet supported by said sheet supporting means and the first sheet abutment surface, and wherein said second sheet abutment surface is displaceable between a sheet regulating position and a sheet non-regulating position;

sheet supply means having a semi-circular roller for feeding out the sheet supported by said sheet supporting means and regulated by said first and second abutment means positioned in the regulating position, wherein said second abutment means is displaced to the sheet non-regulating position when said sheet supply means feeds out the sheet;

separation means disposed downstream of said sheet supply means for separating the sheets fed out by said sheet supply means;

convey means disposed downstream of said separation means for conveying the sheet separated by said separation means;

guide means for guiding the separated sheet to said coney means; and an image forming means for forming an image on the sheet fed out by said sheet supply means;

wherein, when conveying the separated sheet by said convey means, the sheet, guided by said guide means, is facing the cut portion of the semi-circular roller and remote from said second abutment means returned from the sheet non-regulating position to the sheet regulating position.

15. A sheet supplying apparatus comprising:

sheet supporting means for supporting sheets;

first abutment means and second abutment means both of which are disposed along a tip end of the sheets supported by said supporting means for regulating the tip end of the sheets, said first abutment means having a first sheet abutment surface and said second abutment means having a second sheet abutment surface, wherein an angle between a surface of the sheets supported by said sheet supporting means and the second abutment surface is smaller than an angle between the surface of the sheets supported by said sheet supporting means and the first sheet abutment surface, and wherein said second abutment means is constituted by a elastically deformable member;

sheet supply means having a semi-circular roller for feeding out the sheets supported by said sheet supporting means and regulated by said first abutment means and by said second abutment means positioned in the regulating position, wherein said second abutment means is elastically deformed by the sheets fed out by said sheet supply means;

separation means disposed downstream of said sheet supply means for separating the sheets fed out by said sheet supply means;

convey means disposed downstream of said separation means for conveying the sheets separated by said separation means; and guide means for guiding the separated sheets to said convey means in a deflective state;

wherein, when conveying each separated sheet by said convey means, the separated sheet, guided by said guide means in a deflective state, is facing the cut portion of the semi-circular roller and remote from said second abutment means returned from a deformed condition.

16. A sheet supplying apparatus according to claim 15, wherein said elastically deformable member is a thin plate.

17. An image forming apparatus comprising:

sheet supporting means for supporting sheets;

first abutment means and second abutment means both of which are disposed along a tip end of the sheets supported by said supporting means for regulating the tip end of the sheets, said first abutment means having a first sheet abutment surface and said second abutment means having a second sheet abutment surface, wherein an angle between a surface of the sheet supported by said sheet supporting means and the second sheet abutment surface is smaller than an angle between the surface of the sheet supported by said sheet supporting means and the first sheet abutment surface, and wherein said second abutment means is constituted by an elastically deformable member;

sheet supply means having a semi-circular roller for feeding out the sheet supported by said sheet supporting means and regulated by said first and second abutment means positioned in the regulating position, wherein said second abutment means is elastically deformed by the sheet fed out by said sheet supply means;

separation means disposed downstream of said sheet supply means for separating the sheets fed out by said sheet supply means;

convey means disposed downstream of said separation means for conveying the sheet separated by said separation means; and guide means for guiding the separated sheet to said convey means in a deflective state; and an image forming means for forming an image on the sheet fed out by said sheet supply means;

wherein, when conveying the separated sheet by said convey means, the sheet, guided by said guide means in a deflective state, is facing the cut portion of the semi-circular roller and remote from said second abutment means returned from a deformed condition.

* * * * *

UNITED STATES PATENT AND TRADEMARK OFFICE

CERTIFICATE OF CORRECTION

PATENT NO. : 5,918,873

DATED : July 6, 1999

INVENTOR(S) : HIROYUKI SAITO, ET AL.

It is certified that error appears in the above-identified patent and that said Letters Patent is hereby corrected as shown below:

COLUMN 2,
Line 33, "β°°to" should read --β° to"-;
Line 40, "in the" should read -the-; and
Line 61, "abut" should read -abuts-.

COLUMN 6,
Line 2, "comprised" should read -comprises-.

COLUMN 7,
Line 5, "to" should be deleted; and
Line 37, "than" should read -that-.

COLUMN 8,
Line 26, "formed" should read -be formed-; and
Line 63, "angle a" should read -angle α-.

COLUMN 9,
Line 15, "synchronous" should read -synchronism-.

UNITED STATES PATENT AND TRADEMARK OFFICE

CERTIFICATE OF CORRECTION

PATENT NO. : 5,918,873

DATED : July 6, 1999

INVENTOR(S) : HIROYUKI SAITO, ET AL.

It is certified that error appears in the above-identified patent and that said Letters Patent is hereby corrected as shown below:

COLUMN 15,
Line 26, "synchronous" should read -synchronism-.

COLUMN 19,
Line 63, "chronous" should read -chronism--.

COLUMN 22,
Line 57, "used" should read -and-.

COLUMN 23,
Line 14, "sheet." should read -sheets.-; and
Line 36, "sheet" should read -sheets-.

UNITED STATES PATENT AND TRADEMARK OFFICE

CERTIFICATE OF CORRECTION

PATENT NO. : 5,918,873

DATED : July 6, 1999

INVENTOR(S) : HIROYUKI SAITO, ET AL.

It is certified that error appears in the above-identified patent and that said Letters Patent is hereby corrected as shown below:

COLUMN 24,
Line 35, "coney" should read -convey-; and
Line 59, "a" should read -an-.

Signed and Sealed this

Fifteenth Day of February, 2000

*Attest:*

Q. TODD DICKINSON

*Attesting Officer*

*Commissioner of Patents and Trademarks*